US010202746B2

(12) United States Patent
Marsic et al.

(10) Patent No.: US 10,202,746 B2
(45) Date of Patent: Feb. 12, 2019

(54) FILL VALVE ASSEMBLY

(71) Applicant: Waxman Consumer Products Group Inc., Bedford Heights, OH (US)

(72) Inventors: Martin Marsic, Highland Heights, OH (US); Jason A. Sharratt, Wadsworth, OH (US); Tianzhe Wang, Shaker Heights, OH (US)

(73) Assignee: Waxman Consumer Products Group Inc., Bedford Heights, OH (US)

( * ) Notice: Subject to any disclaimer, the term of this patent is extended or adjusted under 35 U.S.C. 154(b) by 56 days.

(21) Appl. No.: 15/411,442

(22) Filed: Jan. 20, 2017

(65) Prior Publication Data

US 2017/0211264 A1 Jul. 27, 2017

Related U.S. Application Data

(60) Provisional application No. 62/287,229, filed on Jan. 26, 2016.

(51) Int. Cl.

| | |
|---|---|
| ***E03D 1/36*** | (2006.01) |
| ***E03D 5/092*** | (2006.01) |
| ***E03D 1/32*** | (2006.01) |

(52) U.S. Cl.

CPC ..... *E03D 1/36* (2013.01); *E03D 1/32* (2013.01); *E03D 5/092* (2013.01)

(58) Field of Classification Search

CPC ..... E03D 1/36

USPC ..... 4/391

See application file for complete search history.

(56) References Cited

U.S. PATENT DOCUMENTS

| | | | |
|---|---|---|---|
| 5,769,111 | A | 6/1998 | Han |
| 6,003,541 | A | 12/1999 | Nichols-Ray |
| 6,510,866 | B2 | 1/2003 | Li |
| 6,666,228 | B1 | 12/2003 | Li |
| 7,029,216 | B2 | 4/2006 | McKay |
| 8,104,105 | B1 | 1/2012 | Schuster et al. |
| 2013/0187072 | A1 | 7/2013 | Guthrie et al. |
| 2014/0345703 | A1 | 11/2014 | Han |

*Primary Examiner* — Christine Skubinna

(74) *Attorney, Agent, or Firm* — Tarolli, Sundheim, Covell & Tummino LLP

(57) ABSTRACT

A fill valve assembly for use in a water storage tank including: a tube; an inlet valve assembly supported by the tube and including an inlet valve and a valve lever operatively coupled to the inlet valve, the inlet valve being on in a first position of the valve lever, and being off in a second position of the valve lever; a float constrained for axial movement in a direction along the tube and coupled to the valve lever; and a linkage assembly positioned between the valve lever and the tube and pivoting between a first upright position wherein the valve lever is maintained in the first position and a second folded position, the linkage assembly including a pivot axis transverse to a longitudinal axis of the tube, the float coupled to linkage assembly and constrained from axial movement when the linkage assembly is in the upright position.

25 Claims, 29 Drawing Sheets

FILL VALVE ASSEMBLY

CROSS REFERENCE TO RELATED APPLICATION

The following application claims priority under 35 U.S.C. § 119(e) to U.S. Provisional Patent Application Ser. No. 62/287,229, filed Jan. 26, 2016 entitled FILL VALVE ASSEMBLY. The above-identified application is incorporated herein by reference in its entirety for any and all purposes.

TECHNICAL FIELD

This disclosure relates to a fill valve assembly fir a water storage tank. In one exemplary embodiment the fill valve assembly is installed in a tank of a toilet for the purpose of refilling the toilet tank and the toilet bowl after a flush actuation. The fill valve assembly of the present disclosure includes an inlet valve, a float mounted to a post, and a linkage assembly to prevent refilling of the toilet tank absent actuation of a flush handle and an overflow tube manifold to facilitate changing a volume of water directed into the overflow tube for filling the toilet bowl after a flush actuation.

BACKGROUND

Fill valve assemblies are used in water storage tanks and the like for refilling the storage tank after a predetermined volume of water has been drained or used from the storage tank. In toilets, for example, fill valve assemblies are mounted in a toilet tank of the toilet for the purpose of refilling a toilet tank and a toilet bowl of the toilet after a flush actuation. Upon a flush actuation, a flapper valve in the toilet tank is opened. Water from the toilet tank flows into a toilet bowl of the toilet for purposes of flushing the toilet. The fill valve assembly typically includes a post supporting a water inlet valve. The post is affixed to a bottom wall of the toilet tank and extends through an opening or passageway in the bottom wall of the toilet tank. An inlet end of the post is coupled to and in fluid communication with a water supply line. The post routes supply line water to the inlet valve assembly. When the toilet is flushed, for example, by pushing on an arm of a flush handle mounted on the toilet tank, the flush handle actuation opens the flapper valve also mounted on the bottom wall of the toilet tank. Opening of the flapper valve causes water in the toilet tank to flow into the toilet bowl to flush the bowl. As the water level in the toilet tank decreases the inlet valve is opened and inflowing supply line water line passes through the inlet valve and is routed by the post into the toilet tank. After the water has drained from the toilet tank, the flapper valve returns to its closed position and the inflowing supply line water exiting from the post into the toilet tank refills the toilet tank. At the same time, an overflow tube, also disposed in the toilet tank, is in fluid communication with the toilet bowl for the purpose of filling the toilet bowl after a flush. A portion of the supply line water flowing through the inlet valve is directed into the overflow tube for the purpose of refilling the toilet bowl.

A continuing goal of designers of fill valve assemblies and, specifically, toilet fill valve assemblies, is to prevent or mitigate water loss or waste both during a flush/refill cycle after a Flush actuation and during a holding period between flash actuations. One potential source of water loss during a holding period is caused by a leakage of water from the toilet tank, for example, leakage of water from the toilet tank to the toilet bowl through a leaky flapper valve. Leakage of water from the toilet tank causes the water level in the toilet tank to gradually decrease. The float of the toilet fill valve assembly will move downwardly with the decreasing water level in the toilet tank. When the water level and the float position falls to a float trigger position, the inlet valve will open to refill the toilet tank and the toilet bowl (i.e., the inlet valve and the float will cause a water refill of the toilet tank as if a normal flush/refill cycle was occurring). If the leakage of water is not corrected and the holding period between flush actuations is long, the inlet valve may go through multiple water refill cycles of the toilet tank causing continued water loss over a long period before the leak is discovered and corrective action is taken by the owner to fix the leak. Additionally, since the inlet valve continues to periodically fill the toilet tank with supply line water, the owner of the toilet may not be aware of the leak as the toilet will appear to be functioning properly when used (that is, there will be sufficient water in the toilet tank to complete a flush when a flush actuation occurs), thus, the leakage problem may continued unabated for a prolonged period of time.

Another potential source of water loss results from overfilling the toilet bowl during a water refill cycle after a flush. Typically, a fill tube extends from the toilet fill valve assembly into an upper open end of the overflow tube. During a flush/refill cycle, a portion of the hallowing supply water passing through the inlet valve is routed through the fill tube and directed into overflow tube where the water flows into the toilet bowl to refill the toilet bowl. As the toilet tank is refilling and the inlet valve is open, if the volume of water routed through the fill tube is too great, the bowl will be overfilled during the flush/refill cycle. The excess water directed into the toilet bowl goes down the bowl drain. It would be desirable to have the volume of water flowing into the overflow tube during the flush/refill cycle of the toilet tank to be approximately equal to the volume of water desired for a complete bowl refill, without overfilling of the bowl, that is, without an appreciable amount of water flowing down the bowl drain during the flush/refill cycle.

SUMMARY

In one aspect, the present disclosure concerns a fill valve assembly for use in a water storage tank, the fill valve assembly comprising: a tube assembly including a tube defining a throughbore and a longitudinal axis extending through the throughbore, the tube assembly in fluid communication with a water supply; an inlet valve assembly supported by the tube and including an inlet valve and a valve lever operatively coupled to the inlet valve, in a first position of the valve lever, the inlet valve being in an off state and in a second position of the valve lever, the inlet valve being in an on state; and a linkage assembly positioned between the valve lever and the tube and pivoting between a first upright position wherein the valve lever is in the first position and a second folded position, the linkage assembly comprising a linkage including an upper link, a lower link, and a pivot member pivotally connecting the upper link and the lower link, the pivot member defining a pivot axis of the linkage, the pivot axis being transverse to the longitudinal axis of the tube.

In another aspect, the present disclosure concerns a fill valve assembly for use in a toilet tank, the fill valve assembly comprising: a tube defining a throughbore and a longitudinal axis extending through the throughbore, the tube in fluid communication with a water supply; an inlet valve assembly supported by the tube and including an inlet valve and a valve lever operatively coupled to the inlet valve, in a first position of the valve lever, the inlet valve being in an on state and in a second position of the inlet valve, the inlet valve being in an off state, the inlet valve being in fluid communication with the tube such that in the on state of the inlet valve water flows though the tube and into the toilet tank; a float constrained for axial movement in a direction along the tube; and a linkage assembly positioned between the valve lever and the tube and pivoting between a first upright position wherein the valve lever is maintained in the first position and a second folded position, the linkage including an upper link, a lower link, a pivot member pivotally connecting the upper link and the lower link and defining a pivot axis of the linkage, the pivot axis transverse to the longitudinal axis of the tube, the float coupled to the valve lever such that the float is constrained from axial movement when the linkage assembly is in the upright position.

In another aspect, the present disclosure concerns a fill valve assembly for use in a water storage tank, the fill valve assembly comprising: a tube assembly including a tube defining a throughbore and a longitudinal axis extending through the throughbore, the tube in fluid communication with a water supply, the tube including a first lower stem and a second upper sleeve telescopically mounted on the first lower stem and movable along the tube longitudinal axis; an inlet valve assembly supported by the tube and including an inlet valve and a valve lever operatively coupled to the inlet valve, in a first position of the valve lever, the inlet valve being in an off state and in a second position of the valve lever, the inlet valve being in an on state; and the tube assembly including a tube height adjustment assembly comprising a cam member positioned on the second upper sleeve and a plurality of axially spaced apart detents on the first lower stem, the tube height adjustment assembly including a locked position wherein a portion of the cam member extends into a selected one of the plurality of axially spaced apart detents to inhibit relative axial movement between the second upper sleeve and the first lower stem and an unlocked position wherein the cam member is disengaged from the plurality of axially spaced apart detent allowing relative axial movement between the second upper sleeve and the first lower stem.

In another aspect, the present disclosure concerns a fill valve assembly for use in a water storage tank, the fill valve assembly comprising: a tube assembly including a tube defining a throughbore and a longitudinal axis extending through the throughbore, the tube in fluid communication with a water supply, the tube having a threaded lower shank extending through a bottom wall of the water storage tank; an inlet valve assembly supported by the tube and including an inlet valve and a valve lever operatively coupled to the inlet valve, in a first position of the valve lever, the inlet valve being in an off state and in a second position of the valve lever, the inlet valve being in an on state; a torque limiting nut is threaded onto the lower shank to secure the fill tube assembly to the bottom wall of the water storage tank, the torque limiting nut including an inner threaded member and an outer driver member radially surrounding the inner driver member, the inner threaded member including a cylindrical body defining a longitudinal axis of the torque limiting nut, the cylindrical body including an upper end and an axially spaced apart lower end and an outer wall and a radially spaced apart inner wall, the inner wall including a threaded opening, the outer wall including an annular rim extending radially outwardly, a lower axial surface of the rim includes a plurality of axially extending ramps, each of the ramps of the plurality of axially extending ramps including a downwardly facing angled bearing surface, an upper axial surface of the inner threaded member cylindrical body defines a bearing surface of the torque limiting nut, the outer driver member including the cylindrical body extending between an upper end and the axially spaced apart lower end and including an outer wall and a radially spaced apart inner wall, the inner wall including a central longitudinal opening which receives the inner threaded member, the upper end of the body of the outer driver member including a plurality of axially extending ramps, an upper surface of each ramp of the plurality of ramps defining an upwardly facing angled wedging surface, each ramp of the plurality of ramps having a base and being pivotable about the base in an axial direction substantially parallel to the longitudinal axis of the torque limiting nut, the upwardly facing angled wedging surfaces of the plurality of ramps of the outer driver member engaging corresponding downwardly facing angled bearing surfaces of the plurality of ramps of the inner threaded member such that as the outer driver member is rotated about the longitudinal axis of the torque limiting nut, the inner threaded member is also rotated.

BRIEF DESCRIPTION OF THE DRAWINGS

The foregoing and other features and advantages of the present disclosure will become apparent to one skilled in the art to which the present invention relates upon consideration of the following description of the invention with reference to the accompanying drawings, wherein like reference numerals refer to like parts unless described otherwise throughout the drawings and in which.

DETAILED DESCRIPTION

Figure 1:
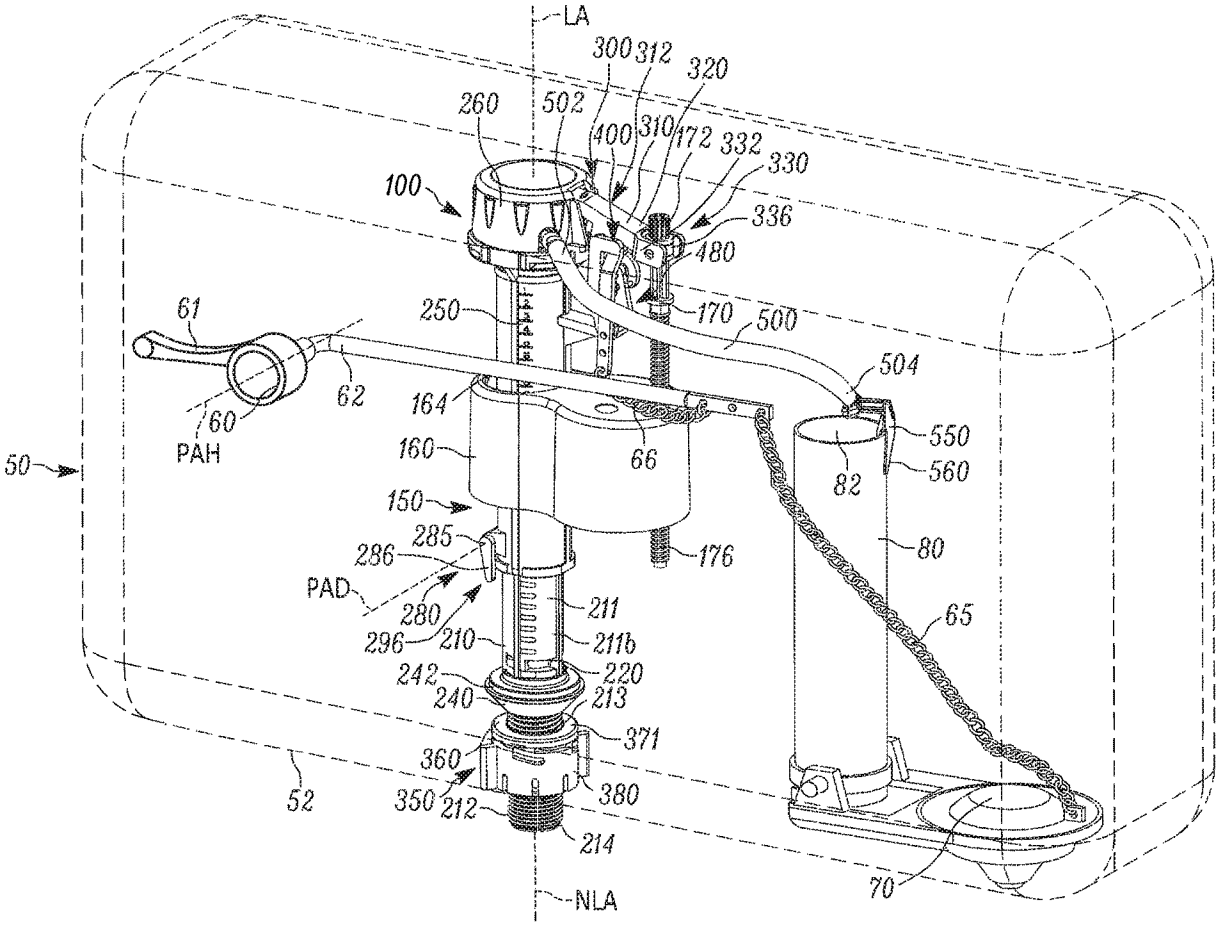
FIG. 1 is a schematic front, right side perspective view of a first exemplary embodiment of a fill valve assembly of the present disclosure, as mounted in a toilet tank of a toilet, with a linkage assembly of the fill valve assembly in an upright position to prevent opening of a water inlet valve of a water inlet valve assembly.
Figure 2:
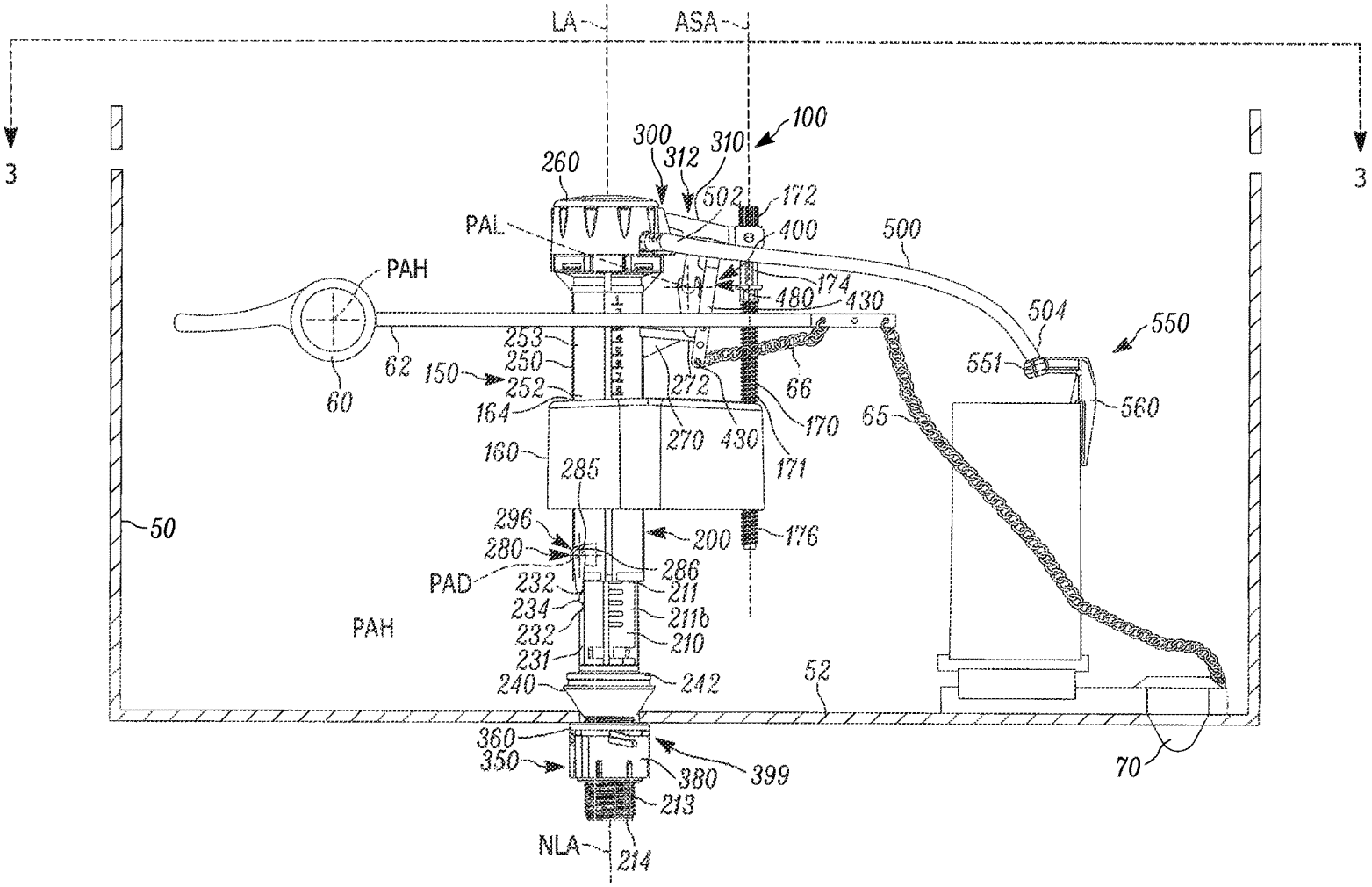
FIG. 2 is a schematic front elevation view, with the toilet tank in section, of the fill valve assembly of FIG. 1.
Figure 3:
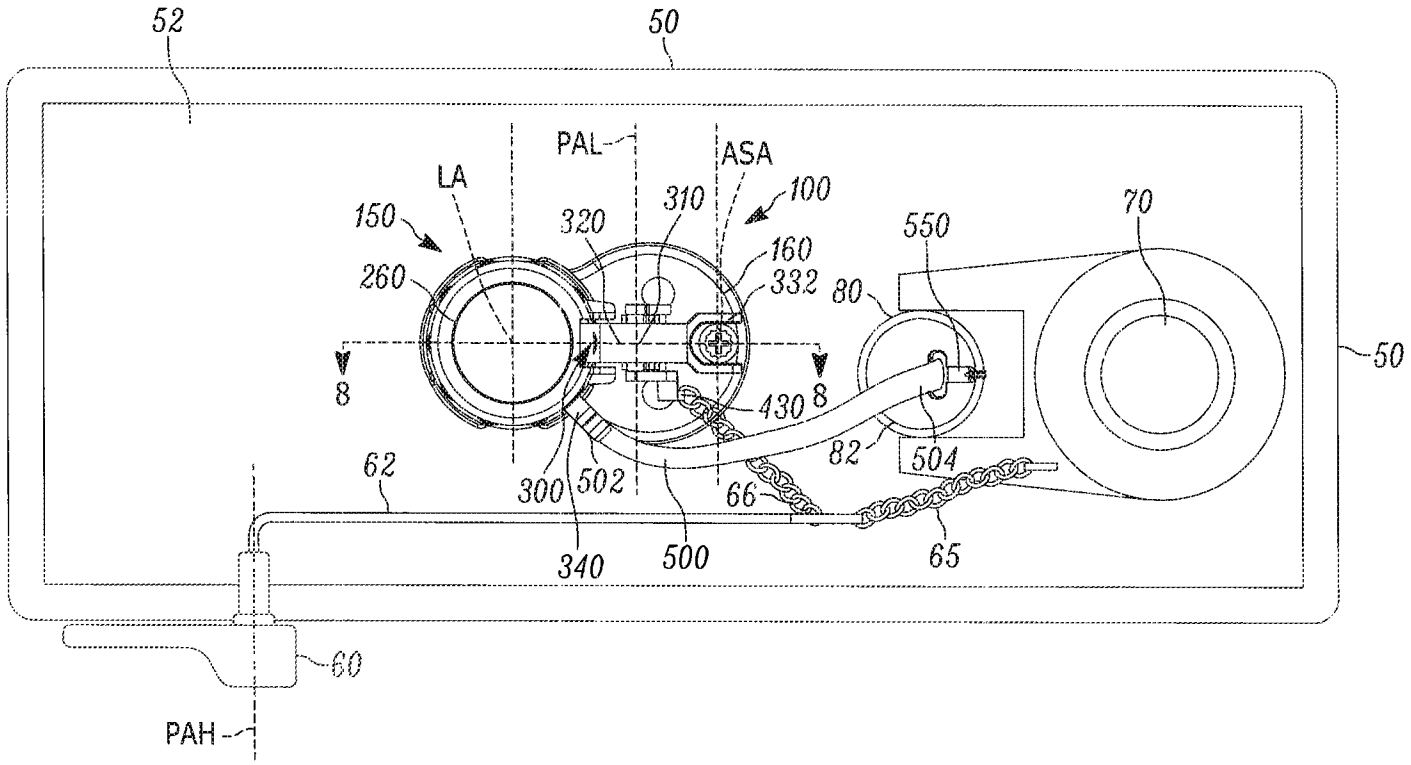
FIG. 3 is a schematic top plan view of the fill valve assembly of FIG. 1.

Referring now to the Figures generally wherein like numbered features shown therein refer to like elements throughout unless otherwise noted. The present disclosure relates to a fill valve assembly for use in a water storage tank for replenishing water to the storage tank. In one exemplary embodiment, the fill valve assembly is used in a toilet tank in connection with replenishing water to a toilet tank and a toilet bowl of a toilet, during a flush/refill cycle of the toilet. More specifically, the fill valve assembly includes a linkage mechanism or linkage assembly which, in an upright or over-center position, supports a valve lever of an inlet valve such that the inlet valve will remain closed until and unless a flush handle of the toilet is operated or actuated. In this way, in the event that there is a water leakage from the toilet tank, e.g., leakage through the flapper valve, the fill valve assembly will not cycle through repeated refill cycles of the toilet tank. That is, absent a flush actuation of the flush handle of the toilet, the linkage assembly of the fill valve assembly of the present disclosure will advantageously prevent opening the inlet valve to replenish the water volume in the toilet tank from a supply line water, in the event that there is leakage of water from the toilet tank between flush actuations. Otherwise, when a trigger level is reached in the toilet tank because of water leakage, the inlet valve would be turned on to refill the toilet tank, thereby causing repeated water loss. In addition to repeated water loss from refilling the toilet tank between flush actuations, supply line water routed by the inlet valve to an overflow tube in the toilet tank would flow into the toilet bowl, where the water would be lost based on overfilling the toilet bowl. Additionally and advantageously, due to the linkage assembly, if there is a water leak in the toilet tank and the toilet tank empties or nearly empties the toilet tank, the owner of the toilet will be made aware of the leakage problem when the flush handle of the toilet is actuated. With little or no water remaining in the toilet tank due to, for example, a leaky flapper valve would result in little or no flush water in the tank. When the owner actuates the flush handle, little or no water will flow from the toilet tank into the toilet bowl. Thus, the owner will be made aware of the leakage problem so that corrective action to stop the leak can be undertaken.

Turning to the drawings, one exemplary embodiment of the fill vale assembly of the present disclosure is schematically shown at 100, in FIGS. 1-10, as mounted in a water storage tank. In one exemplary embodiment, the water storage tank is a toilet tank 50 of a toilet; however, one of ordinary skill in the art would recognize that the fill valve assembly 100 would be use with other water storage tanks having similar function and structure to the toilet tank 50. In one exemplary embodiment, the fill valve assembly 100 includes a tube assembly 150, including a float 160, a height-adjustable tube 200 and a torque limiting nut 350 for securing the tube 200 to a bottom wall 52 of the toilet tank 50. The fill valve assembly 100 further includes a water inlet valve assembly 300 including an inlet valve 305 for controlling the flow of supply line water into the toilet tank 50 and the toilet bowl and a pivoting valve lever 310 which functions to open and close the inlet valve 305. In an upper or closed position 312 of the valve lever 310, as shown, for example, in FIGS. 1, 2, 6, 7 and 8, the inlet valve 305 is in a closed position or state and no supply line water flows into the toilet tank 50, while in a lower or open position 314 of the valve lever 310, as shown, for example, in FIGS. 4, 5 and 9, the inlet valve 305 is in an open position or state and supply line water flows through the inlet valve 305 and ultimately into the toilet tank 50 to refill the tank after a flush actuation. A flush actuation results from actuating or depressing an arm 61 of a flush handle 60 pivotally coupled to the toilet tank 50.

As best seen in FIGS. 6-9 and 21, the fill valve assembly 100 additionally includes a linkage mechanism or assembly 400 disposed between the tube assembly 150 and the water inlet valve assembly 300. The linkage assembly 400 includes a pivoting linkage 405 which pivots or translates between a first, upright or over center position 480 and a second, folded position 490. In the upright position 480, the linkage assembly 400 prevents refill of the toilet tank with supply line water by preventing downward movement or pivoting of the valve lever 310 except when there is a flush actuation of the toilet. In the folded position 490 of the linkage assembly 400, the downward pivoting of the valve lever 310 is permitted such that the valve lever 310 can pivot to its lower position thereby opening the inlet valve 305 and refilling the toilet tank 50 with supply line water. The fill valve assembly 100 also include an overflow tube manifold 550 to match to the extent possible a volume of supply line water directed into the toilet bowl such that the bowl is sufficiently filled during a flush/refill cycle, that is, the during the cycle time needed to refill the toilet tank 50 with supply line water after a flush actuation of the toilet, a sufficient portion of the supply line water is directed through an overflow tube 80 of the toilet tank 50 and into the toilet bowl to properly fill the bowl, without undue wasting of supply line water resulting from overfilling the bowl. Overfilling the toilet bowl during, a flush/refill cycle after a flush actuation of the toilet results in excess water in the bowl being routed down the drain of the toilet. Advantageously, the overflow tube manifold 550 provides for a selected one of a plurality of flow rates of supply line water directed into the overflow tube 80 and into the toilet bowl. Given that different toilet howls have different water volumes required to properly fill the bowl, the ability of an owner to select a flow rate from a plurality of flow rates offered by the manifold 550 is advantageous. The owner will select a flow rate from the plurality of flow rates provided by the manifold 550 to properly fill the toilet bowl during the cycle time after a flush actuation of the toilet, without undue overfilling of the toilet bowl.

Overview

Figure 4:
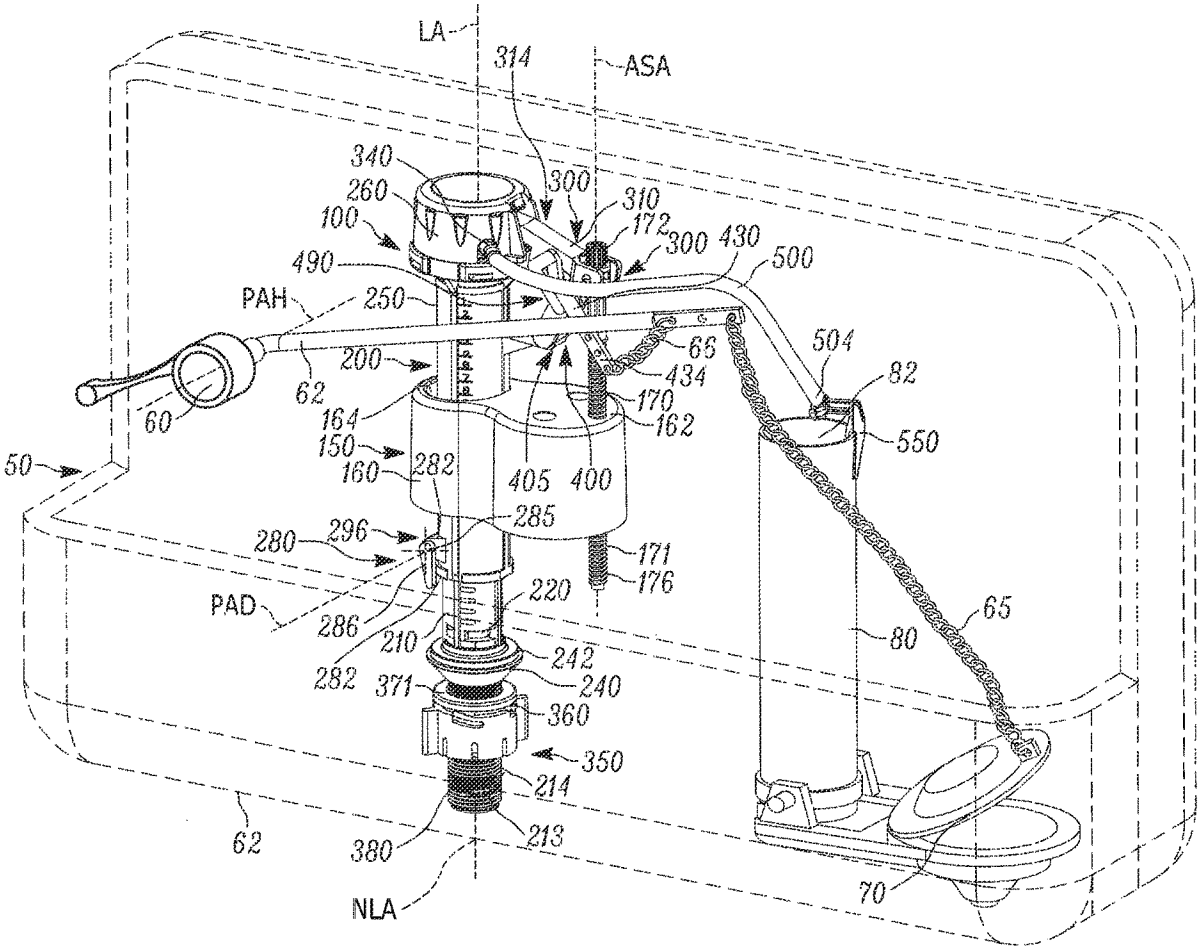
FIG. 4 is a schematic front, right side perspective view of the fill valve assembly of FIG. 1, as mounted in the toilet tank, with the linkage assembly of the fill valve assembly in a folded position after a flush actuation of an arm of a flush handle the toilet.

Affixed to the toilet tank 50 is the flush handle 60 and a flush bar 62 extending from the handle 50. As best seen in FIG. 4, when an arm 61 of the flush handle 60 is actuated or depressed (flush actuation), the handle 60 pivots about a handle pivot axis PAH. The flush bar 62, which extends in a generally opposite direction from an extent of the arm 61 with respect to the handle pivot axis PAH raises or pivots upwardly. A chain or strap 65 extends between an aperture in the flush bar 62 and a flapper valve 70. The flapper valve 70 covers an opening in the bottom wall 52 of the toilet tank 50. Opening the flapper valve 70 cause water to flow from the toilet tank 50 into a toilet bowl (not shown) for purposes of flushing the bowl, as would be understood by those of skill in the art. Also disposed in the toilet tank 50 is the overflow tube 80 which is in fluid communication with the toilet bowl. Supply line water directed into an open upper end 82 of the overflow tube 80 is routed or flows into the toilet bowl for purposes of refilling the bowl during a flush/refill cycle which takes place after a flush actuation.

As used herein a flush refill cycle refers to a cycle time from opening of the inlet valve 305 after a flush actuation of the flush handle 60 to the completion of refilling of the toilet tank 50 and the toilet bowl with supply line water and the closing of the inlet valve 305. That is, after a flush actuation of the flush handle 60, the flapper valve 70 opens and water stored in the toilet tank 50 drains from the toilet tank 50 and is routed into the toilet bowl for purposes of flushing the bowl. When the water level in the toilet tank 50 falls as water is draining from the tank 50, the float 160, which is buoyant on and falls with the water level in the tank 50, moves vertically downward as the float 160 is constrained or limited to axial (up and down) movement by the tube 200. When the float 160 drops to a lower trigger level, the valve lever 310 of the inlet valve assembly 300, which operatively coupled to the inlet valve 305 and is coupled to the float 160 by a vertical float height adjustment screw 170, is pivoted downwardly to an angular position wherein the inlet valve 305 is opened. This commences the flush/refill cycle. After the flush actuation of the flush handle 60, the toilet tank 50 drains and the flapper valve 70 closes. The open inlet valve 305 causes supply line water to be directed into both the toilet tank 50, via a tube 200 of the tube assembly 150, and the toilet bowl, via the overflow tube 80. Supply line water is directed from the inlet valve 305 to the overflow tube 80 through a water a fill tube 500 and an overflow tube manifold 500 of the fill valve assembly 100. As the toilet tank water level increases, the float 160 moves upwardly causing the valve lever 310 to pivot upwardly. When the float 160 reaches an upper trigger level, an angular position of the valve lever 310 moves from a lower open position 314 to an upper closed position 312 such that the inlet valve 305 closes and the supply of water routed to the toilet tank 50 and the toilet bowl is stopped. This ends the flush/refill cycle.

At the same time, the linkage assembly 400, which was in a folded position 490 as a result of the flush actuation of the flush handle 60, commences to move from the folded position 490 to an upright position 480 as the water level in the toilet tank 50 increases and the valve lever 310 is pivoted upwardly from the lower open position 314 to the upper closed position 312. As the valve lever 310 pivots upwardly, the linkage assembly 400 opens or moves or pivots from its folded position 490 to its upright position 480. When the valve lever 310 reaches its upper closed position 312, the linkage assembly 400 reaches its upright position 380. With the linkage assembly 400 in the upright position 380, the valve lever 310 is prevented from pivoting downwardly to its lower open position 314 and thereby opening the inlet valve 305 and commencing a refilling cycle of the toilet tank 50. Even if there is water leakage or loss from the toilet tank 50, the linkage assembly 400, in its upright position 380, will prevent the valve lever 310 from pivoting downwardly until and unless a flush actuation of the flush handle 60 occurs. In this way, the linkage mechanism 400 of the present disclosure both prevents or mitigates water loss or waste during a holding period between flush actuations, in the event that there is a leakage or loss of water from the toilet tank 50 between flush actuations. Additionally and advantageously, the linkage assembly 400, by not permitting refilling of the toilet tank 50 between flush actuations, will make the owner aware of the leakage problem because the amount of water remaining in the toilet tank 50 after a prolonged leaking period between flush actuations, will likely be insufficient to properly flush the toilet. Hence, the owner will be made aware that there is a problem with the toilet When the inlet valve 305 is open, the valve 305 also routes a portion of the supply line water into the fill tube 500. Supply line water flowing through the fill tube 500 is routed through a selected one of a plurality of inlet ports 552 of the overflow tube manifold 550 positioned at the upper open end 82 of the overflow tube 80. Water exits the manifold 550 through an outlet port 570 and flows into the overflow tube 80 and subsequently into the toilet bowl for purposes of refilling the bowl during a flush/refill cycle. As will be explained below, depending on the inlet port selected of the plurality of inlet ports 552, for connecting a distal end 504 of the fill tube 500, the flow rate of water into the overflow tube 80 is determined. In one exemplary embodiment, the plurality of inlet ports 552 of the manifold 550 comprise three inlet ports 554, 556, 558. Each of the three inlet ports 554, 556, 558 provide for differing flow rates into the overflow tube 80. It is desired for the owner to select the inlet port which results in the total volume of water flowing into the bowl during a flush/refill cycle such that the bowl is sufficiently filled, but not overfilled during the period of the flush/refill cycle.

Tube 200

As can best be seen in FIGS. 6-9 and 22-23, in one exemplary embodiment, the tube assembly 150 includes the generally cylindrical tube 200, which defines a central longitudinal axis LA through a cylinder defined by the tube 200. Advantageously, in one exemplary embodiment, the tube 200 comprises a two-part telescoping tube which allows for height adjustment of the tube 200. The tube 200 comprises a lower generally cylindrical tube or stem 210 and an upper generally cylindrical telescoping tube or sleeve 250 which slidingly overlies the stem 210. The tube 200 includes a throughbore 202 which extends along and is substantially centered about or coaxial with the longitudinal axis LA. The throughbore 202 is defined by an inner wall 207 of the tube 200, which, in part, is defined by an inner surface 216 of a wall 211 of the stem 210 and, in part, by an inner surface 254 of a sleeve wall 252 of the sleeve 250. The tube longitudinal axis LA also defines a longitudinal axis of the fill valve assembly 100.

The tube 200 extends through an opening in the bottom wall 52 of the toilet tank 50 and is held in place by the torque limiting nut 350 (FIGS. 14-17). As mentioned above, the tube 200 is generally cylindrical and defines the longitudinal axis LA of the fill valve assembly 100. The longitudinal axis LA of the tube 200 is substantially orthogonal to a planar extent of the bottom wall 52 of the toilet tank 50 and substantially orthogonal to the handle pivot axis PAH. Disposed within the throughbore 202 of the tube 200 is an axially extending conduit 204 which is coaxial with the tube 200 about the tube longitudinal axis LA.

Figure 22:
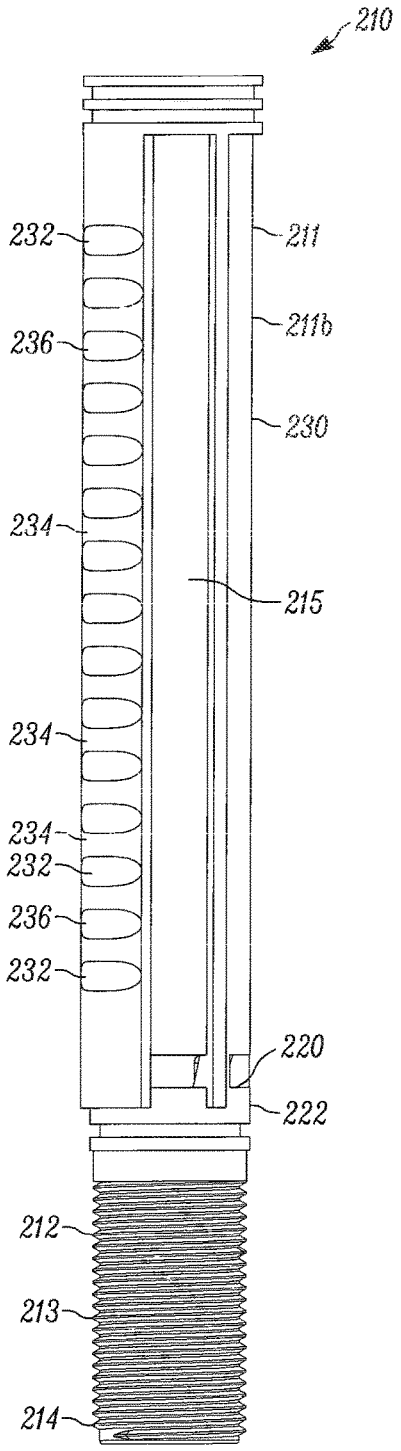
FIG. 22 is a schematic front elevation view of the lower tube of the tube assembly of the fill valve assembly of FIG. 1.
Figure 23:
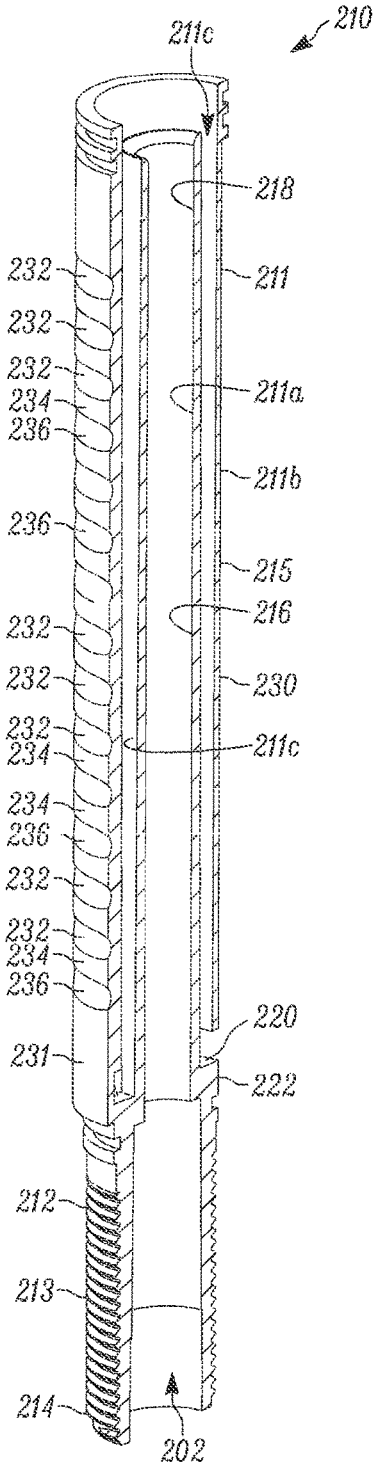
FIG. 23 is a schematic longitudinal view of the lower tube of FIG. 22.
Figure 24:
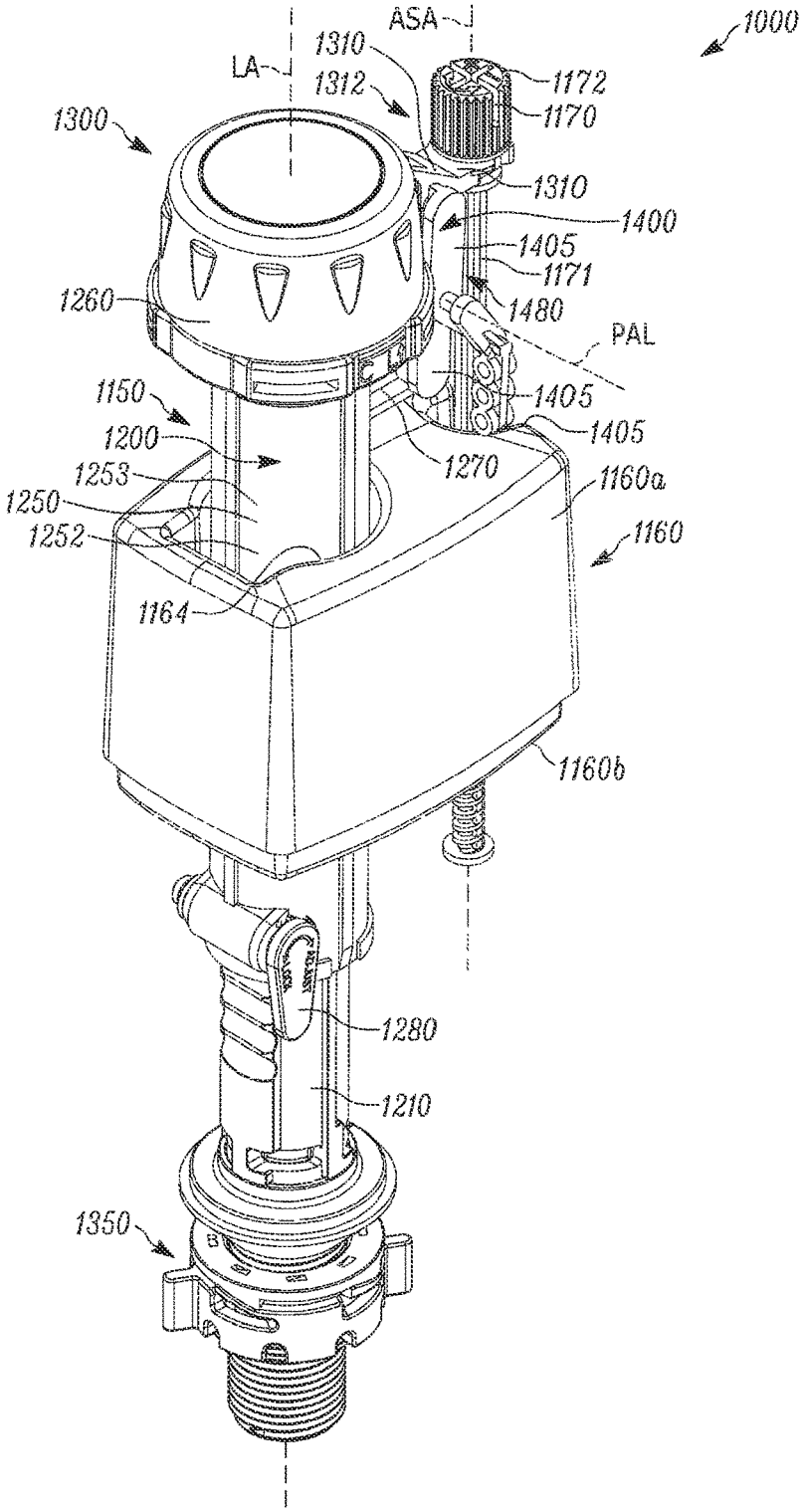
FIG. 24 is a schematic front, left side perspective view of a second exemplary embodiment of a fill valve assembly of the present disclosure, a linkage assembly of the fill valve assembly in an upright or over center position.
Figure 25:
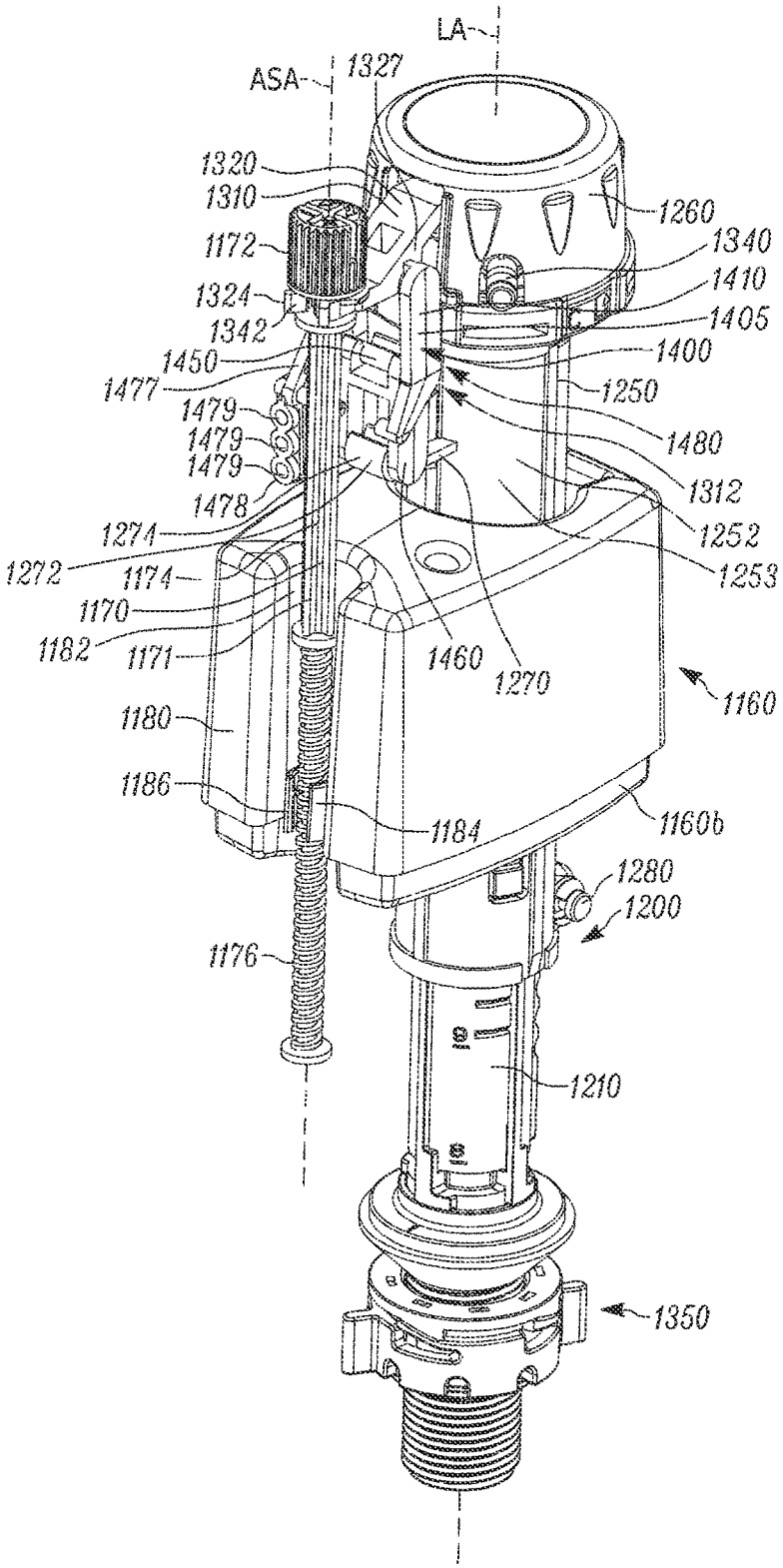
FIG. 25 is a schematic back, right side perspective view of the fill valve assembly of FIG. 24, with a manifold and fill tube removed from the assembly for clarity purposes, the linkage assembly of the fill valve assembly in an upright or over center position.

The stem, best shown in FIGS. 22 and 23, includes a lower portion 212, a middle portion 222 axially above the end portion 212 and an upper portion 230 axially above middle portion 222. In the lower portion 212 of the stem 210, a threaded shank 213 is formed on an outer surface 215 of the wall 211 of the stem 210. In the regions of the middle and upper portions 222, 230 of the stem, the stem wall 211 comprises a generally cylindrical inner wall 211*a* and a radially spaced apart generally cylindrical outer wall 211*b*, both of which are centered about and coaxial with the longitudinal axis LA. A longitudinally extending cylindrical slot 211*c* extends between the inner and outer wall 211*a*, 211*b*. The slot 211*c* is substantially coaxial about the tube longitudinal axis LA. The inner wall 211*a* of the stem 210 defines a portion of the inner surface 207 of the tube 200 and defines the inner surface 216 of the stem wall 211. The middle portion 222 of the stem includes a plurality of openings 220 through the outer wall 211*b* of the stem wall 211 allowing supply line water to exit the tube 200 and flow into the toilet tank 50 during a flush/refill cycle. The plurality of openings 220 are in fluid communication with the cylindrical slot 211*c* between the inner and outer walls 211*a*, 211*b*.

Figure 8:
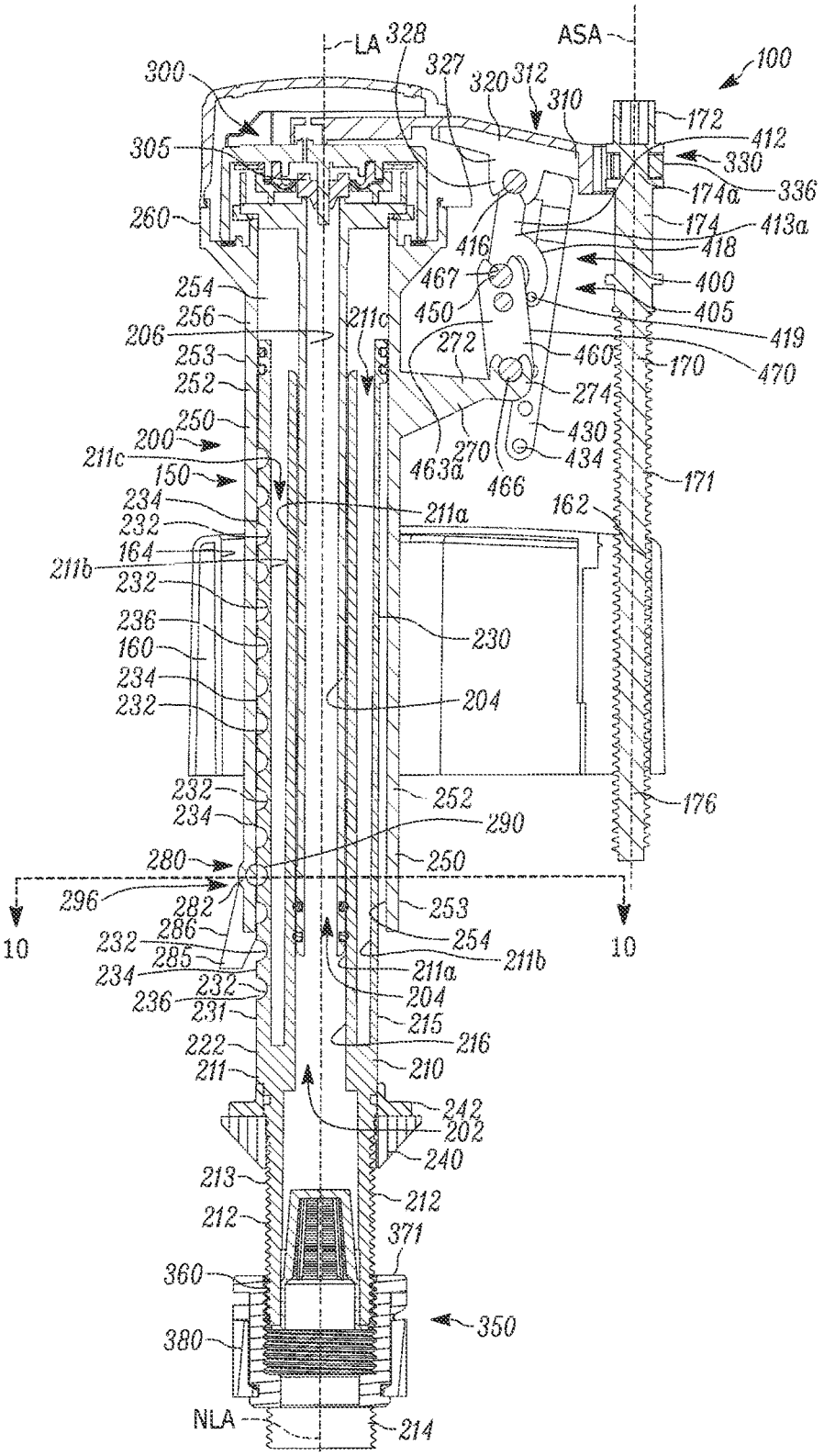
FIG. 8 is a schematic longitudinal section view of the fill valve assembly of FIG. 1, as seen from a plane indicated by the line 8-8 in FIG. 3, with the manifold and fill tube removed from the assembly for clarity purposes.

As can best be seen in FIG. 8, the tube 200 includes the conduit 204 positioned within the throughbore 202 of the tube 200. Specifically, over a part of its axial extent, the conduit 204 is supported by the inner wall 211*a* of the stem wall 211 of the stem 210. The conduit 204 is in fluid communication with the inlet valve 305 of the inlet valve assembly 300 such that pressurized supply line water entering the tube 200 through the shank 213 is routed upwardly through a central passageway 206 of the conduit 204 to the inlet valve 305. When the inlet valve 305 is open, the valve 305 routes a portion of the supply line water from the conduit 204 back down the cylindrical slot 211*c* between the inner and outer walls 211*a*, 211*b* of the wall 211 of the stem 210 where the supply line water exits into the toilet tank 50 through the plurality of openings 220 in a middle portion of the stem 210 above the lower end portion 212. The openings 220 of the stem 210 are within an interior region of the toilet tank 50 such that the supply line water refills the tank 50 during a flush/refill cycle while the inlet valve 305 is open.

The upper portion 240 of the stem 210 included an axially extending column 231 which is part of radially thickened portion of an outer surface 215 of the stem wall 211, which corresponds to an outer surface of the stem outer wall 211*b*. The axial column 231 includes a plurality of axially spaced apart peripheral recesses or detents 232. In one exemplary embodiment the number of detents 232 is fifteen. The plurality of peripheral detents 232 are part of a tube-height adjustment assembly or mechanism 280. Each detent of the plurality of detents 232 defines a central cylindrical surface 236 which functions as a bearing surface for a corresponding cylindrical body 290 of a cam member 295*a*, which in one exemplary embodiment is a dowel pin 285. The dowel pin 285 is also part of the tube-height adjustment assembly 280. When the cylindrical body 290 of the dowel pin 285 is received in a selected detent of the plurality of detents 232, the tube-height adjustment assembly 280 is in a locked position 296 wherein relative axial movement between the upper tube or sleeve 250 with respect to the lower tube or stem 210 is inhibited and relative rotational movement between the upper tube or sleeve 250 with respect to the lower tube or steer 210 is also inhibited. The raised column 231 of the stem 210 also includes a plurality of flats or planar surfaces 234 extending axially between each adjacent pair of detents of the plurality of detents 232. The flat or planar surfaces 234 of the axial column 231 of the stem outer wall 211*b* functions an anti-rotation feature to prevent relative rotation of the sleeve 250 with respect to the stem 210 when the tube-height adjustment assembly 280 is in an unlocked position 298.

As best seen in FIGS. 6-9, the axially extending, generally cylindrical sleeve 250 of the tube 200 of the tube 150 assembly slidingly overlies part of the upper portion 230 of the stem 210 and includes a generally cylindrical wall 252 having an inner surface 254 and a radially spaced apart outer surface 253. The sleeve cylindrical wall 252 is also centered about and coaxial with the longitudinal axis LA and the inner surface 254 of the sleeve wall 252 defines a portion of the inner surface 207 of the tube 200. The sleeve 250 includes a lower portion 258 and an upper portion 256 axially above the lower portion 258. The outer surface 253 of the sleeve 250 includes a radially extending pedestal 270 which rotatably supports a lower link 460 of a linkage assembly 400. Specifically, a split or open sleeve bearing 274 is tinned at a distal end 272 of the pedestal 270. The open sleeve bearing 274 spreads apart and receives a crosspiece 466 of the lower link 460 of the linkage assembly 400 in a snap fit engagement and supports the crosspiece for rotational or pivotal movement of the lower link 460 as the linkage assembly 400 moves from an upright position 480 wherein an inlet valve 305 the inlet valve assembly 300 is prevented from refilling the toilet tank 50 to a folded position 490 wherein the inlet valve 305 of the inlet valve assembly 300 is opera to refill the toilet tank 50. Disposed at an upper end of the sleeve 250 is a cap or housing 260 which houses the inlet valve assembly 300. The valve lever 310 of the valve assembly 300 extends through a side opening 262 of the housing 260 and pivots with respect to the sleeve 250.

The lower end portion 212 of the stem 210 includes the threaded shank 213. As noted above, the torque limiting nut 350 is threaded onto the threaded shank 213 and bears against the bottom wall 52 of the toilet tank 50 to secure the tube assembly 150 to the toilet tank. The lower end portion 212 of the stem also includes a flange 242 and a seal 240 positioned axially below the flange 242 and disposed within the toilet tank 50. The seal 240 bears against and seals against the bottom wall 52 in the region of the bottom wall opening to prevent leakage of water from the toilet tank 50 through the bottom wall 52. The combination of the flange 242, the seal 240 and the torque limiting nut 350 secure the tube assembly 150 to the toilet tank 50 and restrain the tube assembly 150 from axial movement with respect to the tank 50. A threaded fitting (not shown) of a water supply line is threaded onto a distal end 214 of the threaded shank 213 of the stem 210 to supply pressurized water to an interior region of the tube 200 and, ultimately, into the toilet tank 50 and the toilet bowl during a flush/refill cycle.

Tube-Height Adjustment Assembly 280

As best seen in FIGS. 6, 8-13, the tube assembly 150 advantageously includes the tube-height adjustment assembly or mechanism 280. The tube-height adjustment assembly 280 includes the cam member 285*a*. In one exemplary embodiment, the cam member 285*a* comprises the dowel pin 285, which is best seen in FIGS. 10-13. The dowel pin 285 is rotatably mounted in a boss formed on the upper tube or sleeve 250. The dowel pin 285 is rotatable between a locked position 296, in which the sleeve 250 is axially fixed or stationary with respect to the stem 210, and an unlocked position 298, in which the sleeve 250 may be moved axially along the tube longitudinal axis LA to a desired height position within the toilet tank 50. The desired height or axial position of the sleeve 250 will depend on a number of factors including the axial height afforded by the toilet tank 50 and the desired volume of water that the tank 50 will be filled with during a flush/refill cycle. For example, if proper flushing is occurring, the owner may wish to decrease or lower an axial position of the sleeve 250 with respect to the stem 210 as this will result in a reduced volume of water being refilled into the tank 50 during a flush/refill cycle thereby affording reduced water usage per flush.

The tube-height adjustment assembly 280 includes a boss 282 formed on a wall 252 of the sleeve 250. The cylindrical body 290 of the dowel pin 285 is horizontally supported for rotation by the boss 252 and includes a recessed region 292 extending along the body 290. The recessed region 292 includes a central anti-rotation flat 294. The body 290 of the dowel pin 285 functions as a cam in the assembly 280. The body 290 also includes a radial slot 295 which receives a retainer ring to hold the dowel pin 285 in place with respect to the boss 252. The dowel pin 285 includes a handle 286 extending transversely from an extent of the cylindrical body 290. The dowel pin 285 is supported in the boss 252 horizontally (orthogonally to the tube longitudinal axis LA) and the handle 286 rotates or pivots between an up position (FIGS. 1 and 5) corresponding to the locked position 296, and a down position (FIG. 6) corresponding to the unlocked position 298.

Figure 14:
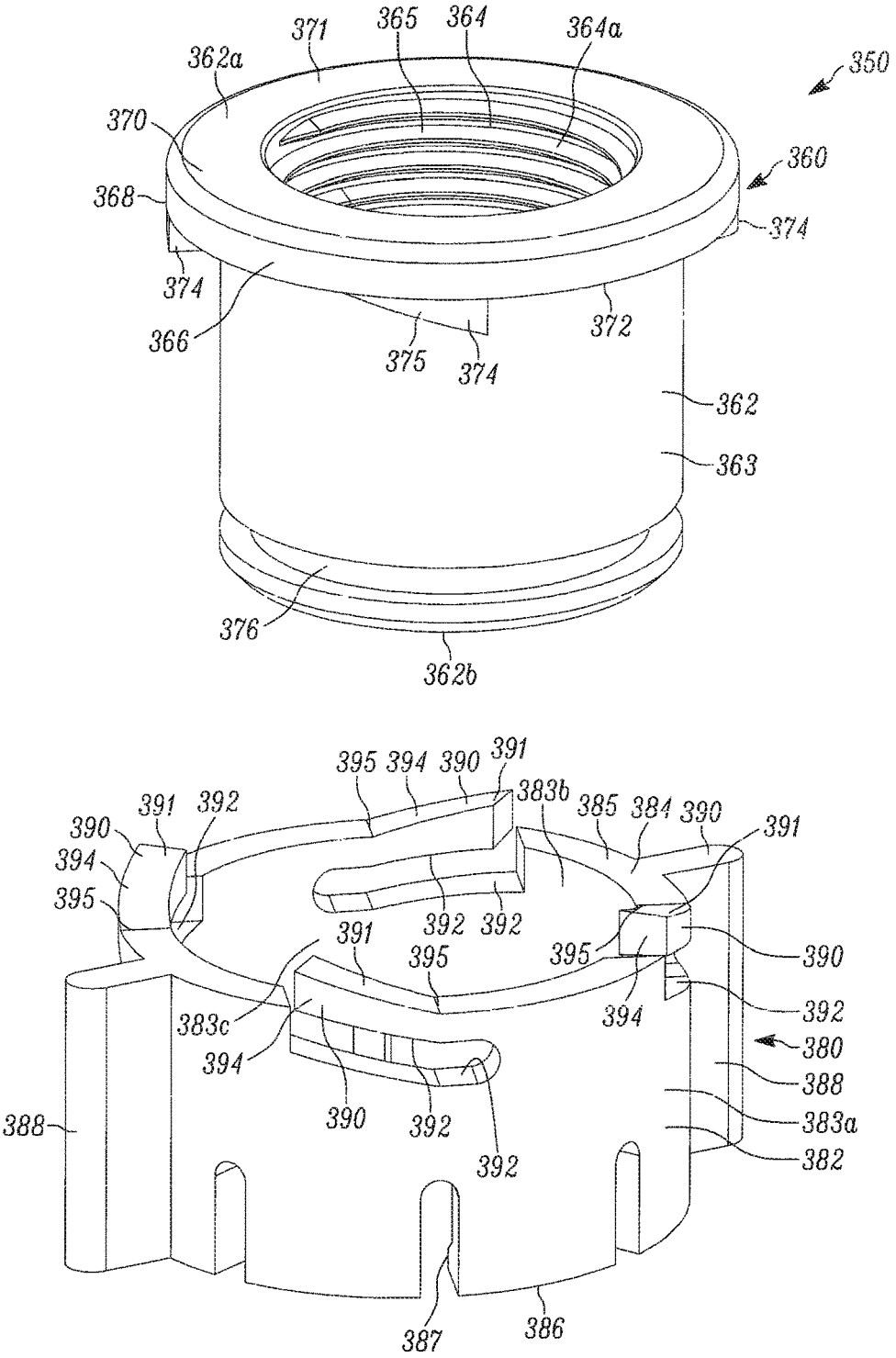
FIG. 14 is a schematic exploded front perspective view of an inner threaded member and an outer driver of a torque limiting nut of the fill valve assembly of FIG. 1.

In the unlocked position 298 of the tube-height adjustment assembly 280, the upper sleeve 250 may be axially moved with respect to the lower stem 210 in an axial range of the dowel pin 285 being aligned with the axially highest detent in the plurality of detents 232 to the dowel pin 285 being aligned with the axially lowest detent the plurality of detents 232. As can be seen in FIG. 14, in the locked position 296 of the tube-height adjustment assembly 280, the cylindrical body 290 of the dowel pin 285 bears against the central cylindrical surface 236 of the selected detent of the plurality of detents 232 and thereby the sleeve 250 is axially and rotatably fixed with respect to the stem 210. The selected detent of the plurality of detents 232 for engagement with the dowel pin 285 is selected by the owner based on a desired final water level in the toilet tank 50 after a flush/refill cycle.

As noted above, the tube-height adjustment assembly 280 includes a vertically oriented raised column 231 that extends radially outwardly from the outer surface 215 of the stem wall 211 in the upper portion 230 of the stem 210. The column 231 includes the plurality of axially spaced apart detents 232 brined on an outer surface of the column 231. Disposed between each of the plurality of spaced apart detents 232 are a plurality of flats 234. Advantageously, because of the interaction of the central flat 294 of the recess region 292 of the dowel pin 285 and the corresponding anti-rotation flat 234 formed in the raised column 231 in the region between the plurality of detents 233, the upper sleeve 250 is prevented from rotating relative to the lower stem 210 about the tube longitudinal axis LA in both the locked position 296 and the unlocked position 298. That is, in the unlocked position 298 of the tube-height adjustment assembly 280, the sleeve 250 prevented from relative rotation with respect to the stem 210 by the engagement of the anti-rotation flat 294 of the cylindrical body 290 of the dowel pin 285 and one of the corresponding flats of the plurality of flats 234 of the raised column 231. In the locked position 296 of the tube-height adjustment assembly 280, the sleeve 250 is prevented from relative rotation with respect to the stem 210 by the engagement of the outer surface of the cylindrical body 290 of the dowel pin 285 against a mating correspondingly configured central cylindrical surface 236 of each of the detents of the plurality of detents 232.

Float 160 and Float Height Adjustment Screw 170

Figure 7:
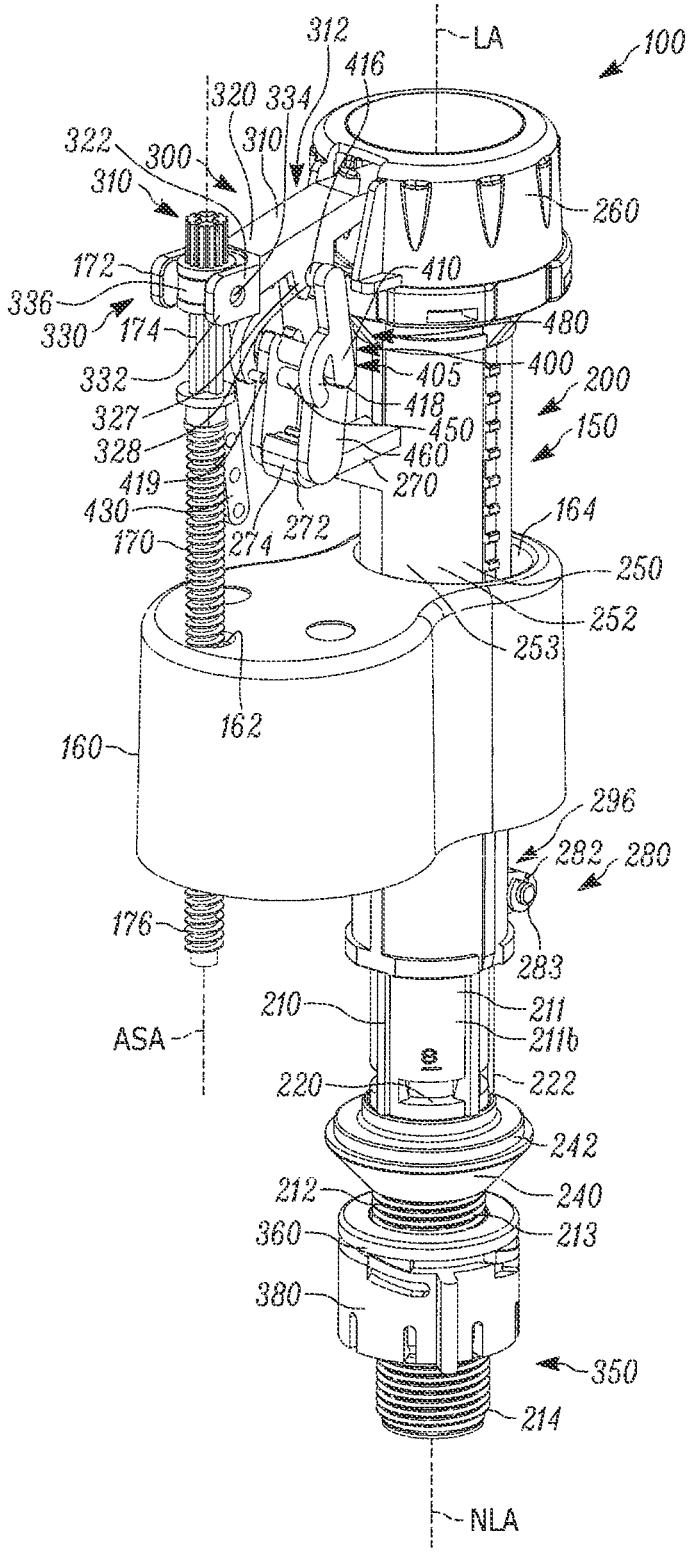
FIG. 7 is a schematic back, right side perspective view of the fill valve assembly of FIG. 1, with the manifold and fill tube removed from the assembly for clarity purposes, the linkage assembly of the fill valve assembly in the upright or over center position.

As can best be seen in FIGS. 7 and 8, the tube assembly 150 also includes the float 160, which surrounds and is constrained for axial (up and down movement) by the tube 200, and a float height adjustment screw 170 which allows for fine axial adjustment of the float position. Changing the axial position of the float 160 will thereby will change the tank water level needed, for example, to move the valve lever 310 from a lower position 314 (FIGS. 4 and 5) (after a flush actuation of the handle 60 wherein water is drained from the toilet tank 50 to flush the toilet) wherein the water inlet valve 305 is open to water to flow into the toilet tank 50 for the purpose of refilling the tank 50 to an upper position 312 (FIGS. 1 and 2) of the valve lever 310 wherein the water inlet valve 305 is closed thereby preventing additional water from flowing into the toilet tank 50. Movement of the float 160 along the tube 200 is parallel to the tube longitudinal axis LA. The float 160 includes an axial opening 164 extending through the float 150 that receives the upper sleeve 250 of the tube 200. The float 160 is thereby constrained to move axially along the tube 200 as the water level in the toilet tank 50 changes and the float 160 is not otherwise constrained from axial movement (as, for example, axially constrained by the linkage assembly 400 when the linkage assembly 400 in is the upright position 480). The float 160 also includes a second threaded axial opening 162 that extends through the float 160. The threaded axial opening 162 is configured to receive a threaded portion 176 of the float height adjustment screw 170. Alternately, instead of the float height adjustment screw 170 extending through the threaded axial opening 162 of the float 160, the float 160, depending on the desired size of the float 160, the float 160 could include a vertically extending threaded opening formed in a boss (not shown) on a side of the float 160 and the float height adjustment screw 170 could threadedly engage and extend though the threaded vertical opening in the boss to adjust the vertical level or height or the float 160.

The float height adjustment screw 170 includes an elongated body 171 which supported for rotation about an axis ASA by a collar 336 of a clevis arrangement 330 disposed at a distal end 324 of the valve lever 310 of the inlet valve assembly 300. The adjustment screw axis ASA is substantially parallel to the tube longitudinal axis LA. The elongated body 171 of the adjustment screw 170 includes the threaded lower portion 176 and an upper knurled portion 172 axially separated by a central cylindrical body portion 174. As best seen in FIG. 8, a necked-down region 174*a* of the central portion 174 is rotatably received in the collar 336. The knurled upper portion 172 allows for easy gripping and rotation of the adjustment screw 170. Rotation of the adjustment screw 170 raises or lowers the float 160, depending on the direction of rotation, by virtue of the threaded engagement of the threaded lower portion 176 and the threaded axial opening 162 of the float 160. The collar 336 constrains the adjustment screw 170 from axial movement thereby causing the float 160 to move axially as the adjustment screw 170 is rotated.

Inlet Valve Assembly 300

Disposed within the cap or housing 260 disposed at an upper end of the upper sleeve 250 of the tube 150 is the water inlet valve assembly 300 including a water inlet valve 305. As can best be seen in FIG. 8, the water inlet valve 305 is in fluid communication with the central passageway 206 of the conduit 204 and is actuated by the outwardly extending valve lever 310 of the inlet valve assembly 300. The valve lever 310 moves pivotally between the upper position 312 (FIGS. 1 and 2) Wherein the water inlet valve 300 is closed and no water flows through the valve 300 and into the toilet tank 50 and a lower position 314 (FIGS. 4 and 5) wherein the water inlet valve 300 is open. When the inlet valve 305 is open, pressurized water from the water supply line flow upwardly through the threaded shank 213 of the tube stem 210, through the central passageway 206 of the conduit 204 and to the inlet valve 305.

The inlet valve 305, when open, routes a portion of the supply line water from the conduit 204 back down the annular passageway 208 defined between the inner surface 207 of the tube 200 and the outer wall 205 of the conduit 204 where the water exits the tube 200 through the plurality of openings 220 in a middle portion of the stem 210 and enters the toilet tank 50. The inlet valve 305, when open, also routes a portion of the supply line water from the conduit 204 into water port 340 disposed on the cap 260 of the tube sleeve 250. The supply line water flows through the port 340 and into a central passageway of the fill tube 500 which is coupled at one end 502 to the port 340. The opposite end of the fill tube 500 is coupled to a selected one of a plurality of ports 552. Water flows from the selected inlet port of the plurality of inlet ports 552 through a corresponding outlet port of a plurality of outlet ports 570 and into the overflow tube 580. The supply line water directed into the overflow tube 80 refills the toilet bowl during a flush/refill cycle. In this way, the inlet valve 305, when open, functions to refill both the toilet tank 50 and the toilet bowl during a flush/refill cycle.

The pivoting valve lever 310 of the inlet valve assembly 300 comprises a lever arm 320. A proximal end 322 of the valve lever arm 320 is operatively coupled to the inlet valve 305 for purposes of opening the inlet valve 305 when the lever 310 is in the lower open position 314 and for closing the valve 305 when the lever 310 is in the upper closed position 112 for any position in between the upper and lower positions 314, 312). That is, the inlet valve 305 does not open until and unless the lever arm 320 of the valve lever is pivoted downwardly sufficiently to reach a trigger angular position which causes the inlet valve 305 to open. It is assumed that the lower position 314 corresponds to the trigger angular position. The lever arm 320 includes a distal end 324 and a lower surface 326 of the arm extending between the proximal and distal ends 322, 324 of the arm 320.

The lower surface 326 of the lever arm 320 includes a downwardly protruding boss 327 (FIG. 7). The boss 327 defines a horizontally extending split sleeve bearing 328 that rotatably receives a cross piece 416 of an upper link 410 of the linkage assembly 400. The split sleeve bearing 328 is part of the lever art 320 of the valve lever 310 of the inlet valve assembly 300 and is also part of the linkage assembly 400. The linkage assembly 400 in the upright or over center position 480 prevents the lever arm 320 of the valve lever 310 from pivoting downward from its upper position 312 (and prevents the inlet valve 305 from opening) unless both the water level in the tank 50 decreases (the float 160, if unconstrained, would move axially downward due to a lowering of the water level in the tank 50) and a flush actuation of the toilet has occurred initiating a flush/refill cycle. That is, when the linkage 405 moves from its upright position 480 to its folded position 490, the cross piece 416 of the upper link 410 rotates in the sleeve bearing 328 of the lever arm 320 of the valve lever 310 and the crosspiece 466 of the lower link 460 of the linkage assembly 400 rotates in the sleeve bearing 274 and a center or pivot member 450 of the linkage assembly 400 rotates in a split sleeve bearing 467 of the lower link 460 of the linkage assembly 400, as the pivot member 450 is moved in a radially outward direction (away from the longitudinal axis LA). As the tank 50 refilled after during a flush/refill cycle, the float 160 rises in the tank 50 with the tank water level. This causes the lever arm 320 of the valve lever 310 to pivot upwardly to its upper position 312, in turn, causing the linkage assembly 400 to move from the folded position 490 to the upright position 480. When the linkage assembly 400 moves from its folded position 490 to its upright position 480, the cross piece 416 of the upper link 410 rotates in rotates in the sleeve bearing 328 of the lever arm 320 of the valve lever 310 and the crosspiece 466 of the lower link 460 of the linkage assembly 400 rotates in the sleeve bearing 274 and the pivot member 450 rotates in the split sleeve bearing 467 of the lower link 460, as the pivot member 450 of the linkage assembly moves in a radially inward direction (toward the longitudinal axis LA).

The distal end 324 of the lever arm 320 includes a clevis arrangement 330 (FIGS. 7 and 8) that includes a clevis 332 and a clevis pin 334. The clevis pin 334 pivotally supports the collar 336. As explained above, the collar 336 rotatable supports the necked-down body portion 174*a* of the float height adjustment screw 170 such that fine axial adjustments of the axial position of the float 160 may be made by the owner. The horizontally oriented clevis pin 334 allows the collar 336 to pivot about a horizontal axis defined by the clevis pin 334. This permits the adjustment screw 170 to remain in a vertical position, parallel to the tube longitudinal axis LA, regardless of the angular position of the lever arm 320 of the valve lever 310. The adjustment screw 170 is constrained to remain in the vertical position because the threaded portion 176 extends through the vertically oriented threaded opening 162 of the float 160 and the float is constrained to remain in the vertical position because of the axial sliding engagement of the float 160 and the tube 200 by virtue of the upper sleeve 250 extending axially through the float opening 164.

Linkage Assembly 400

Figure 5:
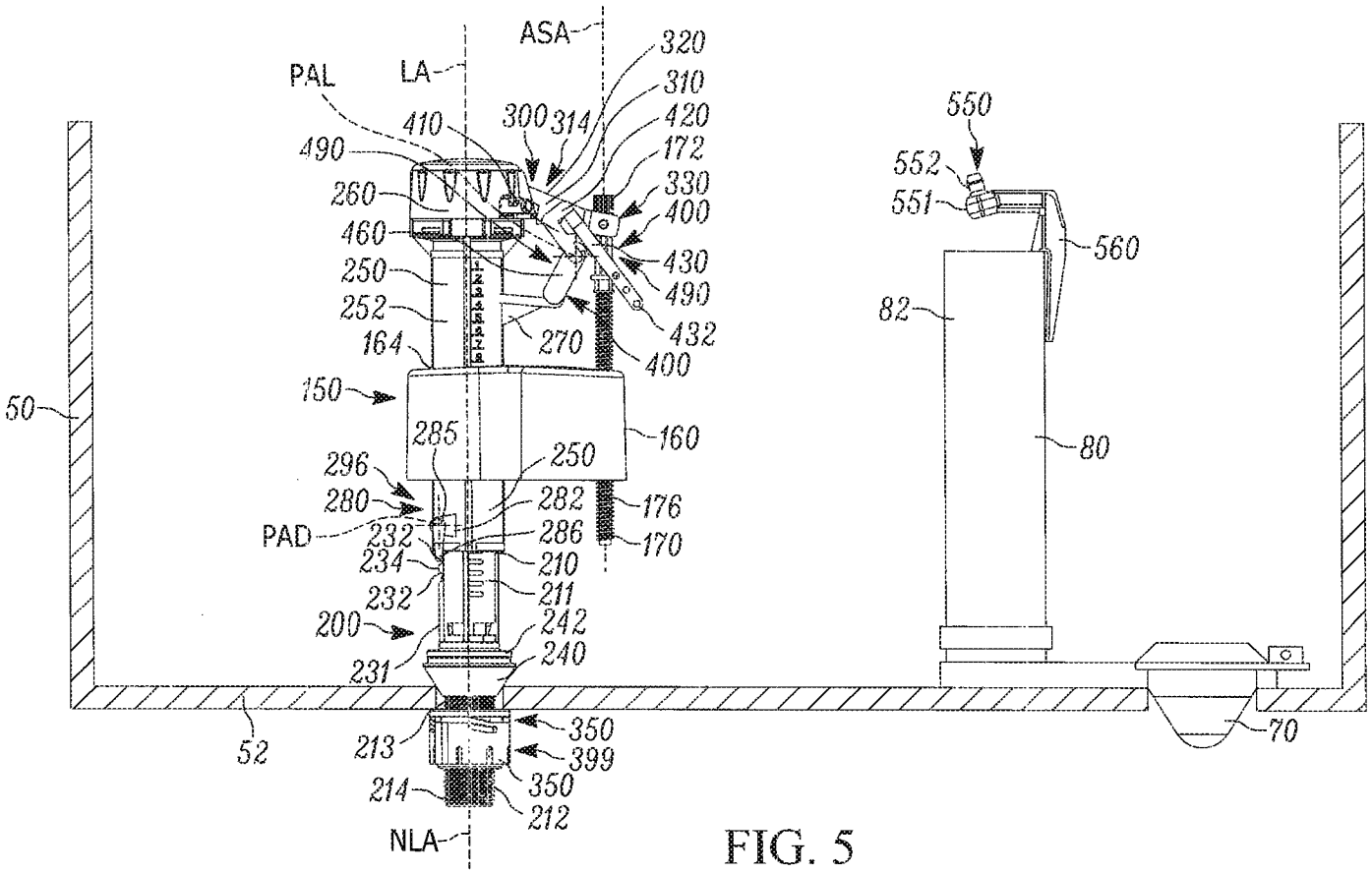
FIG. 5 is a schematic front elevation view, with the toilet tank in section, of the fill valve assembly of FIG. 1 with the linkage assembly of the fill valve assembly in the folded position.
Figure 6:
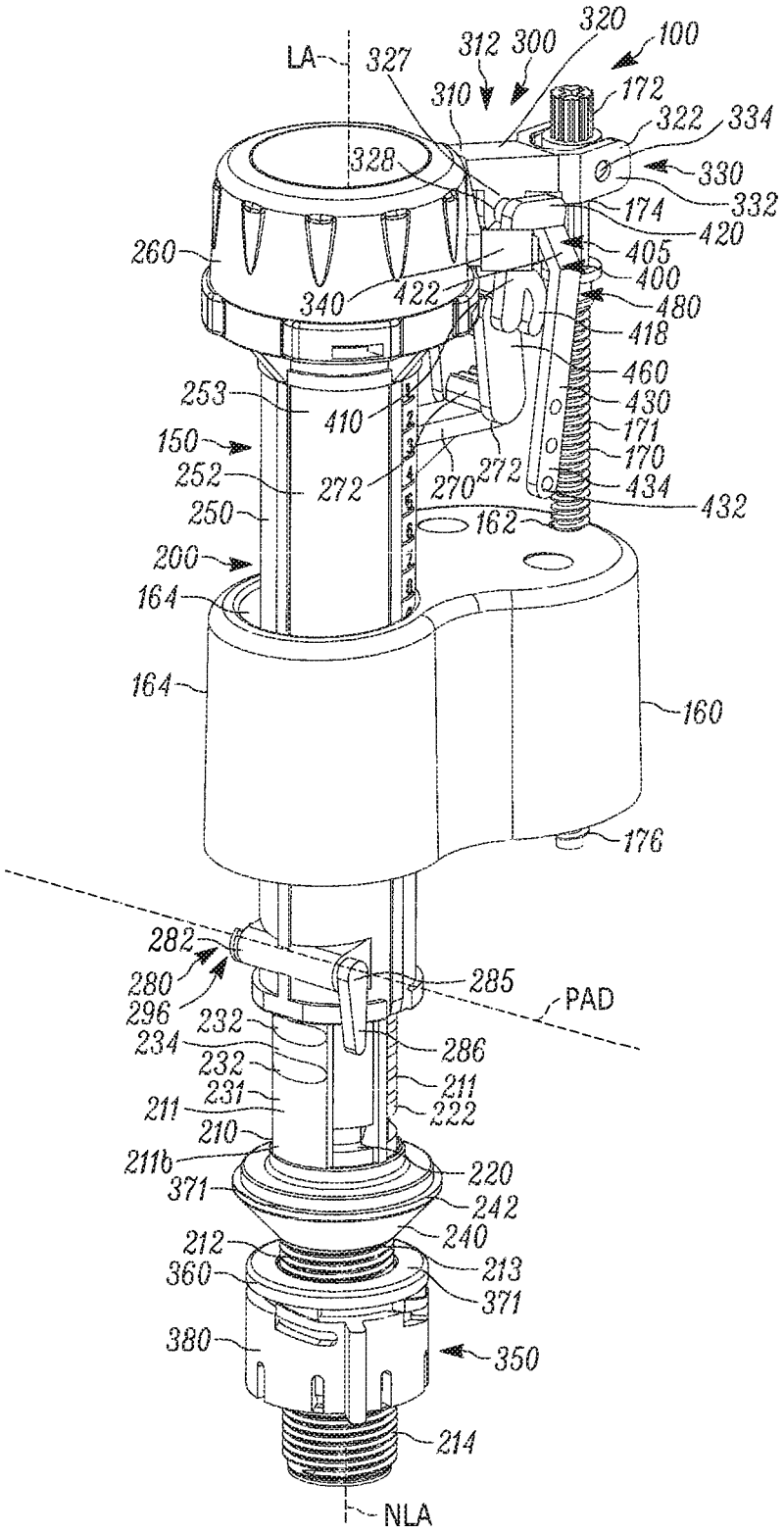
FIG. 6 is a schematic front, left side perspective view of the fill valve assembly of FIG. 1, with a manifold and fill tube removed from the assembly for clarity purposes, the linkage assembly of the fill valve assembly in an upright or over center position.
Figure 9:
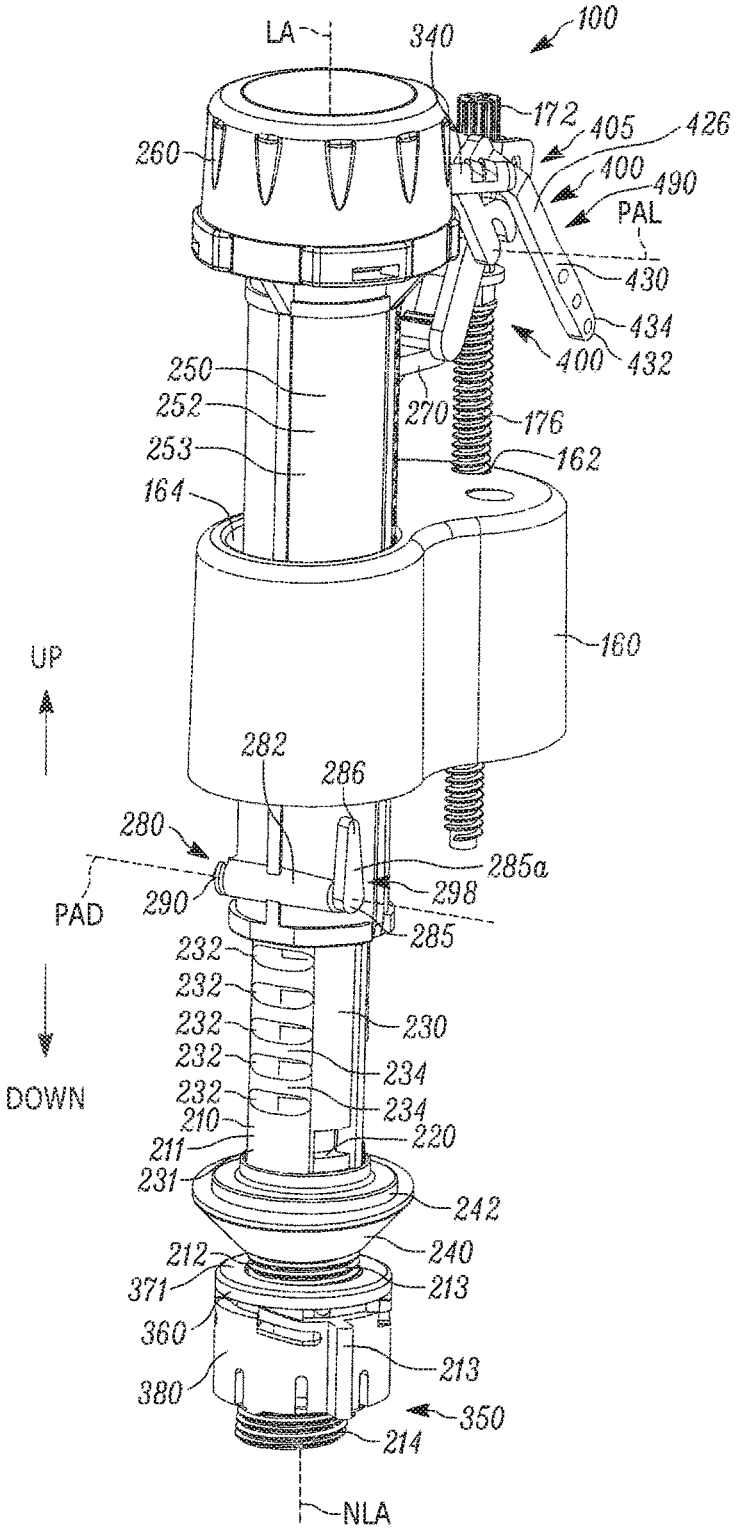
FIG. 9 is a schematic front elevation view of the fill valve assembly of FIG. 1, with the manifold and fill tube removed from the assembly for clarity purposes, with a tube-height adjustment assembly in an unlocked position to allow relative axial movement of an upper tube or sleeve of a tube of a tube assembly with respect to a lower tube or stem of the tube assembly for tube height adjustment purposes and the linkage assembly of the fill valve assembly in a folded position.
Figure 10:
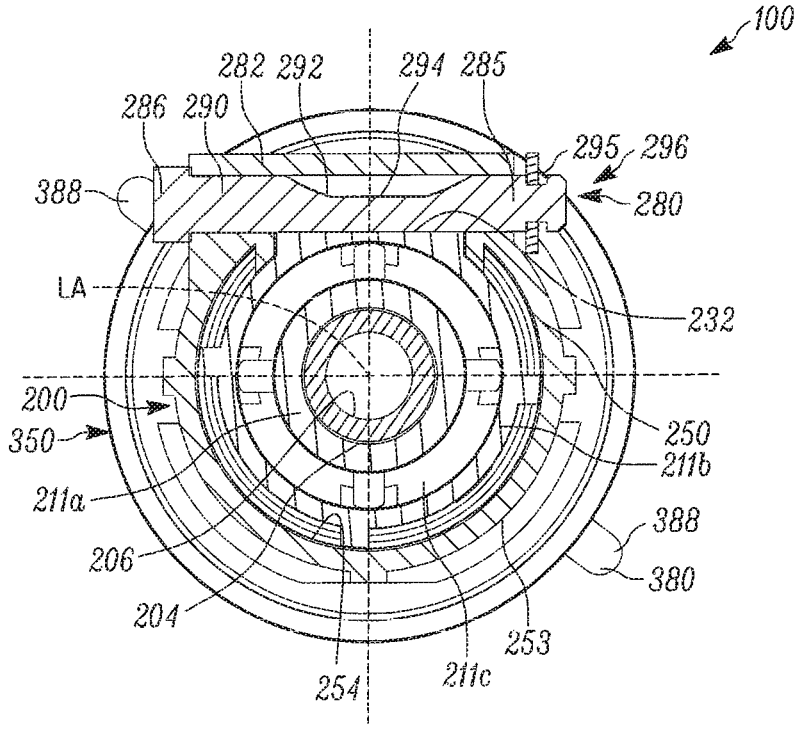
FIG. 10 is a schematic section view through the dowel pin of the tube-height adjustment assembly and the upper and lower tubes of the tube assembly, the dowel pin being in the locked position, as seen from a plane indicated by the line 10-10 in FIG. 8.
Figure 11:
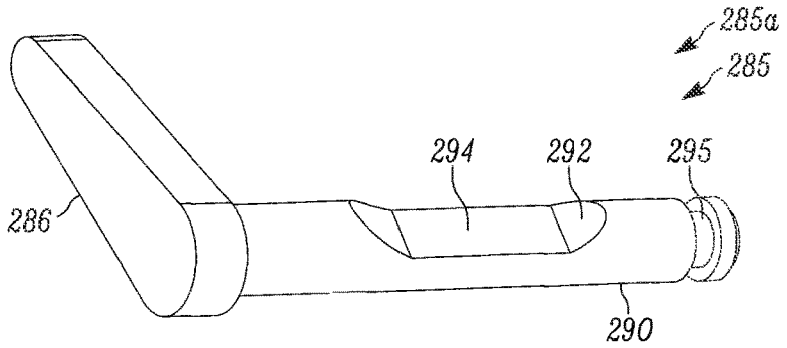
FIG. 11 is a schematic perspective view of a dowel pin of the tube-height adjustment assembly of the fill valve assembly of FIG. 1.
Figure 12:
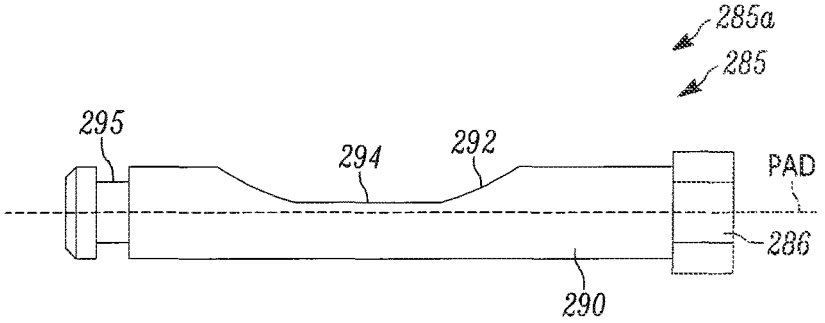
FIG. 12 is a schematic top plan view of the dowel pin of FIG. 11.
Figure 13:
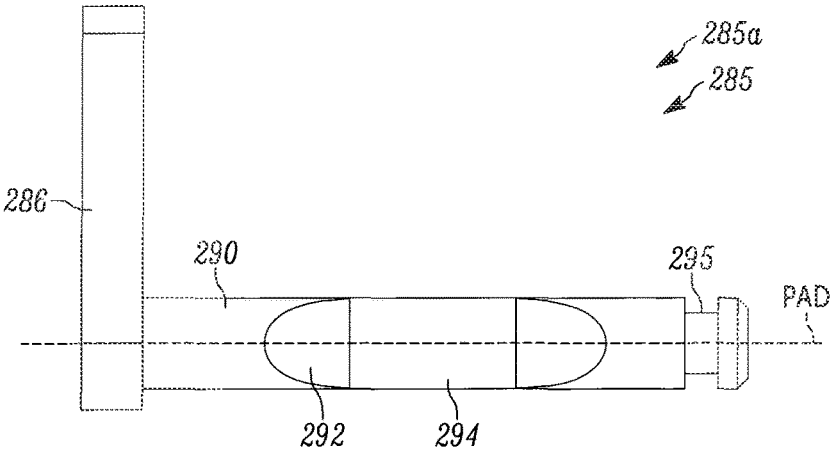
FIG. 13 is a schematic front elevation view of the dowel pin of FIG. 11.

As can best be seen in FIGS. 6-9 and 21, the linkage assembly 400 comprises a linkage 405 including the upper link 410, the horizontally oriented cylindrical center joint or pivot member 450, and the lower link 460. In one exemplary embodiment, the pivot member 450 is formed as part of the upper link 410, although it should be understood that the pivot member 450 may be formed as part of the lower link 460 or may be a separate member, apart from the upper and lower links 410, 460. The linkage 405 also includes an actuation arm 430 extending from the upper link 410. The linkage assembly 400 pivots about a linkage pivot axis PAL defined by a central longitudinal axis through the joint or pivot member 450. The linkage assembly 400 pivots between the upright or over-center position 480 (FIGS. 1, 2, 6, 7 and 8) and the folded position 490 (FIGS. 4, 5 and 9). In the upright position 480, the valve lever 310 is held in the upper closed position 312 of the lever 310 (wherein the inlet valve 305 is in the closed state) and is prevented from pivoting to the lower open position 314 of the lever 310. In the folded position 490, the valve lever 310 is permitted to move downwardly with the float 160 such that when the water level in the toilet tank 50 drops sufficiently such that the float 160 moves downwardly with the water level to a trigger position, the valve lever 310 is pivoted to its lower open position 314 wherein the inlet valve 305 is moved to the open state and supply line water flows into the toilet tank 50 and the toilet bowl.

The term over-center position 480 of the linkage assembly 400 refers to the fact that in the upright position 480, the upper and lower links 410, 460 are not perfectly axially or vertically aligned, that is, not generally parallel to the longitudinal axis LA of the tube 200. Rather, the links 410, 460 are slightly angled or concave with respect to the longitudinal axis LA or, expressed another way, the links 410, 460 are kneed inwardly slightly toward the tube longitudinal axis LA. That is, stated another way, the upper and lower links 410, 460 are angled such that an obtuse angle formed by the links 410, 460 faces away from the longitudinal axis LA. Hence, the upper and lower links 410, 460 when in the upright position are slightly beyond vertical alignment. When in the folded position 490, the upper and lower links 410, 460 pivot about the linkage pivot axis PAL and fold toward each other in an opposite angular direction from the over center position 480. That is, the upper and lower links 410, 460 pivot about the pivot member 450 and the pivot axis PAL such that an included actuate angle between the links 410, 460 faces toward the tube longitudinal axis LA. Stated another way, in the folded position 490, the upper and lower links 410, 460 such that they are convex or kneed outwardly away from the longitudinal axis LA, that is, the pivot member 450 is radially further away from the tube longitudinal axis LA in the folded position 490 than in the upright position 480 of the linkage assembly 400. Of course, as would be understood by one of skill in the art, the linkage assembly 400 may be modified to fold in the opposite direction, that is, in an alternate exemplary embodiment (not shown), in the upright position 480 of the linkage assembly 400, the links 410, 460 would be convex or kneed outwardly away from the tube longitudinal axis LA, and, in the folded position 490 of the linkage assembly 400, the upper and lower links 410, 460 would be concave or kneed inwardly toward from the longitudinal axis LA, that is, the pivot member 450 is radially closer to the tube longitudinal axis LA in the folded position 490 than in the upright position 480 of the linkage assembly 400. The present disclosure contemplates the linkage assembly 400 folding in either direction, depending on space considerations in the toilet tank 50, direction and extent of movement of the flush bar 62, arrangement of the linkage chain 66, etc.

The linkage assembly 400 pivots about the linkage pivot axis PAL. While the linkage pivot axis PAL does move axially and a radial distance of the longitudinal axis LA to the pivot axis PAL does change as the linkage assembly moves from the upright position 480 to the folded position 490, the linkage pivot axis PAL, in either position 480, 490, is substantially parallel to the bottom wall 52 of the toilet tank 50 and substantially orthogonal to the tube longitudinal axis LA. That is, while the tube longitudinal axis LA and the linkage pivot axis PAL do not intersect, if the longitudinal axis LA was moved parallel to itself such that the longitudinal axis LA did intersect the linkage pivot axis PAL, the two axes would be substantially orthogonal in both positions 480, 490 of the linkage assembly 400 and in any intermediate position therebetween. Hence, we will say that the linkage pivot axis PAL, in either position 480, 490, is substantially parallel to the bottom wall 52 of the toilet tank 50 and substantially orthogonal to the tube longitudinal axis LA.

The upper link 410 of the linkage assembly 400 includes a generally rectangular body 412 comprising a pair of spaced apart uprights 413*a*, 413*b*. The uprights 413*a*, 413*b* each include an upper end portion 415 and a lower end portion 414. The cross piece 416 extends horizontally between the upper end portions 415. Similarly, the lower link 460 of the linkage assembly 400 includes a generally rectangular body 462 comprising a pair of spaced apart uprights 463*a*, 463*b*. The uprights 463*a*, 463*b* each include an upper end portion 465 and a lower end portion 464. The upper end portions 465 of the uprights 463*a*, 463*b* define the split or open sleeve bearing 467 which rotatably receives the pivot member 450 to allow relative pivoting movement between the upper link 410 and the lower link 460. The split sleeve bearing 467 comprises two spaced apart split bearing sections, a first split beating section 467*a*, formed by the upper end portion 465 of the upright 463*a*, and a second bearing section 467*b*, formed by the upper end portion 465 of the upright 463*b*. The cross piece 466 extends horizontally between the lower end portions 464 of the lower link 460. Viewed axially, the uprights 463*a*, 463*b* of the lower link 460 are inside or within the uprights 413*a*, 413*b* of the upper link 410. The pivot member 450 extends horizontally between the lower end portions 414 of the upper link uprights 413*a*, 413*b* and is rotatably received in the split bearing 467 of the upper end portions 465 of the uprights 463*a*, 463*b* of the lower link 460 to allow relative pivoting or rotational movement of the upper and lower links 410, 460 about the pivot axis PAL defined by the pivot member 450. The pivot member 450 is generally cylindrical and the central longitudinal axis through the pivot member 450 defines the horizontally oriented linkage pivot axis PAL. That is, both the upper and lower links 410, 460 pivot about the pivot member 450 and the horizontal linkage pivot axis PAL defined by the pivot member 450.

The upper link 410 also include the actuation arm 430 which extends radially outwardly from the upright 413*a* and is also offset from the upper link body 412. The actuation arm 430 extends in a direction substantially parallel to the uprights 413*a*, 413*b* but is substantially longer in length that the uprights and thus extends substantially below the respective lower ends 414 of the uprights 413*a*, 413*b*. This additional length of the actuation arm 430 advantageously provides for greater torque for pivoting the upper link 410 radially outwardly upon a flush actuation of the toilet and subsequent pulling on the arm 430 by the linkage chain 66. The actuation arm 430 includes a vertical extension 426, a horizontal, outwardly projecting offset 420 and a projection 422 bridging the offset 420 and the vertical extension 426. The actuation arm 430 is coupled to the upper end portion 415 of the upright 413*a* by the offset 420 which is generally orthogonal to a general extent of the actuation arm 430. The projection 422 bridges or connect the downwardly extending vertical extension 426 and the horizontally extending offset 420. The offset 420 positions the actuation arm 430 away from a front or outer surface 413*c* of the upright 413*a* and the projection 422 functions to position a side surface 413*d* of the upright 413*a* and outside of the body 412 of the upper link 410, that is, outside and away from the side surface 413*d* of the upright 413*a*. The offset 430 of the actuation arm 430 from the upright 413*a* afforded by the offset 420 advantageously provides for swinging clearance when the actuation arm 430 is pulled radially outwardly by the linkage chain 66 during a flush actuation and places the arm 430 in better alignment with the flush bar 62 so that the linkage chain 66 has more of a direct, horizontal pull on the actuation arm 430 when a flush actuation occurs and the flush bar 62 pivots upwardly about the handle pivot axis PAH.

During a flush actuation of the flush handle 60, the actuation arm 430 is pulled generally horizontally in a general direction away from the tube longitudinal axis LA by the linkage chain 66. This results in the linkage assembly 400 being moved from the upright position 480 to the folded position 490. An end link of the chain 66 extends through a selected one of a plurality of openings 432 in a distal or downward end 434 of the actuation arm 430. Essentially, a horizontal component of a pulling force of the chain 66 on the actuation arm distal end 434 is sufficient to move or pivot the upper link 410 outwardly, away from the tube 200, thereby causing the linkage 405 to move from the upright position 480 to the folded position 490 upon a flush actuation of the handle 60. As explained above, when the linkage 405 moves from the upright position 480 to the folded position 490, the middle pivot member 450 move outwardly away from the tube 200.

By contrast, as the toilet tank 50 refilled after during a flush/refill cycle, the float 160 rises in the tank 50 with the tank water level. This causes the lever arm 320 of the valve lever 310 to pivot upwardly to its upper position 312, in turn, causing the linkage assembly 400 to move from the folded position 490 to the upright position 480. As explained above, when the linkage 405 moves from the folded position 490 to the upright position 480, the middle pivot member 450 moves inwardly toward the tube 200 coming to rest in the upright or over center position 480 of the linkage 405, shown for example, in FIG. 1. The presence of horizontally extending over center stops 419 extending from the arcuate arms 418 of the uprights 413 of the upper link 410 which bear against an outer surface 470 of the uprights 463 or the lower link 460 prevent the linkage 405 from pivoting in the reverse direction past the over center position 480. The outer surface 470 of the uprights 463 of the lower link 460 refers to respective surfaces of the uprights 463 facing in a radial direction generally away from tube 200 and away from the longitudinal axis LA of the tube 200 when the linkage 405 is in the upright position 480 (as can be seen, for example, in FIG. 8). The counterweight effect of the longer actuation arm 430 insures that as the tank 50 is refilled and the valve lever 310 pivots upwardly to its upper position 312, the linkage 405 will positively move from the folded position 490 to the upright or over center position 480. Extending from respective outer surface 413*c* of the uprights 413*a*, 413*b* are a pair of arcuate arms 418. The arms 418 support the horizontally extending over center stops 419, as previously explained.

Torque Limiting Nut 350

The torque limiting nut 350, as noted previously, best seen in FIGS. 6-9 and 14-17, is part of the tube assembly 150 and is threaded onto the threaded shank 213 of the stem 210 of the tube 200 of the tube assembly 150 and bears against the bottom wall 52 of the toilet tank 50 to secure the tube assembly 150 to the toilet tank 50. In one exemplary embodiment, the torque limiting nut 350 is a two part assembly including an inner threaded member 360 and an outer driver member 380. The torque limiting nut 350 limits the torque that can be applied to the inner threaded member 360 by the outer driver member 380 as the nut 350 is tightened on the threaded shank 213 thereby preventing potential damage to the bottom wall 52 of the toilet tank 50 and/or potential damage to the threads of the shank 213 which could resulting from over tightening the nut 350.

The inner threaded member 360 includes a cylindrical body 362 defining a longitudinal axis NLA of the torque limiting nut 350. When the torque limiting nut 350 is threaded onto the threaded shank 213 of the tube stem 210, the nut longitudinal axis NLA is substantially coincident with the tube longitudinal axis LA. The body 362 of the inner threaded member 360 includes an upper end 362*a* and an axially spaced apart lower end 362*b* and an outer wall 363 and a radially spaced apart inner wall 365. The inner wall 365 defines a threaded longitudinal opening 364 which is threadedly received on the threaded shank 213 of the tube stem 210. An annular rim 366 protrudes radially outwardly from the body outer wall 363 of the inner threaded member 360 at the upper end 362*a* of the body 362. The annular rim 366 includes an upper axial surface 370 and a lower axial surface 372 axially spaced apart by an outer peripheral surface 368. The lower axial surface 372 of the rim 366 includes a plurality of axially extending ramps 374. Each of the ramps of the plurality of axially extending ramps 374 includes downwardly facing angled bearing surface 375 which functions as part of the torque limiting mechanism of the nut 350.

In one exemplary embodiment, the number of ramps of the plurality of ramps 374 is four. The lower end 362*b* of the body 362 of the inner threaded member 360 includes a peripheral slot 376 extending into the outer wall 363. The peripheral slot 376 receives an inwardly extending mating peripheral lip 387 at a lower end 386 of a cylindrical body 382 of the outer driver member 380 such that the two members 360, 380 coupled in a snap fit engagement, while permitting relative rotation between the driver member 380 and the inner threaded member 360 as part of the torque limiting mechanism of the nut 350. The upper axial surface 370 of the annular rim 366 is generally planar and defines a bearing surface 371 of the torque limiting nut 350. That is, when the torque limiting nut 350 is fully threaded onto the threaded shank 213 of the stem 210 of the tube 200 to secure the tube assembly 150 to the toilet tank 50, the bearing surface 371 of the nut 350, defined by the upper axial surface 370 of the annular rim 372 of the inner threaded member 360, bears against the bottom wall 52 of the toilet tank 50 to firmly secure the tube assembly 150 in place. The bearing surface 371 of the nut 350 is generally planar across the upper axial surface 370 of the annular rim 366 and can be viewed as defining a bearing plane BP of the nut 350. The bearing plane BP (FIG. 16) of the torque limiting nut 350 is substantially orthogonal to and intersected by the longitudinal axis NLA of the nut 350.

The outer driver member 380 includes the cylindrical body 382 that extends between an upper end 384 and the axially spaced apart lower end 386. The body 382 includes an outer wall 383*a* and a radially spaced apart inner wall 383*b*. The inner wall 383*b* defines a central longitudinal opening 383*c* which receives the inner threaded member 360. The outer driver member 380 includes a pair of radially extending gripping wings 388, extending outwardly from the outer wall 383*a* and positioned circumferentially or peripherally 180° apart. The upper end 384 of the body 382 of the outer driver member 380 includes a generally planar portion 385 that is substantially orthogonal to the nut longitudinal axis NLA and a plurality of axially extending ramps 390. Cut outs or slots 392 are disposed axially below each of the ramps of the plurality of ramps 390. An upper surface of each ramp of the plurality of ramps 390 defines a wedging surface 391. Each ramp 390 and each wedging surface 391 extends axially upwardly at an angle from a base 395. The base 395 is part of the planar portion 385 of the upper end 384 (at an axial level of the planar portion 385). The plurality of ramps 390 each extend at an upward angle from the planar portion 385 of the upper end 385 and, thus, also extend at an upward angle from the base 395. In one exemplary embodiment, the number of ramps of the plurality of ramps 390 is four.

In a driving position (FIG. 14) of the outer driver member 380 on the inner threaded member 360, there is axial engagement of the bearing surfaces 375 of the ramps of the plurality of ramps 374 of the cylindrical body 362 of the inner threaded member 360 with corresponding mating wedging surfaces 391 of the ramps of the plurality of ramps 390 of the cylindrical body 382 of the outer driver member 380. The slots 392 extending below each of the ramps of the plurality of ramps 390 result in each of the ramps being configured as and functioning as an axially deflecting leaf spring 394. Among other variable, a degree of stiffness of the leaf springs 394 determines a torque limit of the nut 350. If the torque limit of the nut 350 is exceeds the plurality of ramps 390 will deflect sufficiently such that the wedging surface 391 of the ramps 390 will slide across the bearing surfaces 375 of the ramps 374 of the inner threaded member 360 thereby preventing the inner threaded member 360 from applying to much force against the bottom wall 52 of the toilet tank 50 or stripping the threads of the threaded shank 213 of the stem tube 210.

As the outer drive member is turned in a clockwise rotation to drive or thread the threaded longitudinal opening 364 of the inner threaded member 360 onto the threaded shank 213 of the tube stem 210, there is engagement of the bearing surfaces 375 of the ramps of the plurality of ramps 374 of the cylindrical body 362 of the inner threaded member 360 with corresponding mating wedging surfaces 391 of the ramps of the plurality of ramps 390 of the cylindrical body 382 of the outer driver member 380. Given that, in one exemplary embodiment, the number of ramps of the plurality of ramps 374 of the inner threaded member 360 is four and the number of ramps of the plurality of ramps 390 of the outer driver member 380 is four, the engagement of the bearing surfaces 375 of the ramps 374 of the inner threaded member 360 with the respective wedging surfaces 391 of the ramps 390 of the outer driver member 380 define four ramped, arcuate areas of contact 396 between the bearing surfaces 375 of the inner threaded member 360 and the corresponding wedging surfaces 391 of the outer driver member 380.

Figure 15:
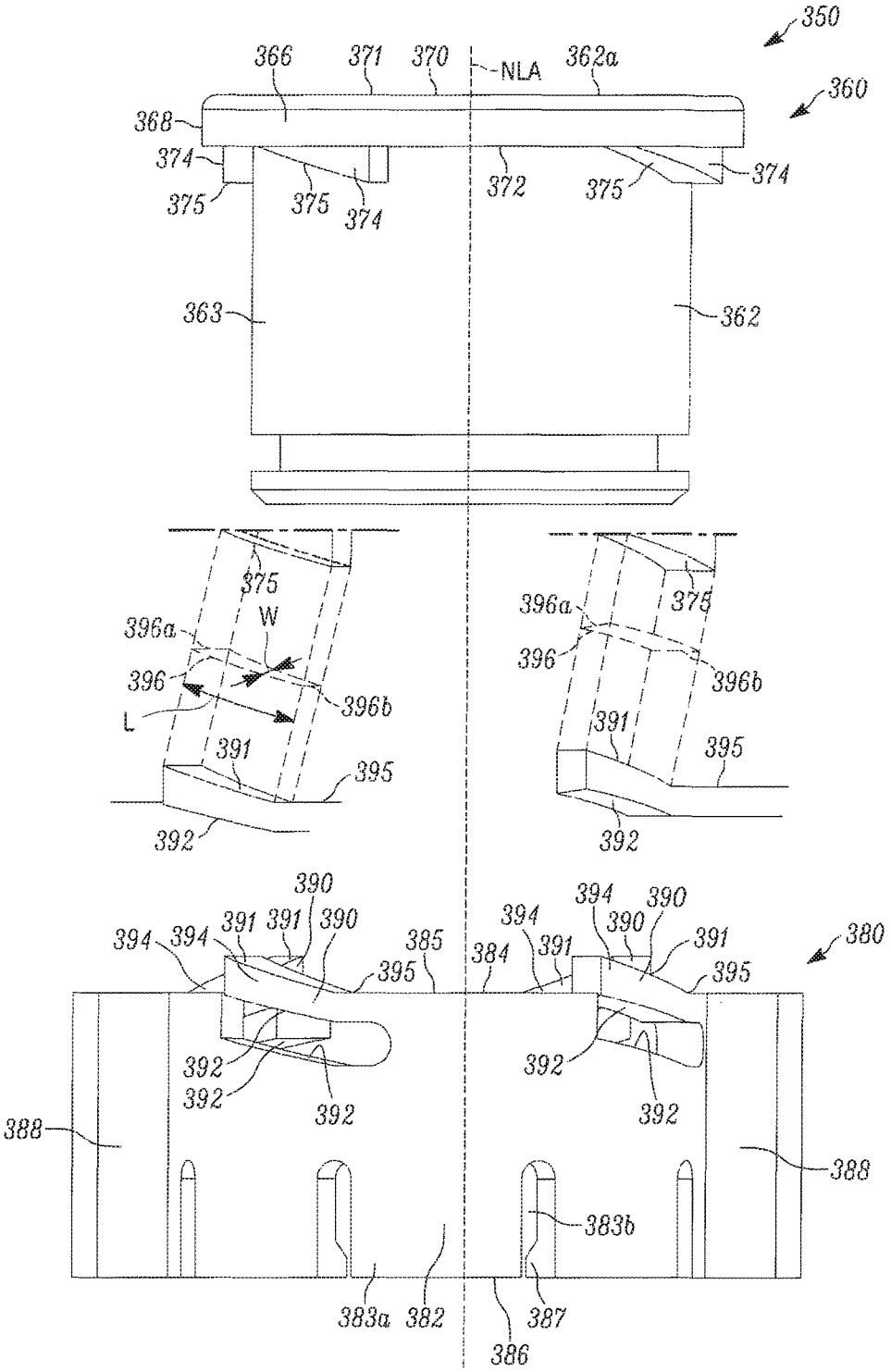
FIG. 15 is a schematic exploded front elevation view of the torque limiting nut of FIG. 14, schematically depicting two regions of contact between two bearing surfaces of axially extending ramps of the inner threaded member and opposing wedging surfaces of axially extending ramps of leaf springs of the outer driver.
Figure 16:
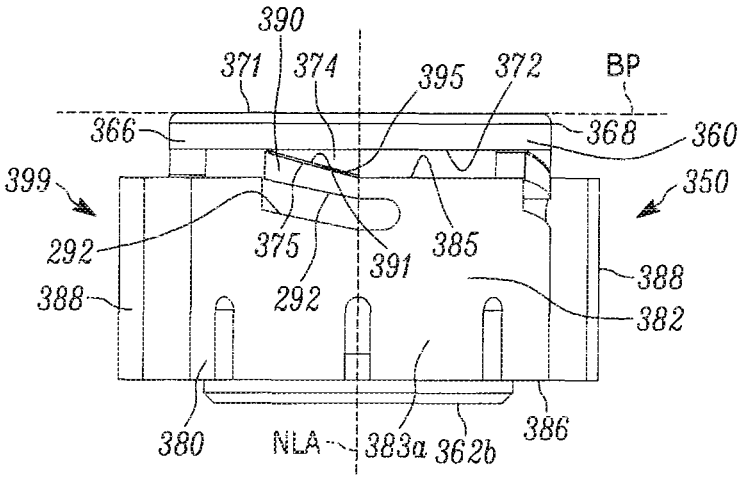
FIG. 16 is a schematic front elevation view of the torque limiting nut of FIG. 14.
Figure 17:
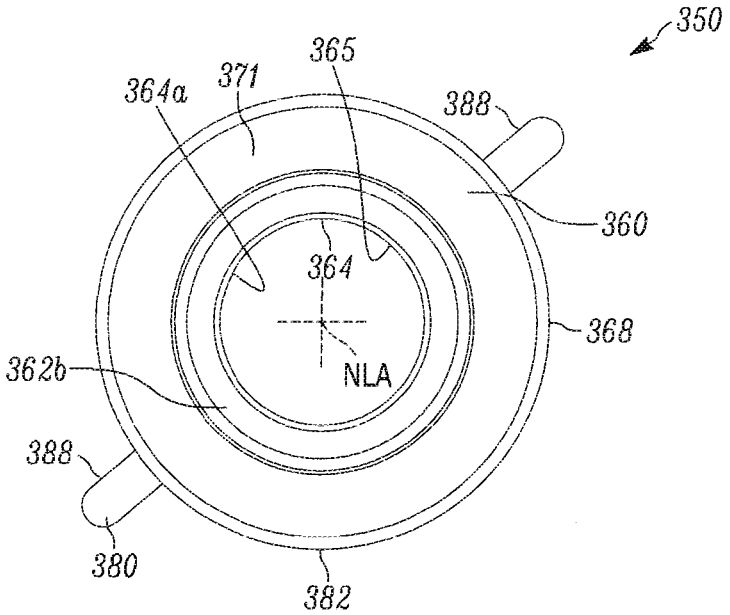
FIG. 17 is a schematic top plan view of the torque limiting nut of FIG. 14.
Figure 18:
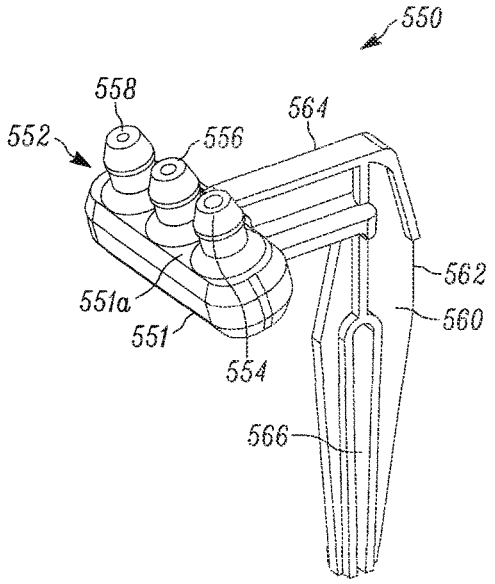
FIG. 18 is a schematic front, right side perspective view of the manifold of the fill valve assembly of FIG. 1.
Figure 19:
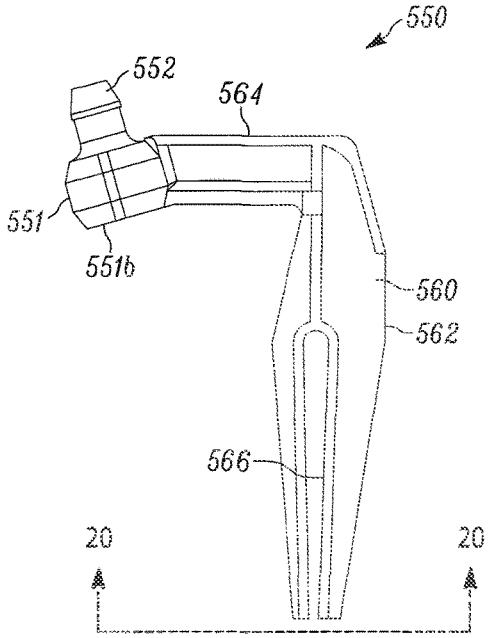
FIG. 19 is a schematic right side elevation view of the manifold of FIG. 18.
Figure 20:
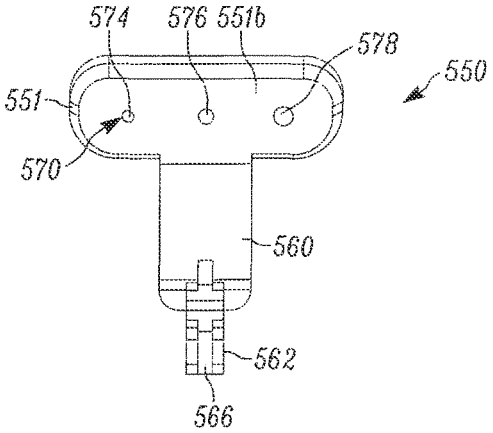
FIG. 20 is a schematic bottom plan view of the manifold of FIG. 18, as seen from a plane indicated by the line 20-20 in FIG. 19.
Figure 21:
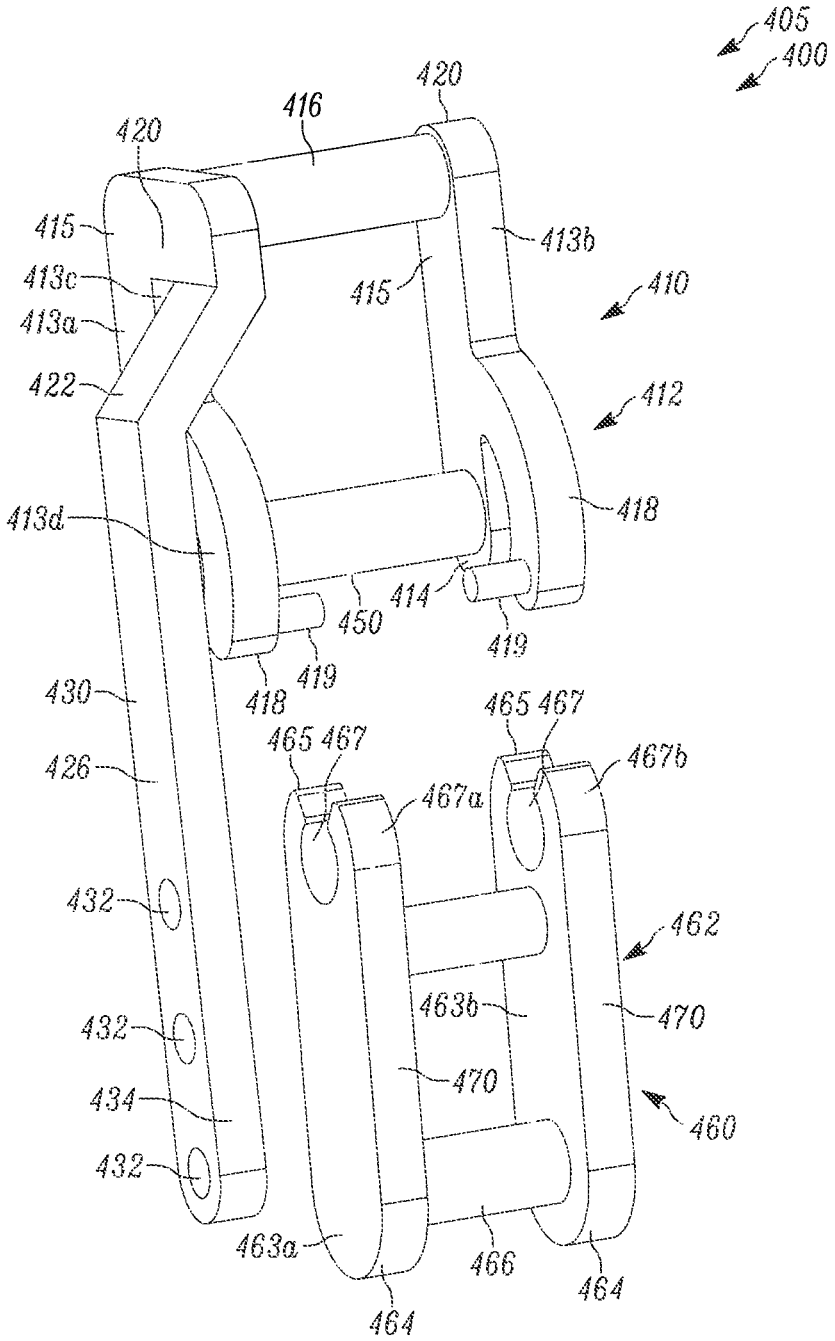
FIG. 21 is a schematic exploded front perspective view of the linkage assembly of the fill valve assembly of FIG. 1.

As is schematically depicted in FIG. 15, the areas of contact 396 are peripherally or circumferentially spaced apart and are centered about the longitudinal axis NLA of the torque limiting nut 350. Each of the areas of contact 396 has a radial width W and a length L. The radial width W substantially corresponds to a width of the lower axial surface 372 of the annular rim 366 of the inner threaded member 360. For each of the areas of contact 396, when viewed along the length L of the area of contract, the area of contact 396 is angled or ramped or extends axially, that is, an upper end 396*a* of the area of contact 396 is axially above a lower end 396*b* of the area of contact 396 (as viewed with respect to the nut longitudinal axis NLA) wherein both the upper end 396*a* and the lower end 396*b* have a radial extent or radial width W. For each of the four areas of contact 396, if extended as coincident plane ACP (plane of area of contact). The four planes of the areas of contact ACP would intersect the bearing plane BP of the torque limiting nut at an acute angle, that is, the areas of contact 396 are not orthogonal to the bearing plane BP nor are the areas of contact 396 parallel to the bearing plane. Further, the four planes of the areas of contact ACP would intersect the longitudinal axis NLA of the torque limiting nut 350 and the tube longitudinal axis LA.

As noted previously, for each ramp of the plurality of ramps 390 of the outer driver member 380 there is a corresponding slot 392 axially disposed under the ramp 390, in an axial direction opposite the wedging surface 391 of the ramp 390. Thus, the plurality of ramps 390 each function as an axially deflecting leaf spring 394 in the event that excess toque is applied to the outer driver member 380 above the designed torque limit of the nut 350. Specifically and advantageously, the slots 392 positioned axially below each ramp of the plurality of ramps 390 of the outer driver member 380 allow each ramp 390 to deflect axially in a direction away from the wedging surface 391 if an excess toque is applied to the outer driver member 380 above the designed torque limit of the nut 350. That is, in the driving position 399 of the outer driver member 380 and the inner threaded member 360 on the threaded shank 213 and wherein the bearing face 371 of the nut 350 is bearing against the bottom wall 52 of the toilet tank 50, if excess torque is applied to the outer driver member 380, each ramp the plurality of ramps 390 of the outer driver member 380 will defect axially in a direction generally parallel to the nut longitudinal axis NLA and each wedging surface 391 of the ramps 390 will slide along and, if torque on the outer driver member 380 is not reduced, the wedging surfaces 391 will ultimately slide over and past the mating bearing surface 371 of the plurality of ramps 374 of the of the inner threaded member 360.

The torque limiting feature of the nut 350 will advantageously reduce the possibility of the bearing face 371 of the nut 350 which is bearing against the bottom wall 52 of the toilet tank 50 from applying such force against the bottom wall 52 as to potentially crack or otherwise damaging the bottom wall 52 and to reduce the possibility of threads 364*a* of the threaded longitudinal opening 364 of the threaded inner member 360 from damaging or stripping corresponding threads of the threaded shank 213 of the tube stein 210 of the tube assembly 150.

Stated another way, if excess torque is applied to the outer driver member 380, the axially deflecting leaf springs 394 of the outer driver member 380 will deflect axially in a direction generally parallel to the nut longitudinal axis NLA and each wedging surface 391 of the ramps 390 will slide along and, if torque on the outer driver member 380 is not reduced, will ultimately slide over and past the mating bearing surface 371 of the plurality of ramps 374 of the of the inner threaded member 360. That is, if excess torque is applied to the outer driver member 380, the outer driver member 380 will rotate about the nut longitudinal axis NLA while the inner threaded member 360 remains stationary so as to limit the force applied by the bearing face 371 of the nut 350 to the toilet tank bottom wall 52.

Manifold 550

As can best be seen in FIGS. 2, 5 and 18-20, the manifold 550 is adapted to be coupled to the second end 504 of the fill tube 500 and directs water flowing through the fill tube 500 during a flush/refill cycle into the upper end 82 of the overflow tube 80 for purposes of filling the toilet bowl. As explained above, a goal of fill valve assembly designers is to match, as closely as possible, a volume of water flowing into the toilet bowl during a flush/refill cycle with the volume of water needed to fill the bowl after a flush actuation of the toilet, without overfilling the bowl. If too little volume of water is directed into the toilet bowl during a flush/refill cycle, there may be insufficient water for a proper flush of the toilet in the next flush actuation. If too much volume of water is directed into the toilet bowl during a flush/refill cycle, the excess water in the bowl simply goes down the bowl drain and is wasted. During a flush/refill cycle water a portion of die supply line water routed to the inlet valve 305 of the water inlet valve assembly 300 is directed by the inlet valve 305 into the fill tube 500 which routes the water into the overflow tube 80 for purposes of filling the toilet bowl.

The manifold 550 advantageously allows the owner to select between three differing flow rates through the manifold 500, resulting in three different volumes of water directed into the overflow tube 80 during a flush/refill cycle, in an attempt to properly match the volume of water actually in the toilet bowl at the end of a flush/refill cycle with the volume of water desired to be in the toilet bowl, while minimizing any overfilling of the toilet bowl during the flush/refill cycle. In one exemplary embodiment, the manifold 550 includes a body 551 and an elongated hanger 560 extending outwardly and transversely from the body 551 for purposes of securing the manifold 550 to the upper end 82 of the overflow tube 80.

The body 551 of the manifold 550 includes a generally planar upper surface 551*a* and a spaced apart generally planar lower surface 551*b*. Disposed on the upper surface 551*a* of the body 551 are plurality of inlet ports 552 which are in fluid communication with an aligned one of a plurality of outlet ports 570 disposed on lower surface 551*a* of the body 551. In one exemplary embodiment, there are three inlet ports 554, 556, 558 and correspondingly, there are three outlet ports 574 (corresponding to and in fluid communication with inlet port 554), 576 (corresponding to and in fluid communication with inlet port 556), 578 (corresponding to and in fluid communication with inlet port 558). The second end 504 of the fill tube 500 may be operatively connected to any one of the three inlet ports 554, 556, 558 to receive supply line water from the fill tube 500. Regardless of the inlet port 552, 554, 556 selected, supply line water will exit the manifold 550 through the corresponding one of the three outlet ports 574, 576, 578 and thereby be directed into the overflow tube 80 via an outlet port.

Advantageously, each of the three inlet ports 554, 556, 558 affords a different flow rate of water through the manifold 550 due to differing diameter openings in the three internal channels extending between the inlet ports 554, 556, 558 and the corresponding outlet ports 574, 576, 578. Thus, for a given water flow rate into the fill tube 500, depending upon the manifold inlet port 554, 556, 558 selected by the owner to be connected to the second end 504 of the fill tube 500, the volume of water exiting the corresponding outlet port 574, 576, 578 and directed into the overflow tube 80 for purposes of filling the toilet bowl will change. Through trial and error, the user will select the inlet port of the plurality of manifold inlet ports 554, 556, 558 that results in most closely matching the volume of water in the toilet bowl at the end of a flush/refill cycle with the volume of water desired to be in the toilet bowl, while minimizing overfilling of the toilet bowl during the flush/refill cycle. As would be appreciated by one of skill in the art, the manifold 550 may be modified to include any number of inlet and outlet ports, e.g., four, five, six or snore inlet and outlet ports, thereby providing for four, five, six or more different flow rates VI water through the manifold 550.

The hanger 560 of the manifold 550 includes an elongated vertically oriented leg 562 that is coupled to the manifold body 551 by a horizontal bridge 564. The leg 562 includes a vertically extending slot 566 that is sized to snugly be received on the upper end 82 of the overflow tube 80 for purposes to securing the manifold 550 on the overflow tube 80 and to properly position the manifold body 551 such that water exiting the manifold 550 through one of the plurality of exit or outlet ports 570 is properly directed into a central opening of the overflow tube 80 to thereby fill the toilet bowl.

The components of the fill valve assembly 100 of the of the present disclosure may be fabricated of various plastic or polymer materials or rubber materials or various metals, such as steel, stainless steel, steel alloys, aluminum and/or various composite materials, or any combination thereof, that provide for sufficient strength and durability and waterproof characteristics to effectively function in the water-based environment of a toilet tank wherein at least a portion of the fill valve assembly will be in a submerged condition, potential exposure cleaning and water treatment chemicals and the like, while providing necessary durability and strength necessary for the toilet fill valve assembly to function properly during repeated flushing cycles over a number of years. The components of the fill valve assembly 100 may be fabricated by injection molding, extrusion, stamping, forming, machining, casting, forging, or other fabrication techniques know to those of skill in the art.

Second Exemplary Embodiment—Fill Valve Assembly 1000

A second exemplary embodiment of a fill valve assembly 1000 of the present disclosure is shown generally at 1000 in FIGS. 24-28. The fill valve assembly 1000 is substantially similar in structure and function to the fill valve assembly 100 of the first exemplary embodiment. For brevity, components and assemblies of the fill valve assembly 1000 that are substantially similar to their counterpart components and assemblies of the fill valve assembly 100 of the first exemplary embodiment, will not be described in detail. Instead reference is made to the descriptions and drawings associated with the fill valve assembly 100, such descriptions and drawings being hereby incorporated by reference into the description of the fill valve assembly 1000 of the second exemplary embodiment.

As can best be seen in FIGS. 24-28, in one exemplary embodiment, the fill valve assembly 1000 comprises a tube assembly 1150, including a float 1160, a height-adjustable tube 1200 and a torque limping nut 1350 for securing the tube 1200 to a bottom wall of a water storage tank, such as a toilet tank 50. The fell valve assembly 1000 further includes a water inlet valve assembly 1300 including an inlet valve 1305 for controlling the flow of supply line water into the toilet tank 50 and the toilet bowl and a pivoting valve lever 1310 which functions to open and close the inlet valve 1305. In an upper or closed position 1312 of the valve lever 1310, as shown, for example, in FIGS. 24-26, the inlet valve 1305 is in a closed position or state and no supply line water flows into the toilet tank 50, while in a lower or open position 1314 of the valve lever 1310, as shown, for example, in FIG. 27, the inlet valve 1305 is in an open position or state and supply line water flows through the inlet valve 1305 and ultimately into the toilet tank 50 to refill the tank 50 after a flush actuation.

As best seen in FIGS. 28-32, the fill valve assembly 1000 additionally includes a linkage mechanism or assembly 1400 disposed between the tube assembly 1150 and the water inlet valve assembly 1300. The linkage assembly 1400 includes a pivoting linkage 1405 which pivots or translates between a first, upright or over center position 1480 (FIGS. 24-26) and a second, folded position 1490 (FIG. 27). In the upright position 1480, the linkage assembly 1400 prevents refill of the toilet tank 50 with supply sine water by preventing downward movement or pivoting of the valve lever 1310 except when there is a flush actuation of the toilet. In the folded position 1490 of the linkage assembly 1400, the downward pivoting of the valve lever 1310 is permitted such that the valve lever 1310 can pivot to its lower position thereby opening the inlet valve 1305 and refilling the toilet tank 50 with supply line water. The fill valve assembly 1000 also includes an overflow tube manifold 1550 to match to the extent possible a volume of supply line water directed into the toilet bowl such that the bowl is sufficiently filled during a flush/refill cycle, that is, the during the cycle time needed to refill the toilet tank 50 with supply line water after a flush actuation of the toilet.

Water Inlet Valve Assembly 1300

Figure 28:
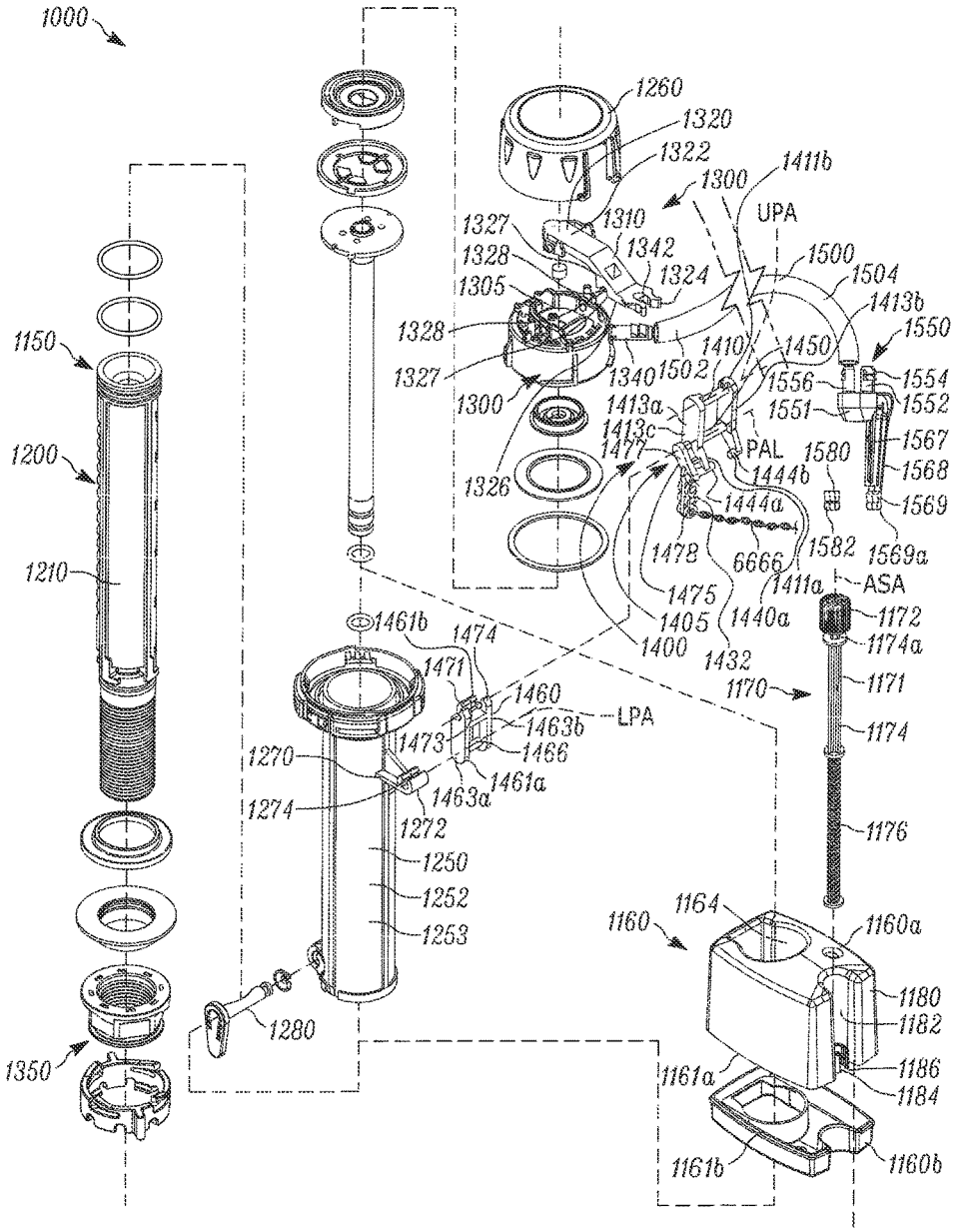
FIG. 28 is a schematic longitudinal section view of the fill valve assembly of FIG. 24, with the manifold and fill tube removed from the assembly for clarity purposes, the linkage assembly of the fill valve assembly in a folded position.
Figure 29:
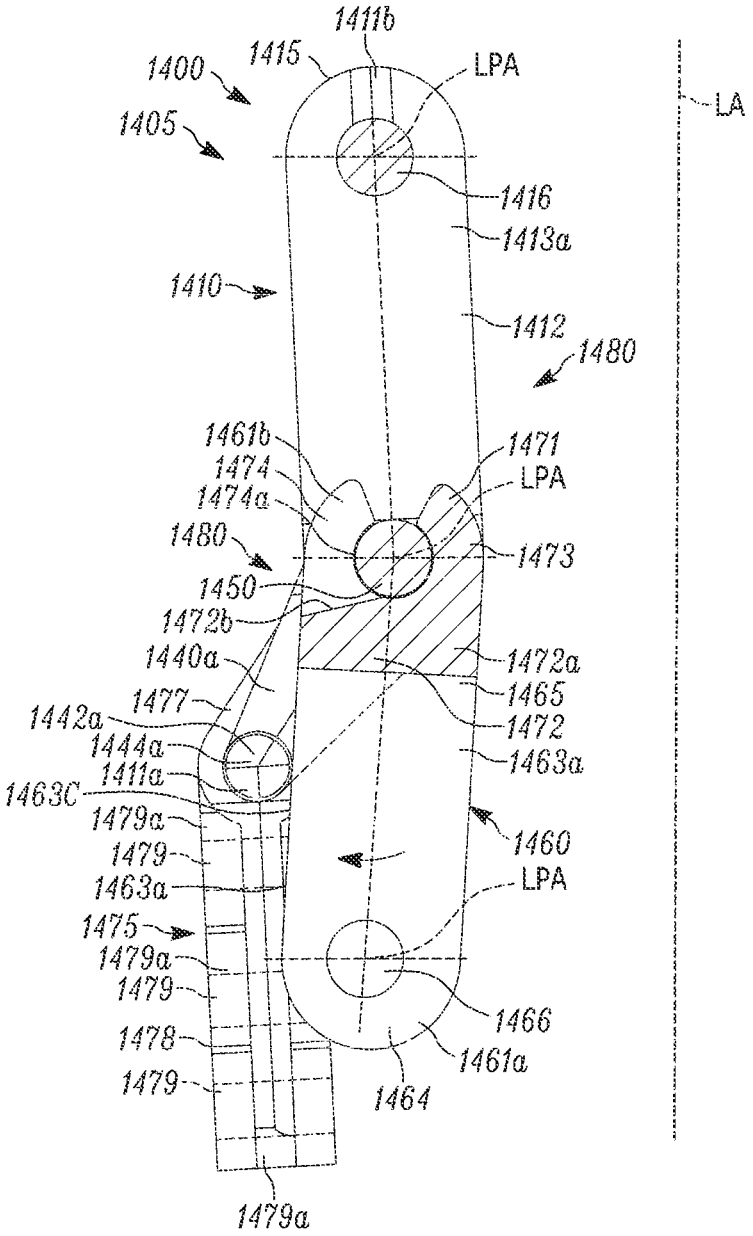
FIG. 29 is a schematic longitudinal section of a linkage of the linkage assembly of the fill valve assembly of FIG. 24 in the upright or over center position.

As best seen in FIGS. 28-28, in one exemplary embodiment, the inlet valve assembly 1300 includes the inlet valve 1305 and the pivoting valve lever 1310 which moves or pivots between the upper or closed position 1312, wherein the inlet valve 1305 is in the closed state, and the lower or open position 1314, wherein the inlet valve 1305 is in the open state. The valve lever 1310 includes a lever arm 1320. A lower surface 1326 of the lever arm 1320 includes a downwardly protruding boss 1327. The boss 1327 defines a horizontally extending split sleeve bearing 1328 that rotatably receives a cross piece 1416 of an upper link 1410 of a linkage 1405 of the linkage assembly 1400. The split sleeve bearing 1328 is part of the lever arm 1320 of the valve lever 1310 of the inlet valve assembly 1300 and is also part of the linkage assembly 1400.

Tube Assembly 1150

As best seen in FIGS. 24 and 26-28, in one exemplary embodiment, the tube assembly 1150 includes the generally height adjustable, generally cylindrical tube 1200, which defines a central longitudinal axis LA through a cylinder defined by the tube 1200. Advantageously, in one exemplary embodiment, the tube 1200 comprises a two-part telescoping tube which allows for height adjustment of the tube 1200. The tube 1200 comprises a lower generally cylindrical tube or stem 1210 and an upper generally cylindrical telescoping tube or sleeve 1250 which slidingly overlies the stem 1210. A tube-height adjustment assembly 1280, similar to the tube height adjustment assembly 280 of the tube assembly 150 of the first exemplary embodiment, provides a detent and lock mechanism between the stem 1210 and the sleeve 1250 for height adjustment purposes.

Positioned at the upper sleeve 1250 is the water inlet valve assembly 1300 and a cap housing 1260 partially overlying the water inlet valve assembly 1300. The upper sleeve 1250 of the tube 1200 includes a sleeve wall 1252 defining an outer surface 1253. Extending generally orthogonally from the outer surface 1253 of the upper sleeve 1250 and generally orthogonally to the tube longitudinal axis LA is a pedestal 1270 (FIG. 28). A distal end portion 1272 of the pedestal 1270 defines a horizontally extending split sleeve bearing 1274 that rotatably receives a cross piece 1466 of a lower link 1460 of the linkage 1405 of the linkage assembly 1400. The split sleeve bearing 1274 is part of the upper sleeve 1250 of the tube 1200 of the tube assembly 1150 and is also part of the linkage assembly 1400.

Float 1160 and Float Height Adjustment Screw 170

Figure 26:
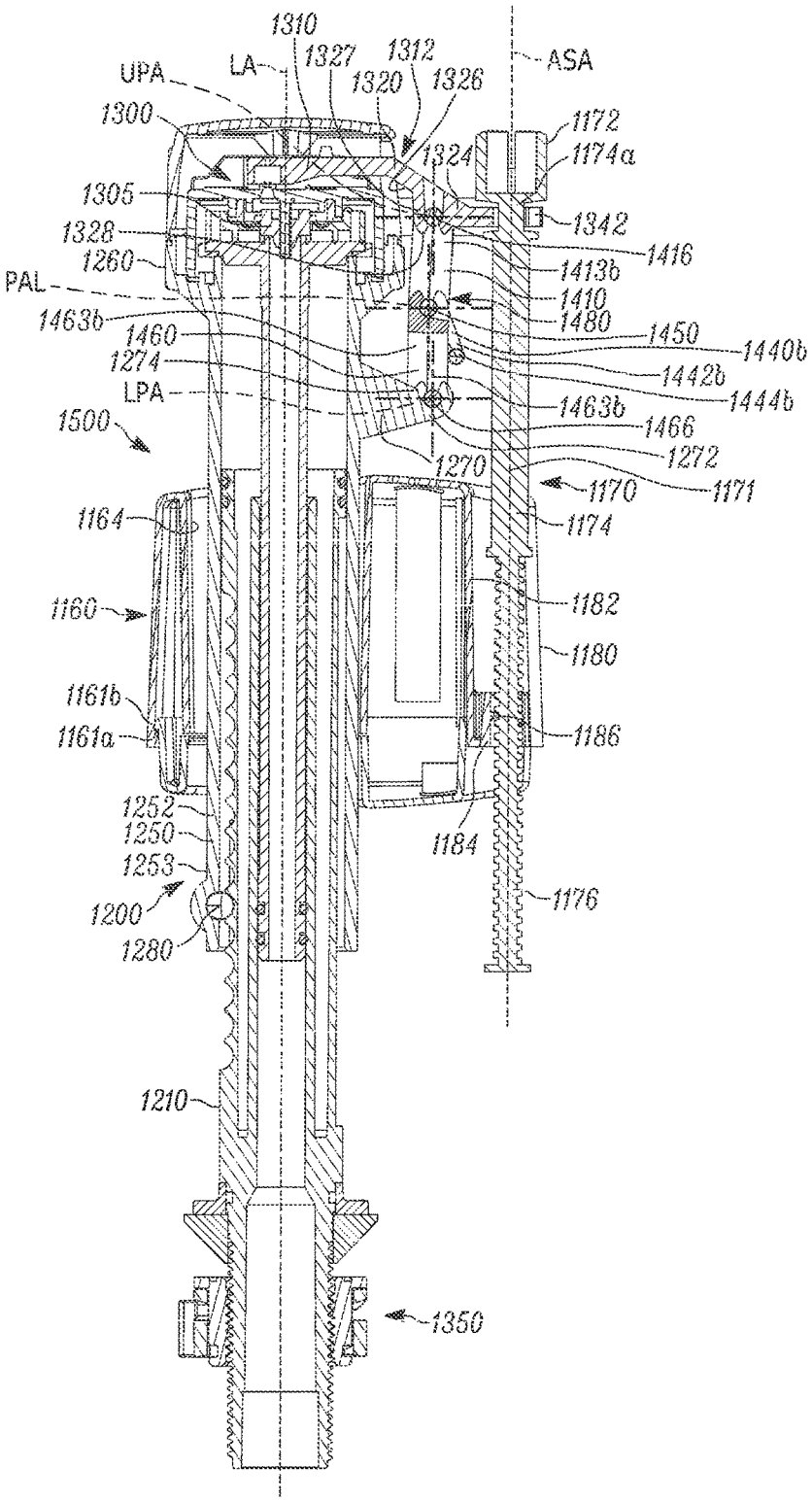
FIG. 26 is a schematic longitudinal section view of the fill valve assembly of FIG. 24, with the manifold and fill tube removed from the assembly for clarity purposes, the linkage assembly of the fill valve assembly in the upright or over center position.
Figure 27:
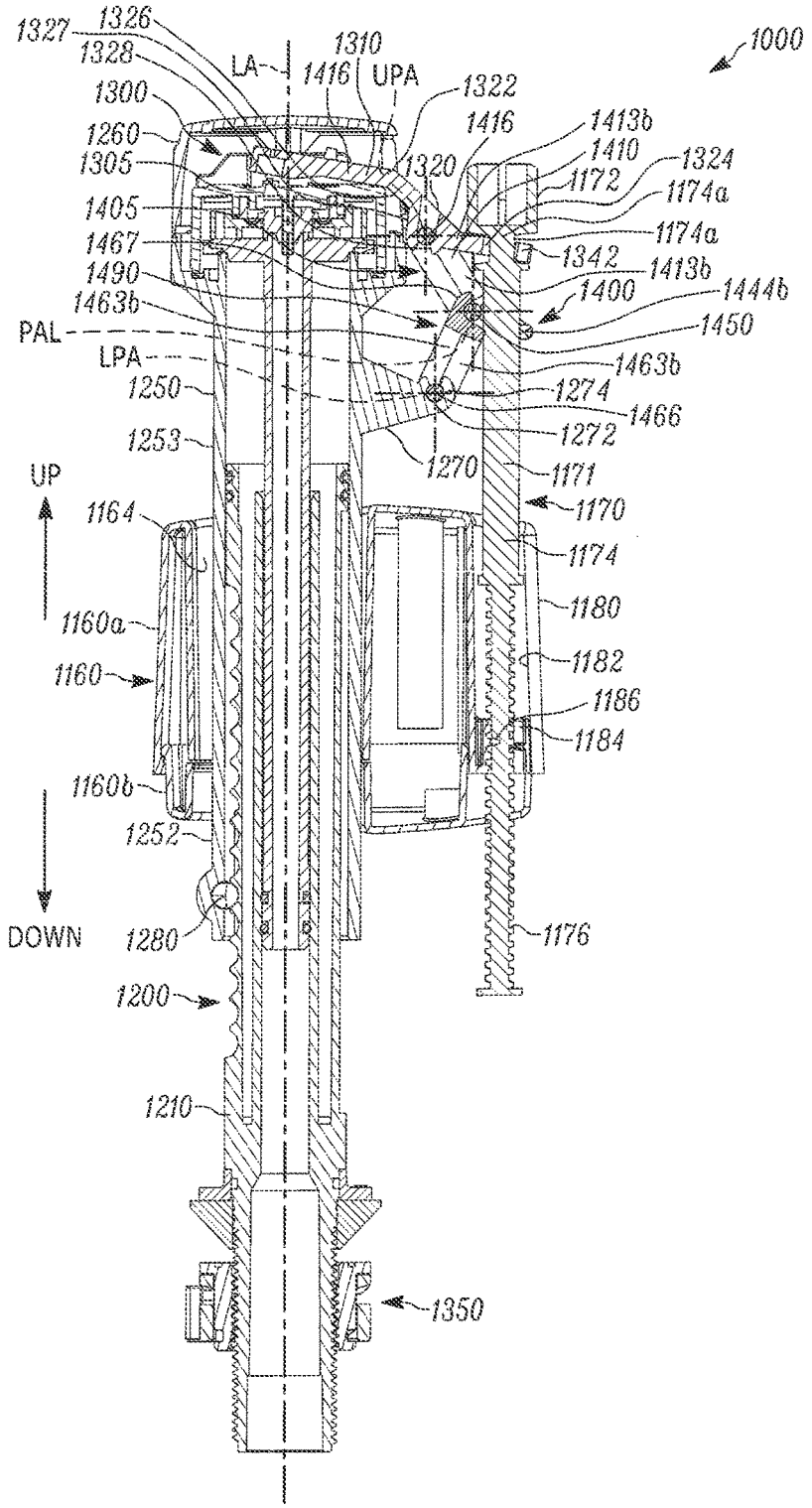
FIG. 27 is a schematic exploded perspective view of the fill valve assembly of FIG. 24, with the manifold and fill tube removed from the assembly for clarity purposes, the linkage assembly of the fill valve assembly in the upright or over center position.

As best seen in FIGS. 25-28, in one exemplary embodiment of the fill valve assembly 1000 of the present disclosure, the tube assembly 1150 including the float 1160 and a float height adjustment screw 1170, which allows for fine axial adjustment of the float position within the tank 50 and, specifically, with respect to the tube 1200. In one exemplary embodiment, as best seen in FIG. 26, the float 1160 is a two-part assembly including an upper section **1160*a* and a lower section 1160*b*, coupled or joined by a mechanical connection, such as, for example, a snap fit connection between mating peripheral regions 1161***a*, 1161*b* of the upper and lower sections 1160*a*, 1160*b*. The mechanical connection between the peripheral regions 1161*a*, 1161*b* of the upper and lower sections 1160*a*, 1160*b* forms a water tight seal between the upper and lower sections 1160*a*, 1160*b* such that the float 1160 is buoyant with respect to the water in the toilet tank 50.

The float 1160 includes an axially extending opening 1164 (FIG. 25) through the float 1160 that receives the upper sleeve 1130 of the tube 1200. The float 1160 moves upwardly (in the direction labeled UP in FIG. 27) and downwardly (in the direction labeled DOWN in FIG. 27) with respect to the tube 1200, parallel to the tube assembly longitudinal axis LA. That is, the float 1160 surrounds and is constrained for axial movement (up and down movement) by the tube 1200. Changing the axial position of the float 1160 by means of the float height adjustment screw 1170 will effectively change the tank water level needed, for example, to move the valve lever 1310 to an upper position 1312 (e.g., FIG. 26), wherein the water inlet valve 1300 is closed and no water flows through the valve 1300, during a flush/refill cycle. The float 1160 constrained to move axially along the tube 1200 as water level in the toilet tank 50 changes and the float 1160 is not otherwise constrained from axial movement (as, for example, axially constrained by the linkage assembly 1400 when the linkage assembly 1400 in is the upright position 1480 (FIGS. 24-26)).

In one exemplary embodiment, the float 160 also includes a vertical recess 1182 formed in an outwardly facing wall 1189 of the float 1160. An axially oriented collar 1184 is positioned in the vertical recess 1182. The collar 1184 includes an axially extending inner threaded portion 1186. The collar threaded portion 1186 is configured to receive a threaded lower portion 1176 of the float height adjustment screw 1170.

The float height adjustment screw 1170 includes an elongated body 1171 which supported for rotation about an axis ASA by a split or open sleeve bearing 1342 formed at a distal end 1324 of a lever arm 1320 of the valve lever 1310 of the inlet valve assembly 1300. The adjustment screw axis ASA is substantially parallel to the tube longitudinal axis LA. The elongated body 1171 of the adjustment screw 1170 includes the threaded lower portion 1176 and an upper knurled portion 1172 axially separated by a central cylindrical body portion 1174. As best seen in FIGS. 26 and 27, a necked-down region 1174*a* of the central portion 1174 is rotatably received in the split bearing 1342. The knurled upper portion 1172 allows for easy gripping and rotation of the adjustment screw 1170. Rotation of the adjustment screw 1170 raises or lowers the float 1160, depending on the direction of rotation, by virtue of the threaded engagement of the threaded lower portion 1176 and the threaded portion 1186 of the float collar 1184. The split bearing 1342 constrains axial movement of the adjustment screw 1170 thereby causing the float 1160 to move axially as the adjustment screw 1170 is rotated.

Linkage Assembly 1400

Figure 30:
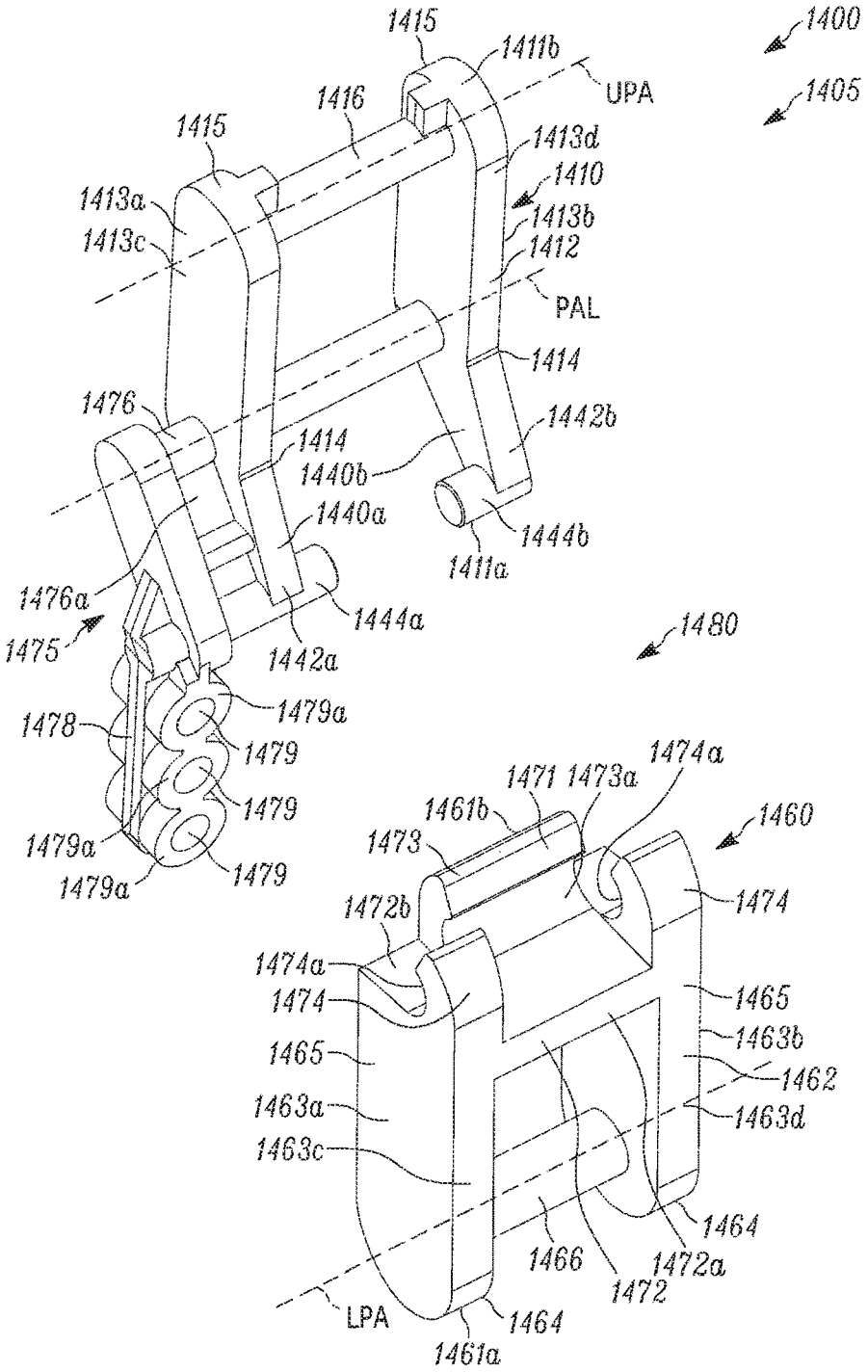
FIG. 30 is a schematic exploded front perspective view of the linkage of FIG. 29.
Figure 31:
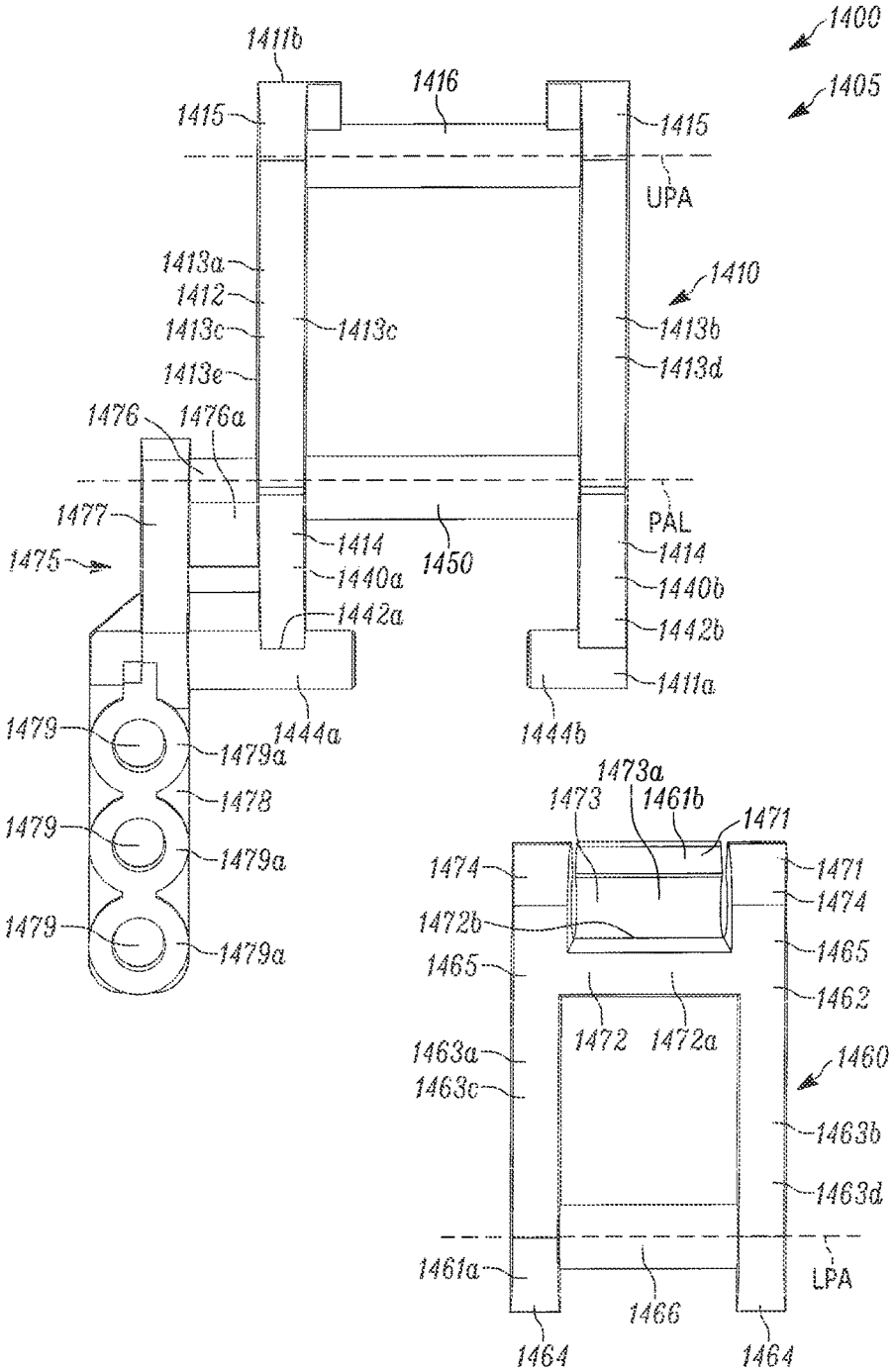
FIG. 31 is a schematic exploded front elevation view of the linkage of FIG. 29.
Figure 32:
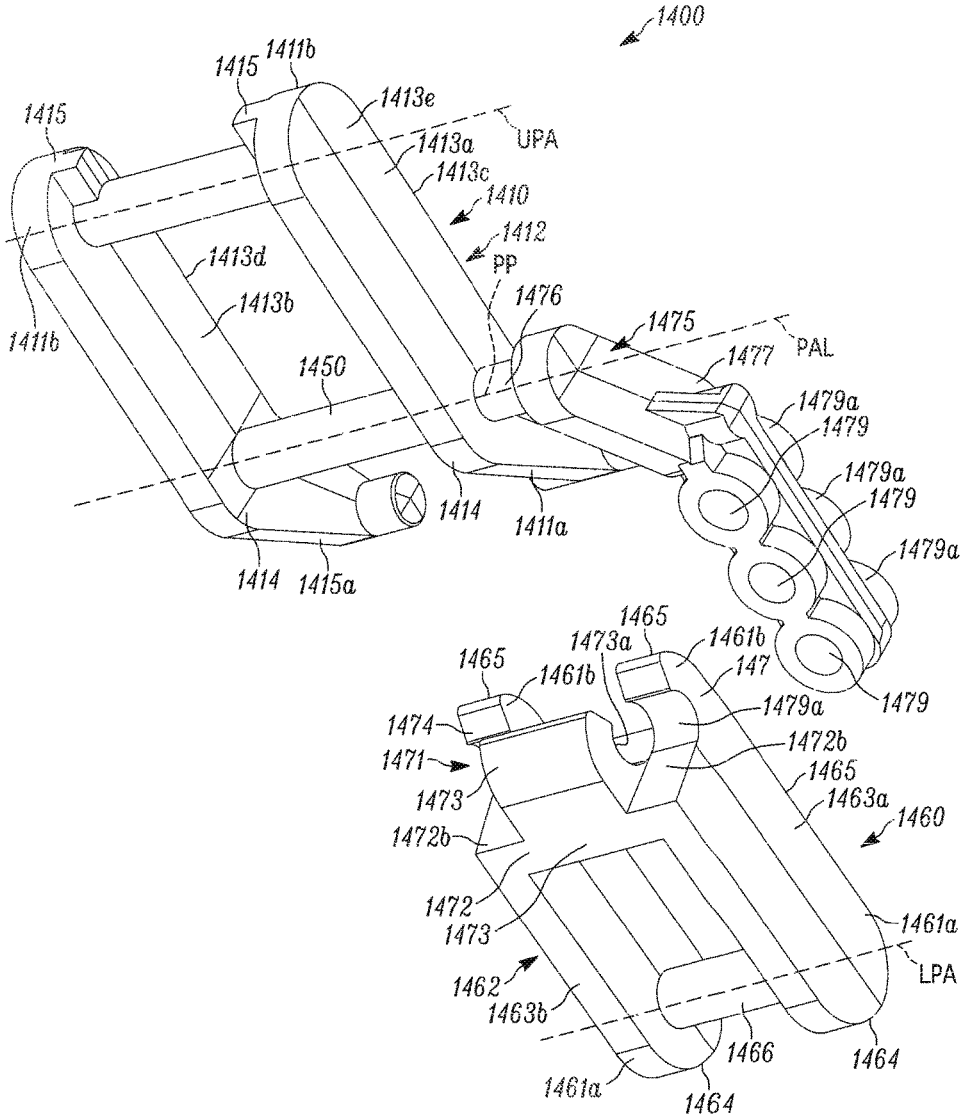
FIG. 32 is a schematic exploded rear perspective view of the linkage of FIG. 29.
Figure 33:
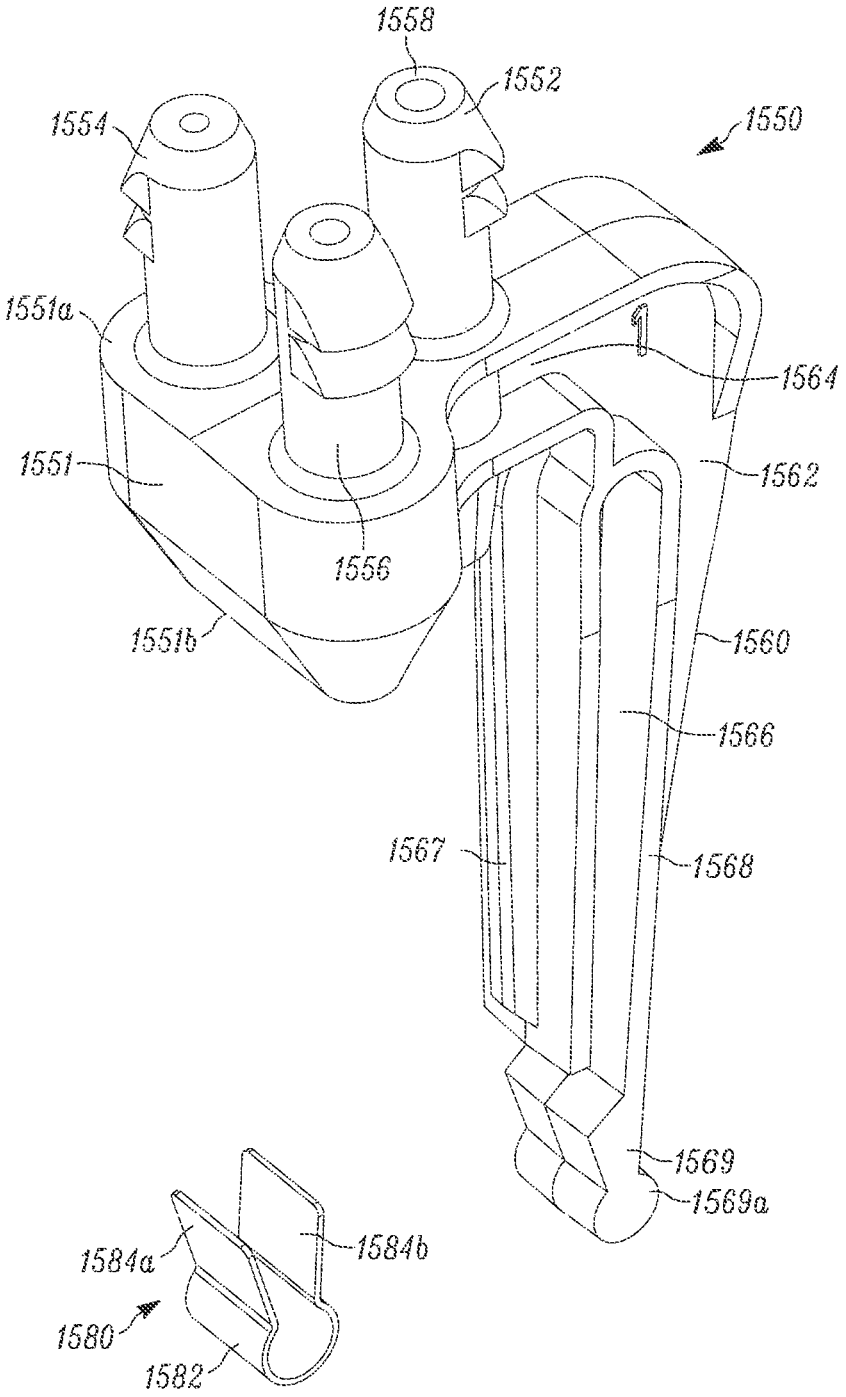
FIG. 33 is a schematic exploded front perspective view of the manifold of the fill valve assembly of FIG. 24.

As can best be seen in FIGS. 26-32, in one exemplary embodiment, the linkage assembly 1400 comprises the folding or pivoting linkage 1405. The linkage 1405 includes the upper link 1410, the horizontally oriented cylindrical center joint or pivot member 1450, and the lower link 1460. As best seen in FIGS. 30-32, in one exemplary embodiment, the pivot member 1450 is formed as part of the upper link 1410, although it should be understood that the pivot member 1450 may be formed as part of the lower link 1460 or may be a separate member, apart from the upper and lower links 1410, 1460. The linkage 1405 also includes an actuation arm 1475 extending from the upper link 1410. The linkage assembly 1400 pivots about a linkage pivot axis PAL defined by a central longitudinal axis through the joint or pivot member 1450. The linkage assembly 1400 pivots between the upright or over-center position 1480 (FIGS. 24-26) and the folded position 1490 (FIG. 28). In the upright position 1480, the valve lever 1310 is held in the upper closed position 1312 of the valve lever 1310 (wherein the inlet valve 1305 is in the closed state) and is prevented from pivoting to the lower open position 1314 of the valve lever 1310. In the folded position 1490 of the linkage 1405, the valve lever 1310 is permitted to move downwardly with the float 1160 such that when the water level in the toilet tank 50 drops sufficiently such that the float 1160 moves downwardly with the water level to a trigger position, the valve lever 1310 is pivoted to its lower open position 1314 wherein the inlet valve 1305 is moved to the open state and supply line water flows into the toilet tank 50 and the toilet bowl.

The term upright or over-center position 1480 of the linkage assembly 1400 refers to the fact that in the upright position 1480, the upper and lower links 1410, 1460 may not be perfectly axially or vertically aligned, that is, not generally parallel to the longitudinal axis LA of the tube 200. Rather, the links 1410, 1460 are slightly angled or concave with respect to the longitudinal axis LA or, expressed another way, the links 1410, 1460 are kneed inwardly slightly toward the tube longitudinal axis LA. That is, stated another way, in one exemplary embodiment, the upper and lower links 1410, 1460 are angled very slightly (see FIG. 29) such that an obtuse angle formed by the links 1410, 1460 faces away from the longitudinal axis LA. Hence, the upper and lower links 1410, 1460 when in the upright position are slightly beyond vertical alignment. When in the folded position 1490, the upper and lower links 1410, 1460 pivot about the linkage pivot axis PAL and fold toward each other in an opposite angular direction from the over center position 1480. That is, the upper and lower links 1410, 1460 pivot about the pivot member 1450 and the pivot axis PAL such that an included actuate angle between the links 1410, 1460 faces toward the tube longitudinal axis LA. Stated another way, in the folded position 1490, the upper and lower links 1410, 1460 such that they are convex or kneed outwardly away from the longitudinal axis LA, that is, the pivot member 1450 is radially further away from the tube longitudinal axis LA in the folded position 1490 than in the upright position 1480 of the linkage assembly 1400. Of course, as would be understood by one of skill in the art, the linkage 1405 of the linkage assembly 1400 may be modified to fold in the opposite direction. The present disclosure contemplates the linkage assembly 1400 folding or pivoting in either direction, depending on space considerations in the toilet tank, direction and extent of movement of the flush bar, arrangement of the linkage chain 66, etc. Additionally, as would be understood by one of skill in the art, depending on design considerations such as the stability of the linkage 1405 in the upright position 1480, the linkage 1405 of the linkage assembly 1400 may be designed such that, in the upright position 1480, the upper and lower links 1410, 1460 are axially or vertically aligned, that is, the links 1410, 1460 are generally parallel to the longitudinal axis LA of the tube 200 such that the to fold in the opposite direction. The present disclosure contemplates all such linkage assembly 1400 configurations.

The linkage assembly 1400 and the linkage 1405 pivots about the linkage pivot axis PAL. While the linkage pivot axis PAL does move axially and a radial distance of the longitudinal axis LA to the pivot axis PAL does change as the linkage assembly moves from the upright position 1480 to the folded position 1490 (FIGS. 26 & 27), the linkage pivot axis PAL, in either position 1480, 1490, is substantially parallel to the bottom wall of the toilet tank and substantially orthogonal to the tube longitudinal axis LA. That is, while the tube longitudinal axis LA and the linkage pivot axis PAL do not intersect, if the longitudinal axis LA was moved parallel to itself such that the longitudinal axis LA did intersect the linkage pivot axis PAL, the two axes would be substantially orthogonal in both positions 1480, 1490 of the linkage assembly 1400 and in any intermediate position therebetween.

In one exemplary embodiment, the upper link 1410 of the linkage assembly 1400 extends between a lower end region or portion 1411*a* and an upper end region or portion 1411*b*. The upper link 1410 includes a generally rectangular body 1412 comprising a pair of spaced apart uprights 1413*a*, 1413*b*. The uprights 1413*a*, 1413*b* each include an upper end portion 1415 and a lower end portion 1414. A cross piece 1416 extends horizontally between the upper end portions 1415 of the uprights 1413*a*, 1413*b*. The cross piece 1416 of the upper link 1410 is pivotally received in the split sleeve bearing 1328 of the lever arm 1320 of the water inlet valve assembly 1300. When the linkage 1405 moves from the upright position 1480 to the folded position 1490, the cross piece 1416 pivots within the sleeve bearing 1328 about a horizontally oriented upper pivot axis UPA (FIGS. 26-28 and 30-32).

Similarly, in one exemplary embodiment, the lower link 1460 of the linkage assembly 1400 extends between a lower end region or portion 1461*a* and an upper end region or portion 1461*b*. The lower link 1460 includes a generally rectangular body 1462 comprising a pair of spaced apart uprights 1463*a*, 1463*b* and a cross piece 1466 extends horizontally between the lower end portions 1464 of the lower link 1460. The cross piece 1466 of the lower link 1460 is pivotally received in the split sleeve bearing 1274 of the pedestal 1270 of the tube 200. When the linkage 1405 moves from the upright position 1480 to the folded position 1490, the cross piece 1466 pivots within the sleeve bearing 1274 about a horizontally oriented lower pivot axis LPA (FIGS. 26-28 and 30-32). The lower pivot axis LPA, the upper pivot axis UPA, and the linkage pivot axis PAL, in either position 1480, 1490, are substantially parallel to each other and are substantially orthogonal to the tube longitudinal axis LA.

The uprights 1463*a*, 1463*b* of the lower link 1460 each include an upper end portion 1465 and a lower end portion 1464. As best seen in FIGS. 30 and 32, in one exemplary embodiment, a split sleeve bearing 1471 is defined at the upper end portion 1461*b* of the lower link 1460. Extending horizontally between the upper end portions 1465 of the uprights 1463*a*, 1463*b* of the lower link 1460 is a bridge 1472. The bridge 1472 includes a generally rectangular body 1472*a*. Extending upwardly from an upper surface 1472*b* of the body 1472*a* of the bridge 1472 is a central arcuate arm 1473. The central arcuate arm 1473 is part of the split sleeve bearing 1471 of the lower link 1460. Specifically, an inner surface 1473*a* of the central arcuate arm 1473 defines a portion of a bearing surface of the split sleeve bearing 1471 that contacts and rotatably supports the pivot member 1450 of the linkage 1405 for rotation about the linkage pivot axis PAL. Also extending upwardly from the upper surface 1472*b* of the body 1472*a* of the bridge 1472 are two arcuate arms 1474 which flank the central arcuate arm 1473. The outer arcuate arms 1474 are also part of the split sleeve bearing 1470 of the lower link 1460. Specifically, respective inner surfaces 1474*a* of the outer arcuate arms 1474, which are in opposed facing relationship with the inner surface 1473*a* of the central arcuate arm 1473, define a remaining portion of the bearing surface of the split sleeve bearing 1470 that contacts and rotatably supports the pivot member 1450 of the linkage 1405 for rotation about the linkage pivot axis PAL.

As noted above, in one exemplary embodiment, the cross piece 1466 (FIG. 30) extends horizontally between the lower end portions 1464 of the lower link 1460. Viewed axially, the uprights 1463*a*, 1463*b* of the lower link 1460 and the split sleeve bearing 1470 are inside or within the uprights 1413*a*, 1413*b* of the upper link 1410. The pivot member 1450 extends horizontally between the lower end portions 1414 of the upper link uprights 1413*a*, 1413*b* and is rotatably received in the split bearing 1470 of the upper end portion 1461*b* of the lower link 1460 to allow relative pivoting or rotational movement of the upper and lower links 1410, 1460 about the pivot axis PAL defined by the pivot member 1450. The pivot member 1450 is generally cylindrical and the central longitudinal axis through the pivot member 1450 defines the horizontally oriented linkage pivot axis PAL. That is, both the upper and lower links 1410, 1460 pivot about the pivot member 1450 and the horizontal linkage pivot axis PAL defined by the pivot member 1450. The open or slit sleeve bearing 1470 spreads apart and receives a pivot member 1450 of the upper link 1410 of the linkage assembly 1400 in a snap fit engagement and rotatably or pivotally supports pivot member 1450 for rotation about the linkage pivot axis PAL on the bearing surface of the split sleeve bearing 1470.

As best seen in FIGS. 29-32, in one exemplary embodiment, the upper link 1410 includes the actuation arm 1475 comprising a horizontally extending offset post 1476, an angled projection 1477 and a vertically extending projection 1478. The vertically extending projection 1478 includes a plurality of vertically spaced linkage chain openings 1479, each of which is sized to receive the linkage chain 66 (a portion of which is shown in FIG. 28 and which is similar in structure and function to the linkage chain 66 of the first exemplary embodiment), as previously explained. The user will select one of the plurality of linkage chains openings 1479 to connect or attach the linkage chain 66 which provides for reliable movement or pivoting of linkage 1405 from the upright position 1480 to the folded position 1490 upon a flush actuation. The horizontally extending offset post 1476 of the actuation arm 1475 is affixed to the lower end portion 1414 of the upright 1413*a* and is substantially aligned with the pivot member 1450 of the linkage 1405. That is, the horizontally extending offset post 1476 extends from a side surface 1413*e* of the upright 1413*a* of the upper link 1410 in a direction generally along the linkage pivot axis PAL away from the upright 1413*a*.

Thus, the plurality of linkage chain openings 1479 of the actuation arm 1475 are spaced from the side surface 1413*e* by the upper offset post 1476. The horizontally extending offset post 1476 is part of a horizontally extending web 1476*a* extending from the side surface 1413*e* of the upright 1413*a* of the upper link 1410. The offset post 1476 terminates in the central angled projection 1477. The central angled projection 1477 of the extension arm 1475 extends outwardly beyond an outer surface 1413*c* of the upright 1413*a* of the upper link 1410. The central angled projection 1477 terminates in the vertically extending projection 1478. The vertically extending projection 1478 of the actuation arm 1475 extends substantially parallel to an extent of the uprights 1413*a*, 1413*b* of the upper link 1410 and, because of the central angled projection 1477, is offset outwardly from the outer surface 1413*c* of the upright 1413*a* of the upper link 1410. The outer surface 1413*c* of the upright 1413*a* of the upper link 1410 refers to the surface of the upright 1413 facing outwardly or in a radial direction generally away from tube 1200 and the tube longitudinal axis LA when the linkage 1405 is in the upright position 1480 (FIG. 26). The vertically extending projection 1478 includes three horizontally extending cylindrical bosses 1479*a*, each of which defines one of the linkage chain openings 1479.

In one exemplary embodiment, the vertically extending projection 1478 of the actuation arm 1475 is offset from the upper link rectangular body 1412, specifically, the vertically extending projection 1478 is offset radially outwardly from a side surface 1413*e* of the upright 1413*a* of the body 1412 and is also offset axially below the lower end 1414 of the uprights 1413*a*, 1413*b* of the body 1412. The vertically extending projection 1478 of the actuation arm 1475 extends in a direction substantially parallel to the uprights 1413*a*, 1413*b* but extends substantially below the respective lower ends 1414 of the uprights 1413*a*, 1413*b* and is disposed offset outwardly from an outer surface 1413*c*, 1413*d* of the uprights 1413*a*, 1413*b*. Accordingly, as the vertically extending projection 1478 defines the plurality of linkage chain openings 1479, each of the plurality of linkage chain openings 1479 of the actuation arm 1475 also are disposed below the respective lower ends 1414 of the uprights 1413*a*, 1413*b* and are disposed outwardly of the uprights 1413*a*, 1413*b* (that is, in a direction radially away from the adjustable-height tube 200).

Upon a flush actuation of the toilet, the linkage chain 66 moves or is pulled generally horizontally and radially outwardly, that is, in a radial direction away from the tube 200. As the linkage chain 66 is coupled to a selected one of the linkage chain openings 1479 of the actuation arm 1475, the horizontal force applied by the linkage chain 66 is transmitted along the actuation arm 1475 to the upper link 1410 in order to urge the upper link 1410 to move from its upright position 1480, that is, the position of the upper link 1410 when the linkage 1405 is in the upright position 1480 (FIG. 26) to its folded position, that is, the position of the upper link 1410 when the linkage 1405 is in the folded position 1490 (FIG. 27). That is, a horizontal component of the force transmitted along actuation arm 1475 (resulting from the horizontal force applied by the linkage chain 66 to the actuation arm 1475) is applied to the lower end portion 1414 of the upright 1413*a* thereby causing the upper link 1410 to pivot about its upper pivot axis UPA and the result is that the upper link 1410 moves from its upright position 1480 to its folded position 1490 and the linkage moves from its upright position 1480 (FIG. 26) to its folded position 1490 (FIG. 27).

The configuration of the actuation arm 1475 advantageously provide for greater torque for pivoting the upper link 1410 radially outwardly upon a flush actuation of the toilet and subsequent pulling on the actuation arm 1475 by the linkage chain 66. Upon a flush actuation of the toilet, the cross piece 1416 which is pivotally received in the split sleeve bearing 1328 of the lever arm 1320 pivots or rotates within the split sleeve bearing and, thus, the upper link 1410 pivots about the upper pivot axis UPA. The horizontally extending offset post 1476 of the actuation arm 1475 is advantageously in horizontal alignment with the pivot member 1450 of the linkage 1405, that is, the offset post 1476 extends substantially along the linkage pivot axis PAL. Thus, the force applied by movement of the linkage chain 66 is transmitted along the actuation arm 1475 and a horizontal component of that force is applied to the lower end portion 1414 of the upright 1413*a* causing the upper link 140 to pivot about the upper pivot axis UPA. The offset post 1476 of the actuation arm 1475 affixed to the lower end portion 1414 of the upright 1413*a* and is in alignment with the pivot member 1450 of the upper link 1410 and the linkage pivot axis PAL. Thus, the force transmitted by the actuation arm 1475 to the upper link 1410 is in close proximity to the pivot member 1450 and the linkage pivot axis PAL. Advantageously, affixing the actuation arm 1475 to the lower end portion 1414 of the upright 1413*a* and having the offset portion 1476 of the actuation arm 1475 in proximity to and in alignment with the pivot member 1450 and the linkage pivot axis PAL improves the sensitivity of the linkage assembly 1400 and provides for a sure and consistent movement or pivoting of linkage 1405 from the upright position 1480 to the folded position 1490 upon a flush actuation.

During a flush actuation of the flush handle 60, the actuation arm 1475 is pulled generally horizontally in a general direction away from the tube longitudinal axis LA by the linkage chain 66. This results in the linkage assembly 1400 being moved from the upright position 1480 to the folded position 1490. An end link(s) of the linkage chain 66 extends through a selected one of the plurality of linkage chain openings 1479 in the vertically extending projection 1478 of the actuation arm 1475. Essentially, a horizontal component of a pulling force of the chain 66 on the actuation arm 1475 is sufficient to move or pivot the upper link 1410 outwardly, away from the tube 1200, thereby causing the linkage 1405 to move from the upright position 1480 to the folded position 1490 upon a flush actuation of the handle 60. As explained above, when the linkage 1405 moves from the upright position 1480 to the folded position 1490, the middle pivot member 1450 moves outwardly away from the tube 1200.

By contrast, as the toilet tank 50 refilled after during a flush/refill cycle, the float 1160 rises in the tank 50 with the tank water level. This causes the lever arm 1320 of the valve lever 1310 to pivot upwardly to its upper position 1312, in turn, causing the linkage assembly 1400 to move from the folded position 1490 to the upright position 1480. When the linkage 1405 moves from the folded position 1490 to the upright position 1480, the middle pivot member 1450 moves inwardly toward the tube 1200 coming to rest in the upright or over center position 1480 of the linkage 1405, shown for example, in FIGS. 24-26.

As best seen in FIGS. 29-32, in one exemplary embodiment, the upper link 1410 of the linkage 1405 includes a pair of angled arms 1440*a*, 1440*b* that extend from a lower end portion 1414 of the uprights 1413*a*, 1413*b* of body 1412 of the upper link 1410. The angled arms 1440*a*, 1440*b* are in axial alignment with the uprights 1413*a*, 1413*b* and extend at an angle beyond respective outer surfaces 1413*c*, 1413*d* of the uprights 1413*a*, 1413*b*. The outer surfaces 1413*c*, 1413*d* of the uprights 1413*a*, 1413*b* of the upper link 1410 refers to the surface of the uprights 1413*a*, 1413*b* facing generally radially away from tube 200 and the tube longitudinal axis LA when the linkage 1405 is in the upright position 1480 (FIG. 26). Formed at distal end portions 1442*a*, 1442*b* of the angled arms 1440*a*, 1440*b* are a pair of aligned, horizontally extending over center stops 1444*a*, 1444*b*. The over center stops 1444*a*, 1444*b* are disposed outwardly of the outer surfaces 1413*c*, 1413*d* of the uprights 1413*a*, 1413*b* of the upper link 1410. When the linkage 1405 is in the upright position 1480, the over center stops 1444*a*,

1444*b* contact respective outer surfaces 1463*c*, 1463*d* of the uprights 1463*a*, 1463*b* of the body 1462 of the lower link 1460 to limit the extent of pivot of the linkage 1480 as the linkage 1405 moves or pivots from the folded position 1490 to the upright position 1480. That is, the contact of the over center stops 1444*a*, 1444*b* of the upper link 1410 with the uprights 1463*a*, 1463*b* of the lower link 1460 in the upright position 1480 of the linkage 1405 prevents the linkage 1405 from pivoting in the reverse direction past the upright or over center position 1480.

It should be understood that the exact angular relationship between the upper and lower links 1410, 1460 in the upright position 1480 is a matter of design choice and may be varied based on the desired sensitivity of the linkage assembly 1400. For example, in comparing the upright position 480 of the linkage 405, as seen in FIG. 8 and the upright position 1480 of the linkage 1405, as seen in FIG. 26, it can be seen that the upright position 1480 of the linkage 1405 is more vertically or axially aligned. That is, while the links 1410, 1460 are still slightly angled or concave with respect to the longitudinal axis LA, a degree to which the links 1410, 1460 of the linkage 1405 are kneed inwardly slightly toward the tube longitudinal axis LA is less than a degree to which the links 410, 460 of the linkage 405 are kneed inwardly toward the tube longitudinal axis LA. The upper and lower links 1410, 1460 in the upright or over center position 1480 are closer to being in a straight line arrangement than the upper and lower links 410, 460 in the upright or over center position 480. The more closely the upright position 1480 of the linkage 1405 is to a straight line arrangement, the more sensitive of the linkage 1405 is, that is, the less force is required to be applied by the linkage chain 66 during a flush actuation to "trip" or move the linkage 1405 from the upright position 1480 to the folded position 1490. It is within the contemplation of the present disclosure to utilize different over center or upright positions depending on desired sensitivity of the linkage 1405 in moving from the upright position 1480 to the folded position 1490. Additionally and advantageously, the counterweight effect of the actuation arm 1430 insures that as the tank 50 is refilled and the valve lever 1310 pivots upwardly to its upper position 1312, the linkage 1405 will positively move from the folded position 1490 to the upright or over center position 1480.

Overflow Tube Manifold 1550

As can best be seen in FIGS. 28 and 33-35, in one exemplary embodiment, the fill valve assembly 1000 of the present disclosure includes the overflow tube manifold 1550 is adapted to be coupled to a second end 1504 of the fill tube 1500 and directs water flowing through the fill tube 1500 during a flush/refill cycle into an upper end of the overflow tube for purposes of filling the toilet bowl. In one exemplary embodiment, the manifold 1550 advantageously allows the owner to select between three differing flow rates through the manifold 1500, resulting in three different volumes of water directed into the overflow tube during a flush/refill cycle, in an attempt to properly match the volume of water actually in the toilet bowl at the end of a flush/refill cycle with the volume of water desired to be in the toilet bowl, while minimizing any overfilling of the toilet bowl during the flush/refill cycle. In one exemplary embodiment, the manifold 1550 includes a body 1551 and an elongated hanger 1560 extending outwardly and transversely from the body 1551 for purposes of securing the manifold 1550 to the upper end 82 of the overflow tube 80.

The body 1551 of the manifold 1550 includes a generally planar upper surface 1551*a* and a spaced apart generally planar lower surface 1551*b*. Disposed on the upper surface 1551*a* of the body 1551 are plurality of inlet ports 1552 which are in fluid communication with an aligned one of a plurality of outlet ports 1570 disposed on the lower surface 1551*a* of the body 1551. In one exemplary embodiment, the plurality of inlet ports 1552 include three inlet ports 1554, 1556, 1558, positioned on the planar upper surface 1551*a* in a generally triangular configuration, and correspondingly, the plurality of outlet ports 1570 include three outlet ports 1574, 1576, 1578. Outlet port 1574 corresponds to and is in fluid communication with inlet port 1554. Outlet port 1576 corresponds to and is in fluid communication with inlet port 1556. Outlet port 1578 corresponds to and is in fluid communication with inlet port 1558.

Figure 34:
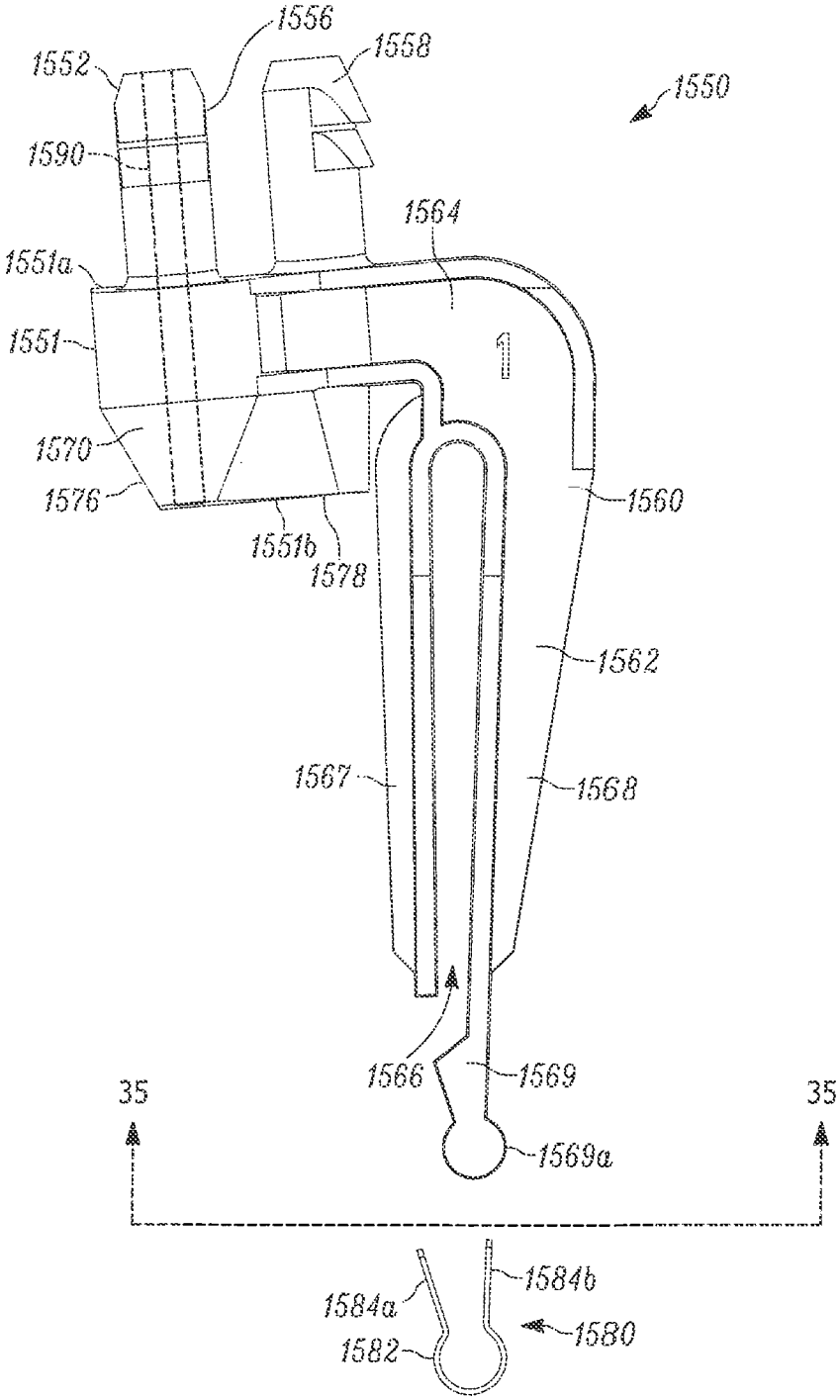
FIG. 34 is a schematic side elevation view of the manifold of FIG. 32.
Figure 35:
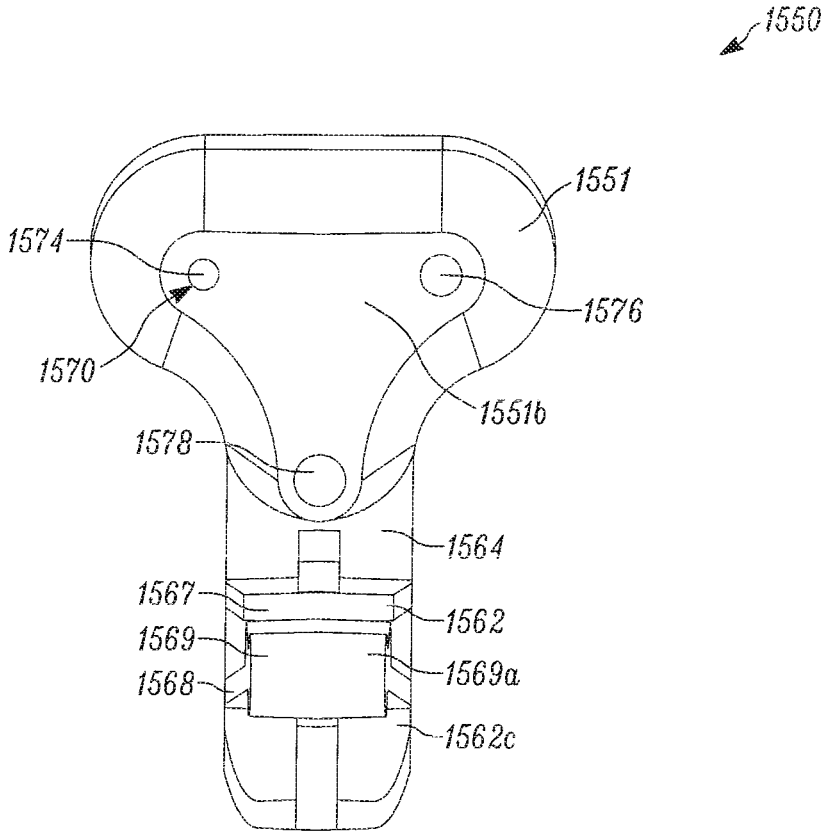
FIG. 35 is a schematic bottom plan view of the manifold of FIG. 32, as seen from a plane indicated by the line 35-35 in FIG. 34.

In one exemplary embodiment, the plurality of outlet ports 1570 are also in a generally triangular configuration on the lower surface 1551*a* of the body 1551 because the three water passageways or internal water flow channels through the body 1551 between respective inlet and outlet ports are all generally linear and are all generally orthogonal to the planar upper and lower surfaces 1551*a*, 1551*b* of the body 1551. In FIG. 34, one of the three internal water flow channels through the manifold body 1551 is schematically depicted, specifically, the water flow channel 1590 extending between inlet port 1556 and outlet port 1576 is depicted in dashed line. The second end 1504 of the fill tube 1500 may be operatively connected to any one of the plurality of inlet ports 1552, namely, any one of inlet ports 1554, 1556, 1558, to receive supply line water from the fill tube 1500. Regardless of the inlet port 1552, 1554, 1556 of the plurality of inlet ports 1552 selected, supply line water will exit the manifold 1550 through its corresponding outlet port, namely, the corresponding one of the plurality of outlet ports 1570, namely, one of the outlet ports 1574, 1576, 1578 and thereby be directed into the overflow tube 80 via the selected outlet port.

Advantageously, each of the three inlet ports 1554, 1556, 1558 of the plurality of inlet ports 1552 affords a different flow rate of water through the manifold 1550 due to differing diameter openings of the three internal water flow channels or water passageways, such as water flow channel 1590, extending between the inlet ports 1554, 1556, 1558 and the corresponding outlet ports 1574, 1576, 1578. Thus, for a given water flow rate into the fill tube 1500, depending upon the manifold inlet port 1554, 1556, 1558 of the plurality of inlet ports 1552 selected by the owner to be connected to the second end 1504 of the fill tube 1500, the volume of water exiting the corresponding outlet port 1574, 1576, 1578 of the plurality of outlet ports 1570 and directed into the overflow tube 80 for purposes of filling the toilet bowl will change. Through trial and error, the user will select the inlet port of the plurality of manifold inlet ports 1552 that results in most closely matching the volume of water in the toilet bowl at the end of a flush/refill cycle with the volume of water desired to be in the toilet bowl, while minimizing overfilling of the toilet bowl during the flush/refill cycle. As would be appreciated by one of skill in the art, the manifold 1550 may be modified to include any number of inlet and outlet ports, e.g., four, five, six or more inlet and outlet ports, thereby providing for four, five, six or more different flow rates of water through the manifold 1550.

The hanger 1560 of the manifold 1550 includes an elongated vertically oriented leg 1562 that is coupled to the manifold body 1551 by a horizontal bridge 1564. The leg 1562 includes an inner leg 1567, which extends into the overflow tube 80, and an outer leg 1568, which extends along the outer surface of the overflow tube 80. Between the inner and outer legs 1567, 1568 is a vertically extending slot 566 that is sized to snugly be received on the upper end 82 of the overflow tube 80 for purposes to securing the manifold 1550 on the overflow tube 80 and to properly position the manifold body 1551 such that water exiting the manifold 1550 through one of the plurality of exit or outlet ports 1570 is properly directed into a central opening of the overflow tube 80 to thereby fill the toilet bowl.

In one exemplary embodiment, to more securely affix the hanger 1560 and thereby the manifold 1550 to the overflow tube 80, a distal end 1569 of the outer leg 1568 includes a pedestal 1569*a* and a flexible clip 1580 configures to be mounted to and overlie the pedestal 1569*a*. Specifically, the pedestal 1569*a* is configured to snugly receive a clip 1580 in a snap fit type arrangement. The clip 1580 includes a central cylindrical section 1582 and a pair of upwardly extending arms 1584*a*, 1585*b*. The central cylindrical section 1582 of the clip 1580 is received on corresponding cylindrical portion of the pedestal 1569*a* of the outer leg 1568. When the hanger 1560 is installed on the upper end 82 of the overflow tube 80, the upwardly extending arm 1584*a* adjacent the overflow tube 80, urges or pushes against the outer surface 84 of the overflow tube 80 causing the inner leg 1567 of the hanger 1560 to bear with greater force against an inner surface 86 of the overflow tube 80. Thus, the bearing action of the upwardly extending arm 1584*a* of the clip 1580 against the outer surface 84 of the overflow tube 80 thereby increases the three of the mechanical coupling between the hanger 1560 and the overflow tube 80 and increases stability of the manifold 1550 as mounted to the overflow tube 80 and making it less likely that the manifold 1550 will be dislodged during flush actuations or when the owner seeks remove the second end 1504 of the fill tube 1500 from the selected one of the plurality manifold inlet ports 1552 (e.g., inlet port 1554) then connect the second end 1504 of the fill tube 1500 to a different one of the plurality of manifold inlet ports 1552 (e.g., inlet port 1556).

As used herein, the terms "up", "down", "axial", "axially", "radial" and "radially" and the like refer to relative positions with respect to the fill valve assembly longitudinal axis 100. "Axially above/below" or "axially spaced above/below", as used herein, means positioned above or below, as the case may be, as viewed with respect to the longitudinal axis LA, even if the elements being referred to are not in exact axial alignment with respect to the axis. Terms of orientation and/or direction such as front, rear, forward, rearward, distal, proximal, distally, proximally, upper, lower, inward, outward, inwardly, outwardly, horizontal, horizontally, vertical, vertically, axial, radial, longitudinal, axially, radially, longitudinally, etc., are provided for convenience purposes and relate generally to the orientation shown in the Figures and/or discussed in the Detailed Description. Such orientation/direction terms are not intended to limit the scope of the present disclosure, this application, and/or the invention or inventions described therein, and/or any of the claims appended hereto. Further, as used herein, the terms comprise, comprises, and comprising are taken to specify the presence of stated features, elements, integers, steps or components, but do not preclude the presence or addition of one or more other features, elements, integers, steps or components. What have been described above are examples or embodiments of the present invention. It is, of course, not possible to describe every conceivable combination of components or methodologies for purposes of describing the present invention or disclosure, but one of ordinary skill in the art will recognize that many further combinations and permutations of the present invention/disclosure are possible. Accordingly, the present invention/disclosure is intended to embrace all such alterations, modifications, and variations that fall within the spirit and scope of the appended claims.

What is claimed is:

1. A fill valve assembly for use in a water storage tank, the fill valve assembly comprising:

a tube assembly including a tube defining a throughbore and a longitudinal axis extending through the throughbore, the tube assembly in fluid communication with a water supply;

an inlet valve assembly supported by the tube and including an inlet valve and a valve lever operatively coupled to the inlet valve, in a first position of the valve lever, the inlet valve being in an off state and in a second position of the valve lever, the inlet valve being in an on state; and a linkage assembly positioned between the valve lever and the tube and pivoting between a first upright position wherein the valve lever is in the first position and a second folded position, the linkage assembly comprising a linkage including an upper link, a lower link, and a pivot member pivotally connecting the upper link and the lower link, the pivot member defining a pivot axis of the linkage, the pivot axis being transverse to the longitudinal axis of the tube.

2. The fill valve assembly of claim 1 wherein in the second folded position, the valve lever is in the second position.

3. The fill valve assembly of claim 1 wherein the tube assembly further includes a float constrained for axial movement in a direction along the tube and coupled to the valve lever such that the float is constrained from axial movement when the linkage assembly is in the upright position.

4. The fill valve assembly of claim 1 wherein the linkage assembly includes a hearing disposed on a lower surface of the valve lever of the inlet valve assembly and the upper link of the linkage is rotatably supported by the bearing.

5. The fill valve assembly of claim 1 wherein the linkage assembly includes a bearing disposed on a pedestal extending from an outer wall of the tube and the lower link is rotatably supported by a bearing disposed.

6. The fill valve assembly of claim 1 wherein the upper link of the linkage includes a first upright and a second upright bridged by the pivot member and an actuation arm including an extension offset from the first and second uprights and being moved in a general direction away from the tube longitudinal axis to pivot the linkage assembly from the upright position to the folded position.

7. The fill valve assembly of claim 6 wherein the actuation arm extends from a lower end portion of the first upright.

8. The fill valve assembly of claim 1 wherein in the upright position of the linkage assembly, when viewed with respect to the tube longitudinal axis, the upper link and lower link are concave with respect to the tube longitudinal axis.

9. The fill valve assembly of claim 1 wherein when pivoting from the first upright position to the second folded position the pivot member of the linkage assembly moves in a general direction away from the tube longitudinal axis.

10. The fill valve assembly of claim 9 wherein the upper link includes an extension arm extending transversely from the upper link and a stop near an end of the extension arm, the stop contacting the lower link in the upright position to limit angular movement of the upper link and the lower link as the pivot member moves in a direction toward the tube longitudinal axis when the linkage assembly moves from the second folded position to the first upright position.

11. The fill valve assembly of claim 1 wherein the tube of the tube assembly includes a first lower stem and a second upper sleeve telescopically mounted on the first lower stet a and movable along the tube longitudinal axis.

12. The fill valve assembly of claim 11 wherein the tube assembly includes a tube height adjustment assembly comprising a cam member position on the second upper sleeve and a plurality of axially spaced apart detents on the first lower stem, the tube height adjustment assembly including a locked position wherein a portion of the cam member extends into a selected one of the plurality of axially spaced apart detests to inhibit relative axial movement between the second upper sleeve and the first lower stem and an unlocked position wherein the cam member is disengaged from the plurality of axially spaced apart detent allowing relative axial movement between the second upper sleeve and the first lower stem.

13. The fill valve assembly of claim 12 wherein the cam member is a dowel pin pivotally mounted on the second upper sleeve and pivoting between first and second positions, the dowel pin including a cylindrical body and a recesses portion extending longitudinally along the cylindrical body, in the locked position of the tube height adjustment assembly, the dowel pin being in the first position and the cylindrical body of the dowel pin extending into a selected one of the plurality of axially spaced apart detents to inhibit relative axial movement between the second upper sleeve and the first lower stem and in the unlocked position of the tube height adjustment assembly, the dowel pin being in the second position and the recessed portion of the cylindrical body of the dowel pin faces the first lower stem such that the dowel pin is disengaged from the plurality of spaced apart detents to allow relative axial movement between the second upper sleeve and the first lower stem.

14. The fill valve assembly of claim 1 wherein the tube of the tube assembly includes a threaded lower shank extending through a bottom wall of the water storage tank, the tube assembly further including a torque limiting nut is threaded onto the lower shank to secure the fill tube assembly to the bottom wall of the water storage tank, the torque limiting nut including an inner threaded member and an outer driver member radially surrounding the inner driver member, the inner threaded member including a cylindrical body defining a longitudinal axis of the torque limiting nut, the cylindrical body including an upper end and an axially spaced apart lower end and an outer wall and a radially spaced apart inner wall, the inner wall including a threaded opening, the outer wall including an annular rim extending radially outwardly, a lower axial surface of the rim includes a plurality of axially extending ramps, each of the ramps of the plurality of axially extending ramps including a downwardly facing angled bearing surface, an upper axial surface of the inner threaded member cylindrical body defines a bearing surface of the torque limiting nut, the outer driver member including the cylindrical body extending between an upper end and the axially spaced apart lower end and including an outer wall and a radially spaced apart inner wall, the inner wall including a central longitudinal opening which receives the inner threaded member, the upper end of the body of the outer driver member including a plurality of axially extending ramps, an upper surface of each ramp of the plurality of ramps defining an upwardly facing angled wedging surface, each ramp of the plurality of ramps having a base and being pivotable about the base in an axial direction substantially parallel to the longitudinal axis of the torque limiting nut, the upwardly facing angled wedging surfaces of the plurality of ramps of the outer driver member engaging corresponding downwardly facing angled bearing surfaces of the plurality of ramps of the inner threaded member such that as the outer driver member is rotated about the longitudinal axis of the torque limiting nut, the inner threaded member is also rotated.

15. The fill valve assembly of claim 14 wherein the outer driver member of the torque limiting nut includes slots disposed axially below each of the ramps of the plurality of ramps to provide for pivotable movement of each of the ramps of the plurality of ramps about its respective base in the axial direction substantially parallel to the longitudinal axis of the torque limiting nut.

16. The fill valve assembly of claim 14 wherein the outer driver member of the torque limiting nut includes a pair of radially extending gripping wings extending outwardly from the outer wall of the outer driver member cylindrical body.

17. A fill valve assembly for use in a toilet tank, the fill valve assembly comprising: a tube defining a throughbore and a longitudinal axis extending through the throughbore, the tube in fluid communication with a water supply; an inlet valve assembly supported by the tube and including an inlet valve and a valve lever operatively coupled to the inlet valve, in a first position of the valve lever, the inlet valve being in an on state and in a second position of the inlet valve, the inlet valve being in an off state, the inlet valve being in fluid communication with the tube such that in the on state of the inlet valve water flows though the tube and into the toilet tank; a float constrained for axial movement in a direction along a along the tube; and a linkage assembly positioned between the valve lever and the tube and pivoting between a first upright position wherein the valve lever is maintained in the first position and a second folded position, the linkage including an upper link, a lower link, a pivot member pivotally connecting the upper link and the lower link and defining a pivot axis of the linkage, the pivot axis transverse to the longitudinal axis of the tube, the float coupled to the valve lever such that the float is constrained from axial movement when the linkage assembly is in the upright position.

18. A fill valve assembly for use in a water storage tank, the fill valve assembly comprising:

a tube assembly including a tube defining a throughbore and a longitudinal axis extending through the throughbore, the tube in fluid communication with a water supply, the tube including a first lower stem and a second upper sleeve telescopically mounted on the first lower stem and movable along the tube longitudinal axis;

an inlet valve assembly supported by the tube and including an inlet valve and a valve lever operatively coupled to the inlet valve, in a first position of the valve lever, the inlet valve being in an off state and in a second position of the valve lever, the inlet valve being in an on state; and the tube assembly including a tube height adjustment assembly comprising a cam member positioned on the second upper sleeve and a plurality of axially spaced apart detents on the first lower stem, the tube height adjustment assembly including a locked position wherein a portion of the cam member extends into a selected one of the plurality of axially spaced apart detents to inhibit relative axial movement between the second upper sleeve and the first lower stem and an unlocked position wherein the cam member is disengaged from the plurality of axially spaced apart decent allowing relative axial movement between the second upper sleeve and the first lower stem.

19. A fill valve assembly for use in a water storage tank, the fill valve assembly comprising:

a tube assembly including a tube defining a throughbore and a longitudinal axis extending through the throughbore, the tube in fluid communication with a water supply, the tube having a threaded lower shank extending through a bottom wall of the water storage tank;

an inlet valve assembly supported by the tube and including an inlet valve and a valve lever operatively coupled to the inlet valve, in a first position of the valve lever, the inlet valve being in an off state and in a second position of the valve lever, the inlet valve being in an on state;

a torque limiting nut is threaded onto the lower shank to secure the fill tube assembly to the bottom wall of the water storage tank, the torque limiting nut including an inner threaded member and an outer driver member radially surrounding the inner driver member, the inner threaded member including a cylindrical body defining a longitudinal axis of the torque limiting nut, the cylindrical body including an upper end and an axially spaced apart lower end and an outer wall and a radially spaced apart inner wall, the inner wall including a threaded opening, the outer wall including an annular rim extending radially outwardly, a lower axial surface of the rim includes a plurality of axially extending ramps, each of the ramps of the plurality of axially extending ramps including a downwardly facing angled bearing surface, an upper axial surface of the inner threaded member cylindrical body defines a bearing surface of the torque limiting nut, the outer driver member including the cylindrical body extending between an upper end and the axially spaced apart lower end and including an outer wall and a radially spaced apart inner wall, the inner wall including a central longitudinal opening which receives the inner threaded member, the upper end of the body of the outer driver member including a plurality of axially extending ramps, an upper surface of each ramp of the plurality of ramps defining an upwardly facing angled wedging surface, each ramp of the plurality of ramps having a base and being pivotable about the base in an axial direction substantially parallel to the longitudinal axis of the torque limiting nut, the upwardly facing angled wedging surfaces of the plurality of ramps of the outer driver member engaging corresponding downwardly facing angled bearing surfaces of the plurality of ramps of the inner threaded member such that as the outer driver member is rotated about the longitudinal axis of the torque limiting nut, the inner threaded member is also rotated.

20. The fill valve assembly of claim 19 wherein the outer driver member of the torque limiting nut includes slots disposed axially below each of the ramps of the plurality of ramps to provide for pivotal movement of each of the ramps of the plurality of ramps about its respective base in the axial direction substantially parallel to the longitudinal axis of the torque limiting nut.

21. The fill valve assembly of claim 19 wherein the outer driver member of the torque limiting nut includes a pair of radially extending gripping wings extending outwardly from the outer wall of the outer driver member cylindrical body.

22. The fill valve assembly of claim 1 further including a manifold in fluid communication with the inlet valve assembly, the manifold including a body having a plurality of inlet ports defined on a first surface of the body and a corresponding plurality of outlet ports defined on a second surface of the body, each of the plurality of water inlet ports in fluid communication with a corresponding different one of the plurality of water outlet ports via a flow channel extending between the water inlet port and corresponding the water outlet port, each water inlet port of the plurality of water inlet ports having a differing water flow rate through the corresponding flow channel.

23. The fill valve assembly of claim 17 further including a manifold in fluid communication with the inlet valve assembly, the manifold including a body having a plurality of inlet ports defined on a first surface of the body and a corresponding plurality of outlet ports defined on a second surface of the body, each of the plurality of water inlet ports in fluid communication with a corresponding different one of the plurality of water outlet ports via a flow channel extending between the water inlet port and corresponding the water outlet port, each water inlet port of the plurality of water inlet ports having a differing water flow rate through the corresponding flow channel.

24. The fill valve assembly of claim 18 further including a manifold in fluid communication with the inlet valve assembly, the manifold including a body having a plurality of inlet ports defined on a first surface of the body and a corresponding plurality of outlet ports defined on a second surface of the body, each of the plurality of water inlet ports in fluid communication with a corresponding different one of the plurality of water outlet ports via a flow channel extending between the water inlet port and corresponding the water outlet port, each water inlet port of the plurality of water inlet ports having a differing water flow rate through the corresponding flow channel.

25. The fill valve assembly of claim 19 further including a manifold in fluid communication with the inlet valve assembly, the manifold including a body having a plurality of inlet ports defined on a first surface of the body and a corresponding plurality of outlet ports defined on a second surface of the body, each of the plurality of water inlet ports in fluid communication with a corresponding different one of the plurality of water outlet ports via a flow channel extending between the water inlet port and corresponding the water outlet port, each water inlet port of the plurality of water inlet ports having a differing water flow rate through the corresponding flow channel.

* * * * *